US012114701B2

(12) United States Patent
Lord et al.

(10) Patent No.: US 12,114,701 B2
(45) Date of Patent: Oct. 15, 2024

(54) AEROSOL DELIVERY SYSTEM

(71) Applicant: Imperial Tobacco Limited

(72) Inventors: Chris Lord, Liverpool (GB); Thomas Sudlow, Liverpool (GB); Ben Illidge, Liverpool (GB); Alfred Madden, Liverpool (GB); Ben Astbury, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 485 days.

(21) Appl. No.: 17/476,088

(22) Filed: Sep. 15, 2021

(65) Prior Publication Data

US 2022/0071289 A1 Mar. 10, 2022

Related U.S. Application Data

(63) Continuation of application No. PCT/EP2020/057323, filed on Mar. 17, 2020, and a (Continued)

(30) Foreign Application Priority Data

Mar. 21, 2019 (EP) ..... 19164428
Mar. 21, 2019 (EP) ..... 19164435

(Continued)

(51) Int. Cl.
*A24F 40/46* (2020.01)
*A24F 40/10* (2020.01)

(Continued)

(52) U.S. Cl.
CPC ..... *A24F 40/46* (2020.01); *A24F 40/10* (2020.01); *A24F 40/44* (2020.01); *A24F 40/485* (2020.01)

(58) Field of Classification Search
CPC ..... A24F 40/46; A24F 40/10; A24F 40/44; A24F 40/485

(Continued)

(56) References Cited

U.S. PATENT DOCUMENTS 5,894,841 A 4/1999 Voges
8,910,640 B2 * 12/2014 Sears ..... F22B 1/28 131/194

(Continued)

FOREIGN PATENT DOCUMENTS

CN 204444252 U 7/2015
CN 106418700 A 2/2017

(Continued)

OTHER PUBLICATIONS

European Patent Office; Extended European Search Report regarding European Patent Application No. EP19164478.0, filed Mar. 21, 2019, dated Oct. 7, 2019.

(Continued)

*Primary Examiner* — Alexander Gilman
(74) *Attorney, Agent, or Firm* — DUNLAP CODDING, P.C.

(57) ABSTRACT

An aerosol delivery device comprises an aerosol-generation apparatus, including a heater and a fluid-transfer article. The fluid-transfer article has a reservoir for the holding an aerosol precursor, a wick arrangement to receive aerosol precursor from the reservoir, and a wick support element. The wick support element has at least one capillary bore therethrough. Hence, it allows aerosol precursor to pass from the reservoir to the wick in a capillary manner through the or each bore. Preferably, the heater makes abutting, unbonded contact with an activation surface of the wick soas to interact thermally therewith. This allows the heater to separable from the wick, for example, when the fluid- (Continued)

transfer article is separated from the rest of the device. This may be necessary when the aerosol precursor in the reservoir of the fluid transfer article has been consumed.

9 Claims, 65 Drawing Sheets

Related U.S. Application Data continuation of application No. PCT/EP2020/057355, filed on Mar. 17, 2020, and a continuation of application No. PCT/EP2020/057327, filed on Mar. 17, 2020, and a continuation of application No. PCT/EP2020/057326, filed on Mar. 17, 2020, and a continuation of application No. PCT/EP2020/057356, filed on Mar. 17, 2020, and a continuation of application No. PCT/EP2020/057341, filed on Mar. 17, 2020.

(30) Foreign Application Priority Data

| | | |
|---|---|---|
| Mar. 21, 2019 | (EP) | 19164438 |
| Mar. 21, 2019 | (EP) | 19164442 |
| Mar. 21, 2019 | (EP) | 19164455 |
| Mar. 21, 2019 | (EP) | 19164460 |
| Mar. 21, 2019 | (EP) | 19164473 |
| Mar. 21, 2019 | (EP) | 19164476 |
| Mar. 21, 2019 | (EP) | 19164478 |

(51) Int. Cl.
*A24F 40/44* (2020.01)
*A24F 40/485* (2020.01)

(58) Field of Classification Search
USPC ..... 131/329
See application file for complete search history.

(56) References Cited

U.S. PATENT DOCUMENTS

| | | | | |
|---|---|---|---|---|
| 11,564,287 | B2 * | 1/2023 | Jobanputra | A24F 40/46 |
| 11,606,979 | B2 * | 3/2023 | Mironov | H05B 6/362 |
| 2013/0255675 | A1 | 10/2013 | Liu | |
| 2014/0007863 | A1 | 1/2014 | Chen | |
| 2014/0069424 | A1 | 3/2014 | Poston et al. | |
| 2014/0190496 | A1 | 7/2014 | Wensley et al. | |
| 2014/0334802 | A1 | 11/2014 | Dubief | |
| 2015/0034103 | A1 | 2/2015 | Hon | |
| 2015/0217068 | A1 | 8/2015 | Wakalopulos | |
| 2016/0121058 | A1 | 5/2016 | Chen | |
| 2016/0143365 | A1 | 5/2016 | Liu | |
| 2017/0035109 | A1 * | 2/2017 | Liu | A24F 40/42 |
| 2017/0105452 | A1 * | 4/2017 | Mironov | A24F 40/42 |
| 2017/0280775 | A1 | 10/2017 | Manca et al. | |
| 2017/0290370 | A1 * | 10/2017 | Garthaffner | A61M 11/042 |
| 2017/0303586 | A1 | 10/2017 | Sur | |
| 2017/0340011 | A1 | 11/2017 | Batista | |
| 2017/0367402 | A1 | 12/2017 | Lau et al. | |
| 2018/0020721 | A1 | 1/2018 | Garthaffner et al. | |
| 2018/0027875 | A1 * | 2/2018 | Rostami | A61M 15/06 |
| 2018/0027876 | A1 | 2/2018 | Watson et al. | |
| 2018/0160735 | A1 * | 6/2018 | Borkovec | A24F 40/60 |
| 2018/0289067 | A1 * | 10/2018 | Courbat | A24F 40/44 |
| 2019/0142066 | A1 * | 5/2019 | Gill | A24F 40/51 131/329 |

FOREIGN PATENT DOCUMENTS

| | | | |
|---|---|---|---|
| CN | 106820272 | A | 6/2017 |
| CN | 207100509 | U | 3/2018 |
| DE | 102014114133 | A1 | 3/2016 |
| DE | 102016120803 | A1 | 5/2018 |
| EP | 2965642 | A1 | 1/2016 |
| EP | 3100621 | A1 | 12/2016 |
| EP | 3153033 | A1 | 4/2017 |
| GB | 2547699 | B | 8/2017 |
| GB | 2561958 | A | 10/2018 |
| WO | WO2011042212 | A1 | 4/2011 |
| WO | WO2014177859 | A1 | 11/2014 |
| WO | WO2014177860 | A1 | 11/2014 |
| WO | WO2016096497 | A1 | 6/2016 |
| WO | WO2016124740 | A1 | 8/2016 |
| WO | WO2017191176 | A1 | 9/2017 |
| WO | WO2018032671 | A1 | 2/2018 |
| WO | WO2018083007 | A1 | 5/2018 |
| WO | WO2018161254 | A1 | 9/2018 |
| WO | WO2018197511 | A1 | 11/2018 |
| WO | WO2018211035 | A1 | 11/2018 |

OTHER PUBLICATIONS

European Patent Office; Extended European Search Report regarding European Patent Application No. EP19164476.4, filed Mar. 21, 2019, dated Sep. 25, 2019.
European Patent Office; Extended European Search Report regarding European Patent Application No. EP19164473.1, filed Mar. 21, 2019, dated Sep. 23, 2019.
European Patent Office; Extended European Search Report regarding European Patent Application No. EP19164460.8 filed Mar. 21, 2019, dated Sep. 26, 2019.
European Patent Office; Extended European Search Report regarding European Patent Application No. EP19164455.8 filed Mar. 21, 2019, dated Sep. 26, 2019.
European Patent Office; Extended European Search Report regarding European Patent Application No. EP19164442.6 filed Mar. 21, 2019, dated Sep. 27, 2019.
European Patent Office; Extended European Search Report regarding European Patent Application No. EP19164438.4 filed Mar. 21, 2019, dated Sep. 27, 2019.
European Patent Office; Extended European Search Report regarding European Patent Application No. EP19164435.0 filed Mar. 21, 2019, dated Sep. 26, 2019.
European Patent Office; Extended European Search Report regarding European Patent Application No. EP19164428.5 filed Mar. 21, 2019, dated Sep. 26, 2019.

* cited by examiner

AEROSOL DELIVERY SYSTEM

CROSS REFERENCE TO RELATED APPLICATIONS/INCORPORATION BY REFERENCE STATEMENT

This application is a non-provisional application claiming benefit to the international application no. PCT/EP20/57341 filed on Mar. 17, 2020, which claims priority to EP 19164438.4 filed Mar. 21, 2019 and EP 19164442.6 filed Mar. 21, 2019. This application also claims benefit to the international application no. PCT/EP20/57356 filed Mar. 17, 2020, which claims priority to EP 19164428.5 filed Mar. 21, 2019. This application also claims benefit to the international application no. PCT/EP20/57323 filed Mar. 17, 2020, which claims priority to EP 19164460.8 filed Mar. 21, 2019. This application also claims benefit to the international application no. PCT/EP20/57326 filed Mar. 17, 2020, which claims priority to EP 19164455.8 filed Mar. 21, 2019. This application also claims benefit to the international application no. PCT/EP20/57327 filed Mar. 17, 2020, which claims priority to EP 19164435.0 filed Mar. 21, 2019. This application also claims benefit to the international application no. PCT/EP20/57355 filed Mar. 17, 2020, which claims priority to EP 19164473.1 filed Mar. 21, 2019 and to EP 19164476.4 filed Mar. 21, 2019 and to EP 19164478.0 filed Mar. 21, 2019

FIELD OF THE DISCLOSURE

The present disclosure relates to an aerosol delivery device and to an aerosol-generation apparatus for an aerosol delivery device. The present disclosure preferably relates to an aerosol delivery device including a heater arranged to heat an aerosol precursor to generate an aerosolised composition for inhalation by a user, and to an aerosol-generation apparatus therefor.

BACKGROUND

A smoking-substitute device or system is an electronic device that permits the user to simulate the act of smoking by producing an aerosol mist or vapour that is drawn into the lungs through the mouth and then exhaled. The inhaled aerosol mist or vapour typically bears nicotine and/or other flavourings without the odour and health risks associated with traditional smoking and tobacco products. In use, the user experiences a similar satisfaction and physical sensation to those experienced from a traditional smoking or tobacco product, and exhales an aerosol mist or vapour of similar appearance to the smoke exhaled when using such traditional smoking or tobacco products.

One approach for a smoking substitute device is the so-called "vaping" approach, in which a vaporisable liquid, typically referred to (and referred to herein) as "e-liquid", is heated by a heater to produce an aerosol vapour which is inhaled by a user. The e-liquid typically includes a base liquid as well as nicotine and/or flavourings. The resulting vapour therefore also typically contains nicotine and/or flavourings. The base liquid may include propylene glycol and/or vegetable glycerine.

A typical vaping smoking substitute device includes a mouthpiece, a power source (typically a battery), a tank for containing e-liquid, as well as a heater. In use, electrical energy is supplied from the power source to the heater, which heats the e-liquid to produce an aerosol (or "vapour") which is inhaled by a user through the mouthpiece.

Vaping smoking substitute devices can be configured in a variety of ways. For example, there are "closed system" vaping smoking substitute devices, which typically have a sealed tank and heating element. The tank is pre-filled with e liquid and is not intended to be refilled by an end user. One subset of closed system vaping smoking substitute devices include a main body which includes the power source, wherein the main body is configured to be physically and electrically coupled to a consumable including the tank and the heater. The consumable may also be referred to as a cartomizer. In this way, when the tank of a consumable has been emptied, that consumable is disposed of. The main body can be reused by connecting it to a new, replacement, consumable. Another subset of closed system vaping smoking substitute devices are completely disposable, and intended for one-use only.

There are also "open system" vaping smoking substitute devices which typically have a tank that is configured to be refilled by a user. In this way the device can be used multiple times.

An example vaping smoking substitute device is the Myblu™ e-cigarette. The Myblu™ e cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid (also referred to as an aerosol precursor), as well as a heater, which for this device is a heating filament coiled around a portion of a wick. The wick is partially immersed in the e-liquid, and conveys e-liquid from the tank to the heating filament. The device is activated when a microprocessor on board the main body detects a user inhaling through the mouthpiece. When the device is activated, electrical energy is supplied from the power source to the heater, which heats e-liquid from the tank to produce a vapour which is inhaled by a user through the mouthpiece.

For a smoking substitute device it is desirable to deliver nicotine into the user's lungs, where it can be absorbed into the bloodstream. As explained above, in the so-called "vaping" approach, "e-liquid" is heated by a heating device to produce an aerosol vapour which is inhaled by a user. Many e-cigarettes also deliver flavour to the user, to enhance the experience. Flavour compounds are contained in the e-liquid that is heated. Heating of the flavour compounds may be undesirable as the flavour compounds are inhaled into the user's lungs. Toxicology restrictions are placed on the amount of flavour that can be contained in the e-liquid. This can result in some e-liquid flavours delivering a weak and underwhelming taste sensation to consumers in the pursuit of safety.

In aerosol delivery devices, it is desirable to avoid large liquid droplets reaching a user's mouth.

Pharmaceutical medicament, physiologically active substances and flavourings for example may be delivered to the human body by inhalation through the mouth and/or nose. Such material or substances may be delivered directly to the mucosa or mucous membrane lining the nasal and oral passages and/or the pulmonary system. For example, nicotine is consumed for therapeutic or recreational purposes and may be delivered to the body in a number of ways. Nicotine replacement therapies are aimed at people who wish to stop smoking and overcome their dependence on nicotine. Nicotine is delivered to the body in the form of aerosol delivery devices and systems, also known as smoking-substitute devices or nicotine delivery devices. Such devices may be non-powered or powered.

Devices or systems that are non-powered may comprise nicotine replacement therapy devices such as "inhalators", e.g. Nicorette® Inhalator. These generally have the appearance of a plastic cigarette and are used by people who crave the behaviour associated with consumption of combustible tobacco—the so-called hand-to-mouth aspect—of smoking tobacco. Inhalators generally allow nicotine-containing aerosol to be inhaled through an elongate tube in which a container containing a nicotine carrier, for example, a substrate, is located. An air stream caused by suction through the tube by the user carries nicotine vapours into the lungs of the user to satisfy a nicotine craving. The container may comprise a replaceable cartridge, which includes a cartridge housing and a passageway in the housing in which a nicotine reservoir is located. The reservoir holds a measured amount of nicotine in the form of the nicotine carrier. The measured amount of nicotine is an amount suitable for delivering a specific number of "doses". The form of the nicotine carrier is such as to allow nicotine vapour to be released into a fluid stream passing around or through the reservoir. This process is known as aerosolization and or atomization. Aerosolization is the process or act of converting a physical substance into the form of particles small and light enough to be carried on the air i.e. into an aerosol. Atomization is the process or act of separating or reducing a physical substance into fine particles and may include the generation of aerosols. The passageway generally has an opening at each end for communication with the exterior of the housing and for allowing the fluid stream through the passageway. A nicotine-impermeable barrier seals the reservoir from atmosphere. The barrier includes passageway barrier portions for sealing the passageway on both sides of the reservoir. These barrier portions are frangible so as to be penetrable for opening the passageway to atmosphere.

A device or a system that is powered can fall into two sub-categories. In both subcategories, such devices or systems may comprise electronic devices or systems that permit a user to simulate the act of smoking by producing an aerosol mist or vapour that is drawn into the lungs through the mouth and then exhaled. The electronic devices or systems typically cause the vaporization of a liquid containing nicotine and entrainment of the vapour into an airstream. Vaporization of an element or compound is a phase transition from the liquid phase to vapour i.e. evaporation or boiling. In use, the user experiences a similar satisfaction and physical sensation to those experienced from a traditional smoking or tobacco product, and exhales an aerosol mist or vapour of similar appearance to the smoke exhaled when using such traditional smoking or tobacco products.

A person of ordinary skill in the art will appreciate that devices or systems of the second, powered category as used herein include, but are not limited to, electronic nicotine delivery systems, electronic cigarettes, e-cigarettes, e-cigs, vaping cigarettes, pipes, cigars, cigarillos, vaporizers and devices of a similar nature that function to produce an aerosol mist or vapour that is inhaled by a user. Such nicotine delivery devices or systems of the second category incorporate a liquid reservoir element generally including a vaporizer or misting element such as a heating element or other suitable element, and are known, inter alia, as atomizers, cartomizers, or clearomizers. Some electronic cigarettes are disposable; others are reusable, with replaceable and refillable parts.

Aerosol delivery devices or systems in a first sub-category of the second, powered category generally use heat and/or ultrasonic agitation to vaporize a solution comprising nicotine and/or other flavouring, propylene glycol and/or glycerine-based base into an aerosol mist of vapour for inhalation.

Aerosol delivery devices or systems in a second sub-category of the second, powered category may typically comprise devices or systems in which tobacco is heated rather than combusted. During use, volatile compounds may be released from the tobacco by heat transfer from the heat source and entrained in air drawn through the aerosol delivery device or system. Direct contact between a heat source of the aerosol delivery device or system and the tobacco heats the tobacco to form an aerosol. As the aerosol containing the released compounds passes through the device, it cools and condenses to form an aerosol for inhalation by the user. In such devices or systems, heating, as opposed to burning, the tobacco may reduce the odour that can arise through combustion and pyrolytic degradation of tobacco.

Aerosol delivery devices or systems falling into the first sub-category of powered devices or systems may typically comprise a powered unit, comprising a heater element, which is arranged to heat a portion of a carrier that holds an aerosol precursor. The carrier comprises a substrate formed of a "wicking" material, which can absorb aerosol precursor liquid from a reservoir and hold the aerosol precursor liquid. Upon activation of the heater element, aerosol precursor liquid in the portion of the carrier in the vicinity of the heater element is vaporised and released from the carrier into an airstream flowing around the heater and carrier. Released aerosol precursor is entrained into the airstream to be borne by the airstream to an outlet of the device or system, from where it can be inhaled by a user.

The heater element is typically a resistive coil heater, which is wrapped around a portion of the carrier and is usually located in the liquid reservoir of the device or system. Consequently, the surface of the heater may always be in contact with the aerosol precursor liquid, and long-term exposure may result in the degradation of either or both of the liquid and heater. Furthermore, residues may build up upon the surface of the heater element, which may result in undesirable toxicants being inhaled by the user. Furthermore, as the level of liquid in the reservoir diminishes through use, regions of the heater element may become exposed and overheat.

The present disclosure has been devised in light of the above considerations.

SUMMARY OF THE DISCLOSURE

First Mode of the Disclosure: Wick Support Element with a Bore

At its most general, an aspect of the first mode of the present disclosure proposes that an aerosol-generation apparatus has a reservoir for holding aerosol precursor, a wick arranged to receive aerosol precursor from the reservoir, and a wick support element between the reservoir and the wick. The wick support element has at least one bore therethrough for the passage of aerosol precursor from the reservoir to the wick. The reservoir, the wick and the wick support element may form parts of a fluid-transfer article, and the aerosol generation apparatus may also include a heater, which heater makes abutting unbonded contact with an activation surface of the wick to interact thermally therewith.

Thus, when aerosol precursor has passed to the wick, through the or each bore, the aerosol precursor may be heated by the heater to form a vapour which may then pass to a user of the aerosol-generation apparatus.

The or each bore may be a capillary bore for the passage of aerosol precursor from the reservoir to the wick in a capillary manner. The use of one or more capillary bores permit aerosol precursor to pass from the reservoir to the wick without the amount of aerosol precursor reaching the wick being excessive.

The wick support member may be rigid. The use of a rigid wick support element allows accurate positioning of the wick, so that the relative positions of the wick and heater may be determined precisely, even though the wick and heater are separable.

At its most general, another aspect of the present disclosure proposes that an aerosol delivery device has a fluid-transfer article with a wick, with the wick being supported by a wick support element which is integral with a casing of the aerosol delivery device. The fluid-transfer article will also normally comprise a reservoir holding an aerosol precursor, with that reservoir being within the casing. The aerosol delivery device may also have a heater, which makes contact with an activation surface of the wick so as to interact thermally with the activation surface, the wick preferably making abutted unbonded contact with the activation surface.

In this way, the manufacture of the aerosol delivery device may be simplified because the wick is supported by an element which may be moulded at the same time as the moulding of the casing. Separability of the wick and the wick support element from the heater allows the fluid-transfer article to be replaced, for example when the aerosol precursor therein is consumed, without having to replace the heater.

Thus, a first aspect of the present disclosure may provide an aerosol-generation apparatus comprising a heater and a fluid-transfer article, the fluid-transfer article comprising a reservoir for holding an aerosol precursor, a wick arranged to receive aerosol precursor from said reservoir, and a wick support element; wherein said wick support element is arranged to support said wick such that said heater makes abutting unbonded contact with an activation surface of said wick so as to interact thermally with said activation surface; and wherein said wick support element is between said reservoir and said wick and has at least one capillary bore therethrough for passage of said aerosol precursor from said reservoir to said wick in a capillary manner.

A second aspect of the first mode of the present disclosure may provide an aerosol-generation apparatus comprising a heater and a fluid-transfer article, the fluid-transfer article comprising a reservoir for holding an aerosol precursor, a wick arranged to receive aerosol precursor from said reservoir, and a wick support element; wherein said wick support element is arranged to support said wick such that said heater makes abutting unbonded contact with an activation surface of said wick so as to interact thermally with said activation surface; and wherein said wick support element is between said reservoir and said wick, is rigid, and has at least one bore therethrough for passage of said aerosol precursor from said reservoir to said wick.

Preferably, said at least one bore in the wick support element is sized so as to define at least one capillary duct (also referred to herein as a capillary bore) through the wick support element so that flow of aerosol precursor therethrough occurs in a capillary manner.

A third aspect of the first mode of the present disclosure may provide an aerosol delivery device comprising a heater, a fluid-transfer article and a first casing, the fluid-transfer article comprising a reservoir for holding an aerosol precursor, a wick arranged to receive aerosol precursor from said reservoir, and a wick support element; wherein said wick support element is arranged to support said wick such that said heater makes abutting unbonded contact with an activation surface of said wick so as to interact thermally with said activation surface; and wherein said first casing contains said reservoir therein and said wick support element is integral with said first casing, said wick support element having at least one bore therethrough for passage of said aerosol precursor from said reservoir to said wick.

One possibility within the third aspect of the present disclosure is for the or each bore through the wick support element to be a non-capillary duct. This allows the aerosol precursor to flow in a non-capillary manner from the reservoir to the wick through the bore or bores. Another possibility is for the or each bore to be a capillary duct (also referred to herein as a capillary bore), so that the flow of aerosol precursor therethrough is controlled by capillary action.

In any of the above-noted aspects, the or each capillary bore may have a diameter of at least 0.3 mm, more preferably at least 0.5 mm. It is also preferable that the or each capillary bore has a diameter not greater than 2 mm. Thus, the or each capillary bore may have a diameter of 0.8 to 1.5 mm.

If said at least one bore forms at least one capillary duct, the flow of aerosol precursor therethrough will be influenced by the length of said at least one capillary duct, which length is determined by the thickness of the wick support element.

With such capillary bores, the wick support element may have a thickness of at least 0.5, more preferably 1 mm, between the reservoir and the wick. It is also preferable that the wick support element has a thickness not greater than 5 mm between the reservoir and the wick. Greater thicknesses may limit the amount of aerosol precursor which reaches the wick.

Preferably, the activation surface of the wick is planar, as this assists in ensuring efficient interaction with the heater. The wick support element may form an end wall of the reservoir of the reservoir. It is preferable that the wick support element is resilient, so that it biases the wick towards the heater to ensure good contact therebetween. For this purpose, the wick support element may be made of rubber material. The wick itself may be of silica material, or may be fibrous, woven or of porous ceramic material.

Preferably, the wick support element forms on the wall of the reservoir.

In order to form the casing containing the reservoir, it may comprise first and second casing parts, each being hollow and containing the reservoir. In this case, the wick support element may integral with the second casing part. Preferably, the first and second casing parts are separable.

The aerosol delivery device of the third aspect of the first mode may further include a second casing supporting the heater, with the first and second casings being separably interconnected. The abutting unbonded contact between the heater and the wick allows the heater to be separated from the wick, and remain with the second casing, when the first casing is removed from the second casing.

In such a structure, it is preferable that the first casing has an outlet, with there being a first air-flow pathway from the activation surface to that outlet. In such an arrangement, it is desirable that the wick and the wick support element have aligned openings therethrough, with the aligned openings forming a part of the first air-flow pathway. This allows air, and also vapour formed by heating of the aerosol precursor, to pass from the activation surface through the wick and the wick support element to the outlet. The second casing may then have an inlet, with a second air-flow pathway from the inlet to the activation surface. The outlet then forms a mouthpiece for the user, air will be drawn through the inlet and the second air-flow pathway to the activation surface when the user sucks or draws on the mouthpiece, and the air can be mixed with heated aerosol precursor, which then passes through the aligned openings in the wick and the wick support element and along the first air-flow pathway to the outlet forming the mouthpiece.

According to a fourth aspect of the first mode of the disclosure, the aerosol-generation apparatus discussed above according to either the first aspect of the second aspect may form part of an aerosol delivery device, also comprising first and second casings. The first casing contains the reservoir and supports the wick and the wick support element, and the second casing supports the heater. The first and second casings may then be separably interconnected.

The wick support element is preferably sealed to the first casing, e.g. by one or more O-rings.

In such an arrangement, it is preferable that the first casing has an outlet, which may form a mouthpiece for the user, and there is a first air-flow pathway from the activation surface to the outlet. For convenience, part of that first air-flow pathway may be formed by aligned openings in the wick and wick support element, which allows the passage of air from the activation surface, which may contain vaporised aerosol precursor may pass to the user.

The first casing may have a hollow tube defining a part of the first air-flow pathway, and said hollow tube and said wick support element may then abut each other with said hollow tube being aligned with said aligned openings in said wick and said wick support element.

In a similar way the second casing may have an inlet, with there being a second air-flow pathway from the inlet to the activation surface. Thus, when the user draws on the mouthpiece, air is drawn into the inlet of the device, through the second air-flow pathway to the activation surface where it may be mixed with vaporised aerosol precursor generated by heating of the wick by the heater. The resulting mixture of air and vapour may then pass through the aligned openings in the wick and wick support element and along the first air-flow pathway to the outlet, and hence to the user.

The disclosure includes the combination of the aspects of the first mode and preferred features described except where such a combination is clearly impermissible or expressly avoided.

Second Mode of the Disclosure: A Mesh Receiving Aerosol Precursor From a Reservoir At its most general, an aspect of the second mode of the present disclosure proposes that an aerosol generation apparatus has a mesh which receives aerosol precursor from a reservoir. The user is able to draw air through a duct to the mesh, the passage of air through the mesh causing the aerosol precursor to pass from the mesh in atomised form. The atomised aerosol precursor from the mesh sprays onto the heater to be vaporised, and flow through the duct to the user. Hence, the user controls the atomisation and vapourisation of the aerosol precursor as they draw on the apparatus.

The duct will normally extend from an air inlet of the apparatus to a mouthpiece of the apparatus, so that the user draws air from the inlet to the mouthpiece via the mesh.

There is also preferably a wick between the reservoir and the mesh, for regulating the transfer of aerosol precursor from the reservoir to the mesh.

Thus, according to a first aspect of the second mode of the present disclosure there may be provided an aerosol-generation apparatus comprising; a reservoir for holding an aerosol precursor; an air duct passing from an air inlet of said apparatus to a mouthpiece of said apparatus, thereby to allow a user to draw air through said air duct from said inlet to said mouthpiece; a mesh through which said air duct passes, said mesh being arranged to receive said aerosol precursor from said reservoir, and atomise said aerosol precursor on said mesh due to passage of air through said mesh, thereby to form a spray of atomised aerosol precursor; a heater arranged to receive said spray of atomized aerosol precursor from said mesh and to heat and thereby vaporise said atomized aerosol precursor to form a mixture of vapour and air in said air duct at said heater; wherein said mouthpiece is arranged to receive said mixture from said heater via said air duct.

Note that it is not necessary that all of the aerosol precursor reaching the mesh is atomised, and not necessary that all the atomised aerosol precursor is vapourised by the heater. The mixture may itself be mixed with some unatomised aerosol precursor and/or some atomised but unvapourised aerosol precursor as it passes to the mouthpiece. However, it is desirable for the atomisation/vaporisation processes to be efficient, to maximise the amount of vapour passing to the user, although those processes need not be complete.

Preferably, the apparatus further includes a wick between said reservoir and said mesh, said wick being arranged to receive aerosol precursor from said reservoir and to transfer said aerosol precursor to said mesh. The wick may be of a fibrous material, such as glass fibre, cotton or ceramic fibre, may be of porous polymeric material, or may be of porous ceramic material.

At its most general, another aspect of the second mode of the present disclosure proposes that an aerosol generation apparatus has a wick which draws aerosol precursor from a reservoir, a venturi and a heater. The user is able to draw air through a duct to the wick, through the venturi and onto the heater. Aerosol precursor at the wick is transferred to the air, atomised by the venturi and sprayed onto the heater to be vaporized. Hence, the user controls the atomisation and vaporization of the aerosol precursor as they draw on the apparatus. The duct will normally draw air in from an air inlet of the apparatus to a mouthpiece of the apparatus.

Thus, according to a second aspect of the second mode of the present disclosure, there may be provided an aerosol-generation apparatus comprising; a reservoir for holding an aerosol precursor; an air duct passing from an air inlet of said apparatus to a mouthpiece of said apparatus, thereby to allow a user to draw air through said air duct from said inlet to said mouthpiece; a wick for transferring said aerosol precursor from said reservoir to said air duct thereby to form a first mixture of air and aerosol precursor; a venturi through which said air duct passes, the venturi being arranged to atomise aerosol precursor in said first mixture in said air duct; a heater arranged to receive a spray of atomized aerosol precursor from said venturi and to heat and thereby vaporise said atomized aerosol precursor to form a second mixture of vapour and air in said air duct at said heater; wherein said mouthpiece is arranged to receive said second mixture from said heater via said air duct.

Note that it is not necessary that all of the aerosol precursor reaching the venturi is atomised, and not necessary that all the atomised aerosol precursor is vapourised by the heater. The second mixture may itself be mixed with some un-atomised aerosol precursor and/or some atomised but un-vapourised aerosol precursor as it passes to the mouthpiece.

Preferably, the wick includes a nib extending into the venturi. This improves the atomisation of the aerosol precursor at the venturi, since the aerosol precursor is at the venturi when it enters the duct and forms the first mixture. The reservoir may be a simple tank to hold liquid aerosol precursor, but optionally at least a part of the reservoir is a porous polymer material, which porous polymer material transfers aerosol precursor to the wick.

According to a third aspect of the second mode of the present disclosure, there may be provided an aerosol delivery system in which the aerosol-generation apparatus of the first aspect described above is mounted in two separable housings. The first housing has therein the reservoir, the mouthpiece, the mesh and parts of the air duct. The second housing has therein the heater and other parts of the air duct. Thus, the reservoir may be separated from the heater by separating the housings, to enable the reservoir to be refilled or replaced.

According to a fourth aspect of the second mode of the present disclosure, there may be provided an aerosol delivery system in which the aerosol-generation apparatus of the second aspect described above is mounted in two separable housings. The first housing has therein the reservoir, the mouthpiece and parts of the air duct. The second housing has therein the venturi, the heater and other parts of the air duct. Thus, the reservoir may be separated from the venturi and the heater by separating the housings, to enable the reservoir to be refilled or replaced.

The wick, if present, will normally be in the first housing.

Preferably, the air inlet is in the second housing, the air inlet leading to the parts of the duct in the second housing, to enable air to enter the duct from the exterior of the aerosol delivery system. The duct then extends from said inlet to said first housing.

The disclosure includes the combination of the aspects and preferred features described except where such a combination is clearly impermissible or expressly avoided.

Third Mode of the Disclosure: Multiplicity of Spaced Apart Plates

At its most general, the third mode of the present disclosure proposes that an aerosol-generation apparatus has a fluid-transfer article which holds aerosol precursor and which has a multiplicity of spaced apart plates which act as a wick for the aerosol precursor. The plates extend to, or proximate, a heating surface of a heater of the aerosol-generation apparatus. An air-flow pathway can then be defined along the heating surface, passing through the multiplicity of plates.

Thus, aerosol precursor will be drawn into the spaces between the plates. When the heating surface is active, aerosol precursor at or adjacent that heating surface will be vaporized, to form vapour and/or a vapour and aerosol mixture. Air flow along the air-flow pathway will cause that vapour or mixture to pass along the heating surface and out from the spaces between the fibres. This will have the effect of drawing more fluid along the fibres towards the heating surface, for the process to continue.

Thus, according to the third mode of the present disclosure, there may be provided an aerosol-generation apparatus comprising a heater and a fluid-transfer article, the fluid-transfer article comprising a first region for holding an aerosol precursor and for transferring said aerosol precursor to a second region of said fluid-transfer article, said second region being formed from a multiplicity of spaced apart plates, each of the plates extending from said first region to an end of said fluid-transfer article facing said heater, each of said multiplicity of plates terminating at, or proximate a heating surface of said heater, there being an air-flow pathway along said heating surface, which air-flow pathway passes among said multiplicity of plates.

Optionally, the first region of said fluid-transfer article comprises an empty tank for the receipt and storage of said aerosol precursor.

Alternatively, the first region of the fluid-transfer article is made of a porous material such as a porous polymer material. That porous material may hold aerosol precursor, pass the aerosol precursor to the spaces between the ends of the fibres remote from the heating surface. For example, the porous material may end at a transfer surface, with the ends of the plates in contact with that transfer surface.

The porous polymer material may comprise Polyetherimide (PEI) and/or Polyether ether ketone (PEEK) and/or Polytetrafluoroethylene (PTFE) and/or Polyimide (PI) and/or Polyethersulphone (PES) and/or Ultra-High Molecular Weight Polyethylene (UHMWPE) and/or Polypropylene (PP) and/or Polyethylene Terephthalate (PET).

The plates are generally parallel to each other, and the spacing between them small enough to provide satisfactory capiliary action for drawing aerosol precursor along the plates towards the heater.

Several different configurations of the heater and plates are possible. For example, the heating surface of the heater may be close to, but spaced from the edges of the plates which are furthest from the first region, so that the aerosol precursor which reaches those edges of the plates which are closest to the heating surface can then be heated directly by heater. Alternatively, the heating surface may be formed by heating elements on the edges of the plates which are furthest from the first region. Each of the plates may have a heating element, or there may be heating elements on some of the plates, but not on others. In such an arrangement, the heating elements heat the plates directly, thereby to heat the aerosol precursor in the spaces between the plates. There may then be an air-flow pathway adjacent the ends of the plates which have the heating elements thereon.

Yet another possibility is for the plates to have varying lengths in the direction towards the heating surface from the first region, so they extend different distances from that first region. They may then be configured so that air flow channels are formed at the end of the second region. In such an arrangement, it is possible for the heating surface to contact the ends of the longer plates, but be spaced from the ends of the shorter plates to form the channels in the end of the second region. The air-flow pathway then flows in these channels, which are formed by the shorter plates, along the heating surface.

The aerosol-generation apparatus may form part of an aerosol delivery system which has a carrier and include a housing containing the fluid-transfer apparatus. There may then be a further housing containing the heater, with the housing and the further housing being separable. The further housing may have an inlet and outlet, with the air-flow pathway extending to the inlet and outlet.

The disclosure of the third mode includes the combination of the aspects and preferred features described except where such a combination is clearly impermissible or expressly avoided.

Fourth Mode of the Disclosure: Fluid Transfer Article with Multiplicity of Fibres At its most general, the fourth mode of the present disclosure proposes that an aerosol-generation apparatus has a fluid-transfer article which holds aerosol precursor and which has a multiplicity of fibres which act as a wick for the aerosol precursor. Some of the fibres extend to a heating surface of a heater of the aerosol-generation apparatus, whilst other fibres terminate short of the heating surface. There is thus a gap between the end of each of said other fibres and the heating surface, and such gaps together form one or more channels adjacent the heating surface. The one or more channels then act as an air-flow pathway at the heating surface.

Thus, aerosol precursor will be drawn into the spaces between the fibres. When the heating surface is active, aerosol precursor at or adjacent that heating surface will be vaporized, to form vapour and/or a vapour and aerosol mixture. Air flow along the air-flow pathway will cause that vapour or mixture to pass along the heating surface along the channels formed by the fibres. This will have the effect of drawing more fluid along the fibres towards the heating surface, for the process to continue.

Thus, according to the fourth mode of the present disclosure, there may be provided an aerosol-generation apparatus comprising a heater and a fluid-transfer article, the fluid-transfer article comprising a first region for holding an aerosol precursor and for transferring said aerosol precursor to a second region of said fluid-transfer article, said second region being formed from a multiplicity of fibres extending from said first region to an end of said fluid-transfer article facing said heater, wherein some of said multiplicity of fibres terminate at a heating surface of said heater, and others of said fibres terminate spaced from said heating surface, with a gap between the end of each of said others of said fibres and said heating surface, whereby the gaps define at least one channel adjacent said heating surface, said at least one channel forming an air-flow pathway along said heating surface.

Optionally, the first region of the fluid-transfer article comprises an empty tank for the receipt and storage of said aerosol precursor.

Alternatively, the first region of the fluid-transfer article is made of a porous material such as a porous polymer material. That porous material may hold aerosol precursor, pass the aerosol precursor to the spaces between the ends of the fibres remote from the heating surface. For example, the porous material may end at a transfer surface, with the ends of the fibres in contact with that transfer surface.

The porous polymer material may comprise Polyetherimide (PEI) and/or Polyether ether ketone (PEEK) and/or Polytetrafluoroethylene (PTFE) and/or Polyimide (PI) and/or Polyethersulphone (PES) and/or Ultra-High Molecular Weight Polyethylene (UHMWPE) and/or Polypropylene (PP) and/or Polyethylene Terephthalate (PET).

The fibres are preferably generally parallel as they extend from the first region of the fluid-transfer article towards the heater.

Preferably, a plurality of first groups of said fibres have a first length and at least one second group of said fibres have a second length shorter than said first length, the or each of said second group of fibres being arranged between a respective pair of said first groups of fibres, whereby said at least one channel is defined between the fibres of said pair of said first groups and between the ends of the fibres of the or each second group and the heating surface.

The aerosol-generation apparatus may form part of an aerosol delivery system which has a carrier and include a housing containing the fluid-transfer apparatus. There may then be a further housing containing the heater, with the housing and the further housing being separable. The further housing may have an inlet and outlet, with the air-flow pathway extending to the inlet and outlet.

The fourth mode of the disclosure includes the combination of the aspects and preferred features described except where such a combination is clearly impermissible or expressly avoided.

Fifth Mode of the Disclosure: Fluid Transfer Article with Wick for the Aerosol Precursor At its most general, the fifth mode of the present disclosure proposes that an aerosol-generation apparatus has a fluid-transfer article which holds aerosol precursor and which has a multiplicity of fibres which act as a wick for the aerosol precursor. The fibres extend to, or proximate, a heating surface of a heater of the aerosol-generation apparatus. An air-flow pathway can then be defined along the heating surface, passing through the multiplicity of fibres.

Thus, aerosol precursor will be drawn into the spaces between the fibres. When the heating surface is active, aerosol precursor at or adjacent that heating surface will be vaporized, to form vapour and/or a vapour and aerosol mixture. Air flow along the air-flow pathway will cause that vapour or mixture to pass along the heating surface and out from the spaces between the fibres. This will have the effect of drawing more fluid along the fibres towards the heating surface, for the process to continue.

Thus, according to the fifth mode of the present disclosure, there may be provided an aerosol-generation apparatus comprising a heater and a fluid-transfer article, the fluid-transfer article comprising a first region for holding an aerosol precursor and for transferring said aerosol precursor to a second region of said fluid-transfer article, said second region being formed from a multiplicity of fibres, each of said multiplicity of fibres extending from said first region to an end of said fluid-transfer article facing said heater, said multiplicity of fibres terminating at, or proximate a heating surface of said heater, there being an air-flow pathway along said heating surface, which air-flow pathway passes among said multiplicity of fibres.

Optionally, the first region of the fluid-transfer article comprises an empty tank for the receipt and storage of said aerosol precursor.

Alternatively, the first region of the fluid-transfer article is made of a porous material such as a porous polymer material. That porous material may hold aerosol precursor, and pass the aerosol precursor to the spaces between the ends of the fibres remote from the heating surface. For example, the porous material may end at a transfer surface, with the ends of the fibres in contact with that transfer surface.

The porous polymer material may comprise Polyetherimide (PEI) and/or Polyether ether ketone (PEEK) and/or Polytetrafluoroethylene (PTFE) and/or Polyimide (PI) and/or Polyethersulphone (PES) and/or Ultra-High Molecular Weight Polyethylene (UHMWPE) and/or Polypropylene (PP) and/or Polyethylene Terephthalate (PET).

The fibres are preferably generally parallel as they extend from the first region of the fluid-transfer article towards the heater.

The aerosol-generation apparatus may form part of an aerosol delivery system which has a carrier and include a housing containing the fluid-transfer apparatus. There may then be a further housing containing the heater, with the housing and the further housing being separable. The further housing may have an inlet and outlet, with the air-flow pathway extending to the inlet and outlet.

The fifth mode of the present disclosure includes the combination of the aspects and preferred features described except where such a combination is clearly impermissible or expressly avoided.

Sixth Mode of the Disclosure: Capillary Tubes as Wicks for Aerosol Precursor

At its most general, the sixth mode of the present disclosure proposes that an aerosol-generation apparatus has a fluid-transfer article which holds aerosol precursor and which has a multiplicity of capillary tubes which act as a wick for the aerosol precursor. The capillary tubes extend to, or proximate, a heating surface of a heater of the aerosol-generation apparatus. An air-flow pathway can then be defined along the heating surface, passing the ends of the multiplicity of capillary tubes at or proximate the heating surface.

Thus, aerosol precursor will be drawn down the capillary tubes towards the heating surface. When the heating surface is active, aerosol precursor at or adjacent that heating surface will be vaporized, to form vapour and/or a vapour and aerosol mixture. Air flow along the air-flow pathway will cause that vapour or mixture to pass along the heating surface and out from the spaces between the capillary tubes. This will have the effect of drawing more fluid along the capillary tubes towards the heating surface, for the process to continue.

Thus, according to the sixth mode of the present disclosure, there may be provided an aerosol-generation apparatus comprising a heater and a fluid-transfer article, the fluid-transfer article comprising a first region for holding an aerosol precursor and for transferring said aerosol precursor to a second region of said fluid-transfer article, said second region being formed from a multiplicity of capillary tubes, each of said multiplicity of capillary tubes extending from said first region to an end of said fluid-transfer article facing said heater, said multiplicity of capillary tubes terminating at, or proximate a heating surface of said heater, there being an air-flow pathway along said heating surface, which air-flow pathway passes the ends of said multiplicity of capillary tubes furthest from said first region of said fluid-transfer article.

The capillary tubes may be generally parallel as they extend towards the heating surface. Since the aerosol precursor will pass along the bores of the capillary tubes, the capillary tubes may be mounted so that they contact each other along at least part of their length. This way the number of capillary tubes may be maximized, taking into account the size of the apparatus.

It is also preferable that the ends of the capillary tubes that are furthest from the first region of the fluid-transfer article, and which are thus at or proximate the heating surface are tapered. This will ensure that, even if the rest of the capillary tubes are in contact with each other, there are spaces between the tapered ends of the capillary tubes through which air can pass, to form the air-flow pathway. In such an arrangement, the capillary tubes may terminate at, or extremely close, to the heating surface since aerosol precursor will be able to pass from the capillary tubes along the surface into the space between the tapered ends of the capillary tubes. If the ends of the capillary tubes were flat, and generally parallel to the heating surface, there would normally have to be sufficient gap between the ends of the capillary tubes and the heating surface to allow aerosol precursor to pass from the capillary tubes, and also to provide a space for the air-flow pathway. Another possibility is for the capillary tubes to have flat ends inclined to the heating surface.

Thus, an activation region for aerosol precursor may be formed at the ends of the capillary tubes, the spaces around their ends if they are tapered or inclined and/or the spacing between the ends of the capillary tubes and the heating surface. The aerosol precursor is heated at the activation region when the heater is active, which causes the aerosol precursor to vapourise and pass as vapour or a mixture of vapour and aerosol to the air flowing in the air-flow pathway.

Normally, the capillary tubes will form a two-dimensional array at the heating surface, with the configuration of that array depending on air flow arrangements. For example, two-dimensional array may be square or circular, with the air-flow pathway passing from one side of the array to the other, or the array may be annular, with air flow through the central case of the annulus.

Preferably, the capillary tubes are formed of a polymer material, which is able to resist the temperatures which the heater will generate. Glass capillary tubes could be used, but they may be too fragile for the intended purpose. In either case, the capillary tubes will have a bore extending along their length, which bore is sufficiently small to generate a capillary action which will draw aerosol precursor along the capillary tubes towards the heating surface. Optionally, the first region of the fluid-transfer article comprises an empty tank for the receipt and storage of said aerosol precursor.

Alternatively, the first region of the fluid-transfer article is made of a porous material such as a porous polymer material. That porous material may hold aerosol precursor and pass the aerosol precursor to the ends of the capillary tubes remote from the heating surface. For example, the porous material may end at a transfer surface, with the ends of the capillary tubes in contact with that transfer surface.

The porous polymer material may comprise Polyetherimide (PEI) and/or Polyether ether ketone (PEEK)

and/or Polytetrafluoroethylene (PTFE) and/or Polyimide (PI) and/or Polyethersulphone (PES) and/or Ultra-High Molecular Weight Polyethylene (UHMWPE) and/or Polypropylene (PP) and/or Polyethylene Terephthalate (PET).

The aerosol-generation apparatus may form part of an aerosol delivery system which has a carrier and include a housing containing the fluid-transfer apparatus. There may then be a further housing containing the heater, with the housing and the further housing being separable. The further housing may have an inlet and outlet, with the air-flow pathway extending to the inlet and outlet.

The sixth mode of the present disclosure includes the combination of the aspects and preferred features described except where such a combination is clearly impermissible or expressly avoided.

SUMMARY OF THE FIGURES

So that the disclosure may be understood, and so that further aspects and features thereof may be appreciated, embodiments illustrating the principles of the disclosure will now be discussed in further detail with reference to the accompanying figures, in which.

DETAILED DESCRIPTION OF THE DISCLOSURE

First Mode of the Disclosure

Aspects and embodiments of the present disclosure will now be discussed with reference to the accompanying figures. Further aspects and embodiments will be apparent to those skilled in the art. All documents mentioned in this text are incorporated herein by reference.

Figure 1:
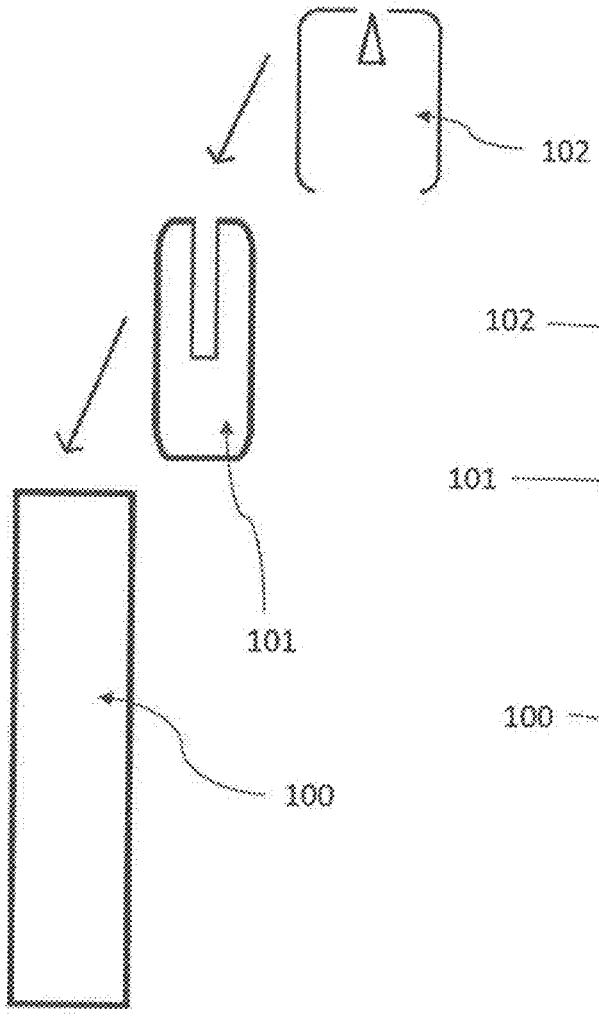
FIG. 1 shows a schematic drawing of a first arrangement of a smoking substitute system in accordance with the first mode.
Figure 2:
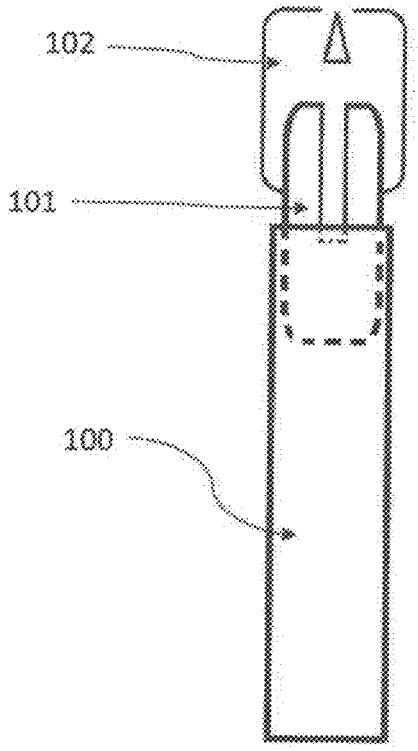
FIG. 2 shows another schematic drawing of the first arrangement of the smoking substitute system.

Referring to FIGS. 1 and 2, there is shown a smoking substitute system comprising a smoking substitute device 100. In this example, the substitute smoking system comprises a cartomiser 101 and a flavour pod 102. The cartomiser 101 may engage with the smoking substitute device 100 via a push-fit engagement, a screw-thread engagement, or a bayonet fit, for example. A cartomiser may also be referred to as a "pod". The smoking substitute system may be an aerosol delivery device according to the present disclosure.

The flavour pod 102 is configured to engage with the cartomiser 101 and thus with the substitute smoking device 100. The flavour pod 102 may engage with the cartomiser 101 via a push-fit engagement, a screw-thread engagement, or a bayonet fit, for example. FIG. 2 illustrates the cartomiser 101 engaged with the substitute smoking device 100, and the flavour pod 102 engaged with the cartomiser 101. As will be appreciated, in this example, the cartomiser 101 and the flavour pod 102 are distinct elements. Each of the cartomiser 101 and the flavour pod may be an aerosol delivery device.

As will be appreciated from the following description, the cartomiser 101 and the flavour pod 102 may alternatively be combined into a single component that implements the functionality of the cartomiser 101 10 and flavour pod 102. Such a single component may also be an aerosol delivery device according to the present disclosure. In other examples, the cartomiser may be absent, with only a flavour pod 102 present or vice versa.

A "consumable" component may mean that the component is intended to be used once until exhausted, and then disposed of as waste or returned to a manufacturer for reprocessing.

Figure 3:
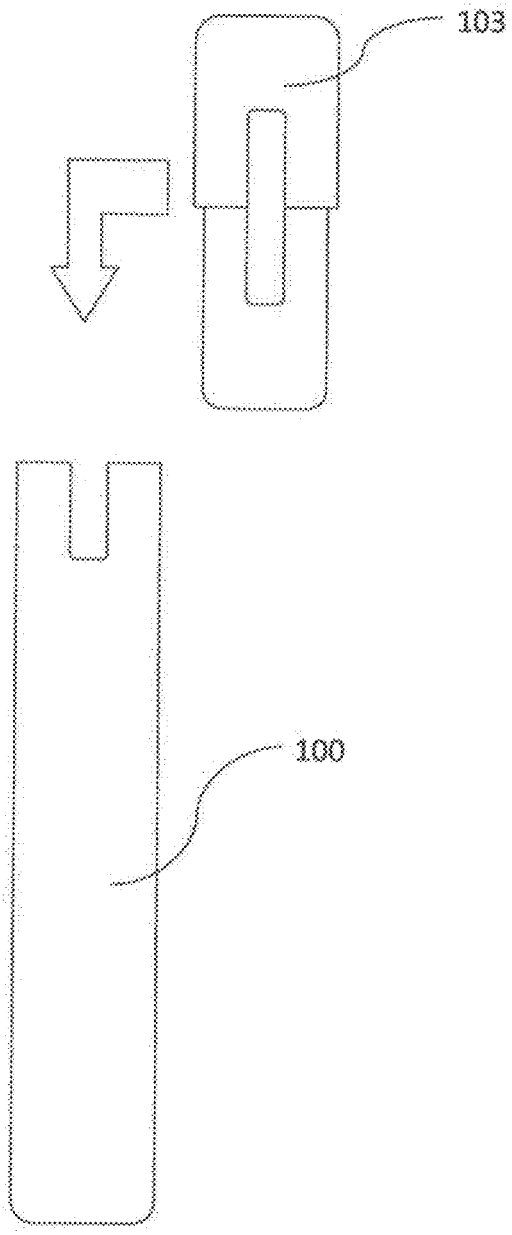
FIG. 3 shows a schematic drawing of a second arrangement of a smoking substitute system in accordance with the first mode.
Figure 4:
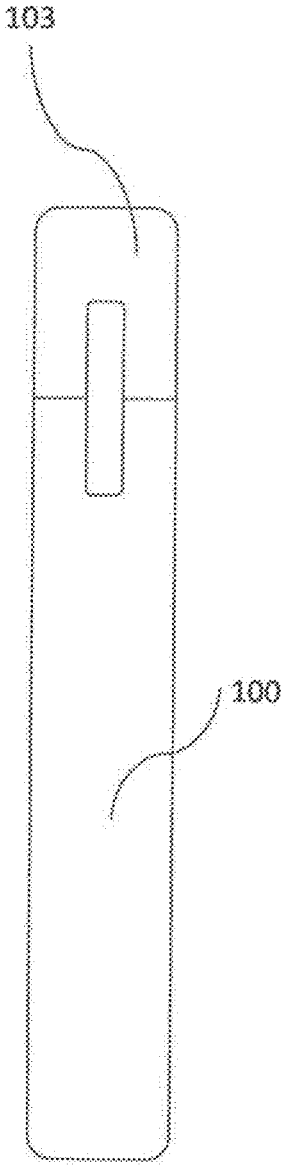
FIG. 4 shows another schematic drawing of the second arrangement of the smoking substitute system.

Referring to FIGS. 3 and 4, there is shown a smoking substitute system comprising a smoking substitute device 100 and a consumable 103. The consumable 103 combines the functionality of the cartomiser 101 and the flavour pod 102. In FIG. 3, the consumable 103 and the smoking substitute device 100 are shown separated from one another. In FIG. 4, the consumable 103 and the smoking substitute device 100 are engaged with each other.

Figure 5:
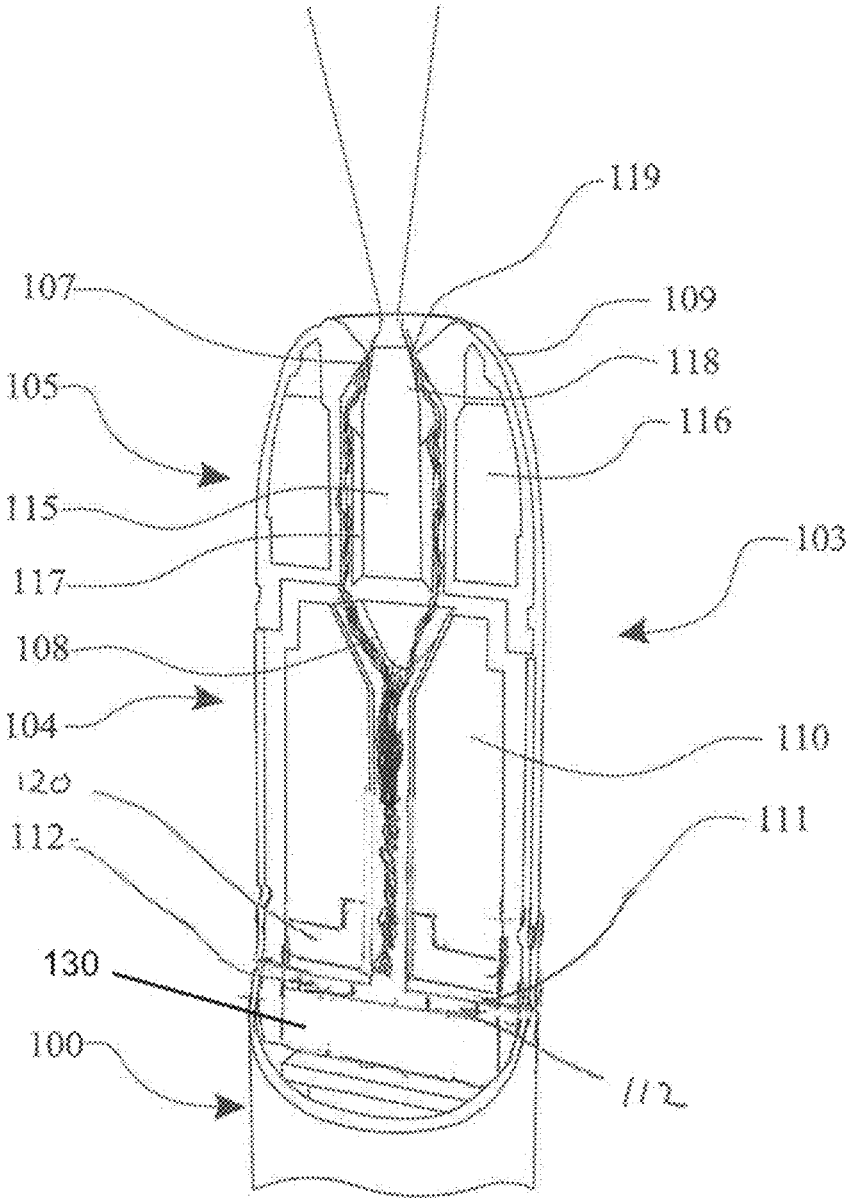
FIG. 5 shows a cutaway view of part of a third arrangement of a smoking substitute system.

Referring to FIG. 5, there is shown a consumable 103 engaged with a smoking substitute device 100 via a push-fit engagement. The consumable 103 may be considered to have two portions—a cartomiser portion 104 and a flavour pod portion 105, both of which are located within a single component (as in FIGS. 3 and 4).

The consumable 103 includes an upstream airflow inlet 106 and a downstream airflow outlet 107. In other examples a plurality of inlets and/or outlets are included. Between and fluidly connecting the inlet 106 and the outlet 107 there is an airflow passage 108. The outlet 107 is located at the mouthpiece 109 of the consumable 103, and is formed by a mouthpiece aperture.

As above, the consumable 103 includes a flavour pod portion 105. The flavour pod portion 105 is configured to generate a first (flavour) aerosol for output from the outlet 107 of the mouthpiece 109 of the consumable 103. The flavour pod portion 105 of the consumable 103 includes a member 115. The member 115 acts as a passive aerosol generator (i.e. an aerosol generator which does not use heat to form the aerosol, also referred to as a "first aerosol generator" in this example), and is formed of a porous material. The member 115 comprises a supporting portion 117, which is located inside a housing, and an aerosol generator portion 118, which is located in the airflow passage 108. In this example, the aerosol generator portion 118 is a porous nib.

A first storage reservoir 116 (in this example a tank) for storing a first aerosol precursor (i.e. a flavour liquid) is fluidly connected to the member 115. The porous nature of the member 115 means that flavour liquid from the first storage 116 is drawn into the member 115. As the first aerosol precursor in the member 115 is depleted in use, further flavour liquid is drawn from the first storage reservoir 116 into the member 115 via a wicking action.

As described above, the aerosol generator portion 118 is located within the airflow passage 108 through the consumable 103. The aerosol generator portion 118 therefore constricts or narrows the airflow passage 108. The aerosol generator portion 118 occupies some of the area of the airflow passage, resulting in constriction of the airflow passage 108. The airflow passage 108 is narrowest adjacent to the aerosol generator portion 118. Since the constriction results in increased air velocity and corresponding reduction in air pressure at the aerosol generator portion 118, the constriction is a Venturi aperture 119.

The cartomiser portion 104 of the consumable 103 includes a second storage reservoir 110 (in this example a tank) for storing a second aerosol precursor (i.e. e-liquid, which may contain nicotine). At one end of the second storage reservoir 110 is a wick support element 120, which supports a wick 111. As will be described in more detail later, aerosol precursor passes through one or more bores (not shown in FIG. 5) in the wick support element 120 to reach the wick 111. The surface of the wick furthest from the reservoir then acts as an activation surface from which aerosol precursor will be released in the form of a vapour, or a mixture of vapour and aerosol.

A heater 112 is a configured to heat the wick 111. The heater 112 may be in the form of one or more resistive heating filaments that abut the wick 111. The wick 111, the heater 112 and the e-liquid storage reservoir 110 together act as an active aerosol generator (i.e. an aerosol generator which uses heat to form the aerosol, referred to as a "second aerosol generator" in this example). The second storage reservoir 110, the wick support element, and the wick 111 form a fluid-transfer article, as they transfer aerosol precursor to the activation surface to be heated by the heater 112.

The heater 112 is supported in the smoking substitute device 100 by a heater support element 130. There may be one or more passages (not shown in FIG. 5) through the heater support element 130 to allow air to reach the activation surface of the wick 111 from an inlet (again not shown in FIG. 5) of the smoking substitute device.

The smoking substitute device 100 includes an electrical power source (not shown), for example a battery. That battery is then connected via suitable electrical connections to the heater 112. The heater 112, the battery, and other components of the smoking substitute system device 100 form a non-consumable part of the device from which the consumable may be connected and disconnected.

In the arrangement of the smoking substitute device 100 of FIG. 5, and in the arrangement to be described later, the consumable 103 is separable from the rest of the smoking substitute device 100. This allows the consumable 103 to be replaced, or possibly refilled, when the first and/or second aerosol precursor have been consumed by the user. Since the consumable 103 includes the wick 111 and the wick support element 120, these components will be removed when the consumable 103 is separated from the rest of the smoking substitute device 100. The heater 112, on the other hand, will remain when the consumable 103 is removed, so that it is non-consumable.

In use, a user draws (or "sucks", or "pulls") on the mouthpiece 109 of the consumable 103, which causes a drop in air pressure at the outlet 107, thereby generating air flow through the inlet, through the passages in the heater support element 130, past the activation surface of the wick 111, along the airflow passage 108, out of the outlet 107 and into the user's mouth.

When the heater 112 is activated (by passing an electric current through one or more heating filaments in response to the user drawing on the mouthpiece 109) the e-liquid (aerosol precursor) located in the wick 111 at the activation surface adjacent to the or each heating filament is heated and vaporised to form a vapour. The vapour condenses to form the second aerosol within the airflow passage 108. Accordingly, the second aerosol is entrained in an airflow along the airflow flow passage 108 to the outlet 107 and ultimately out from the mouthpiece 109 for inhalation by the user when the user 10 draws on the mouthpiece 109.

The substitute smoking device 100 supplies electrical current to the heating filament or filaments of the heater 112 and the heating filament or filaments heat up. As described, the heating of the heating filament or filaments causes vaporisation of the e-liquid in the wick 111 to form the second aerosol.

As the air flows up through the airflow passage 108, it encounters the aerosol generator portion 118. The constriction of the airflow passage 108 caused by the aerosol generator portion 118 results in an increase in air velocity and corresponding decrease in air pressure in the airflow in the vicinity of the porous surface 118 of the aerosol generator portion 115. The corresponding low pressure region causes the generation of the first (flavour) aerosol from the porous surface 118 of the aerosol generator portion 118. The first (flavour) aerosol is entrained into the airflow and ultimately is output from the outlet 107 of the consumable 103 and thus from the mouthpiece 109 into the user's mouth.

The first aerosol may be sized to inhibit pulmonary penetration. The first aerosol may be formed of particles with a mass median aerodynamic diameter that is greater than or equal to 15 microns, in particular, greater than 30 microns, more particularly greater than 50 microns, yet more particularly greater than 60 microns, and even more particularly greater than 70 microns.

The first aerosol may be sized for transmission within at least one of a mammalian oral cavity and a mammalian nasal cavity. The first aerosol may be formed by particles having a maximum mass median aerodynamic diameter that is less than 300 microns, in particular less than 200 microns, yet more particularly less than 100 microns. Such a range of mass median aerodynamic diameter will produce aerosols which are sufficiently small to be entrained in an airflow caused by a user drawing air through the flavour element and to enter and extend through the oral and or nasal cavity to activate the taste and/or olfactory receptors.

The second aerosol generated may be sized for pulmonary penetration (i.e. to deliver an active ingredient such as nicotine to the user's lungs). The second aerosol may be formed of particles having a mass median aerodynamic diameter of less than or equal to 10 microns, preferably less than 8 microns, more preferably less than 5 microns, yet more preferably less than 1 micron. Such sized aerosols tend to penetrate into a human user's pulmonary system, with smaller aerosols generally penetrating the lungs more easily. The second aerosol may also be referred to as a vapour.

The size of aerosol formed without heating is typically smaller than that formed by condensation of a vapour.

As a brief aside, it will be appreciated that the mass median aerodynamic diameter is a statistical measurement of the size of the particles/droplets in an aerosol. That is, the mass median aerodynamic diameter quantifies the size of the droplets that together form the aerosol. The mass median aerodynamic diameter may be defined as the diameter at which 50% of the particles/droplets by mass in the aerosol are larger than the mass median aerodynamic diameter and 50% of the particles/droplets by mass in the aerosol are smaller than the mass median aerodynamic diameter. The "size of the aerosol", as may be used herein, refers to the size of the particles/droplets that are comprised in the particular aerosol.

Figure 6:
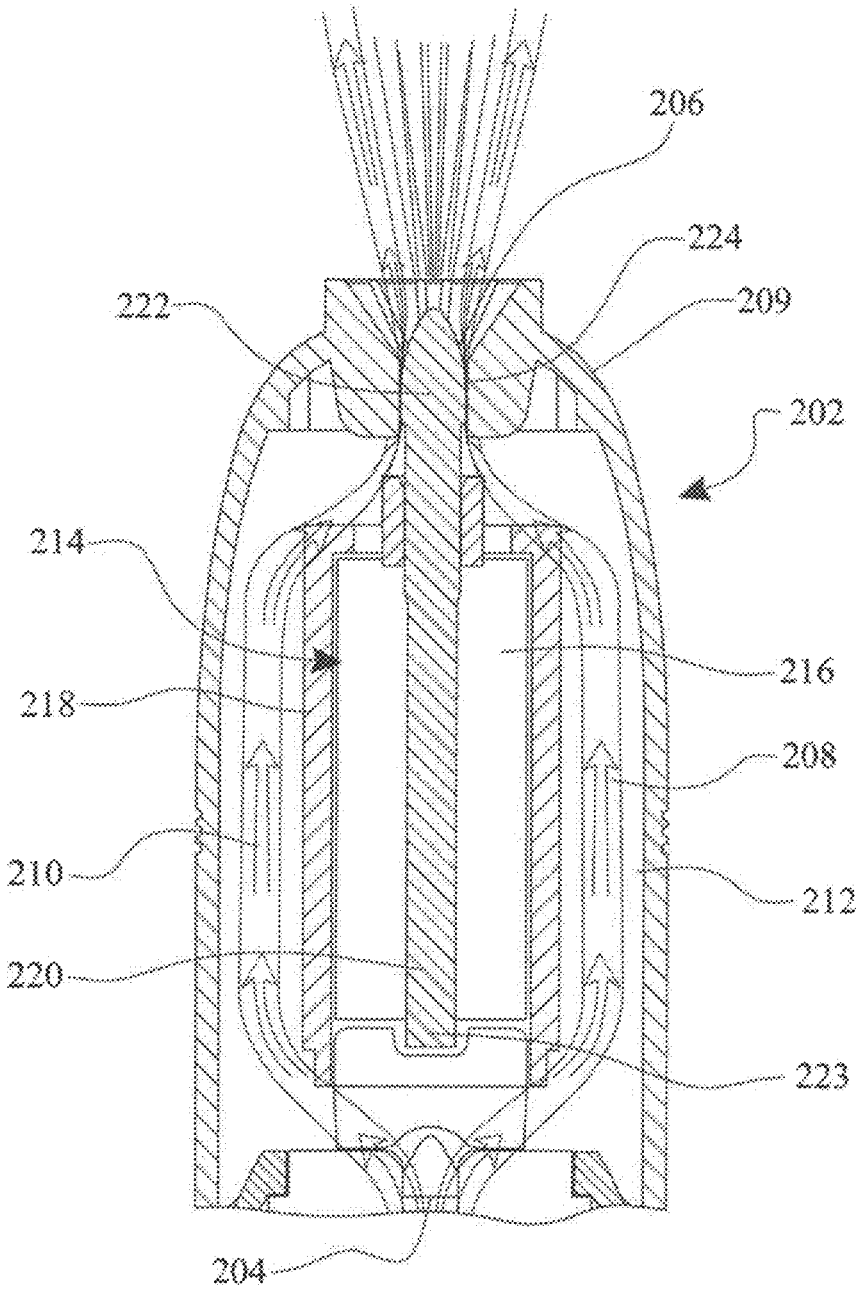
FIG. 6 shows a cross-sectional view of an arrangement of a flavour pod.

Referring to FIG. 6, there is shown a flavour pod portion 202 of a consumable, the consumable providing an aerosol delivery device in accordance with the disclosure. The consumable further comprises a cartomiser portion (not shown in FIG. 6) having all of the features of the cartomiser portion 104 described above with respect to FIG. 5.

The flavour pod portion 202 comprises an upstream (i.e. upstream with respect to flow of air in use) inlet 204 and a downstream (i.e. downstream with respect to flow of air in use) outlet 206. Between and fluidly connecting the inlet 204 and the outlet 206 the flavour pod portion 204 comprises an airflow passage 208. The airflow passage 208 comprises a first airflow branch 210 and a second airflow branch 212, each of the first airflow branch 210 and the second airflow branch 212 fluidly connecting the inlet 204 and the outlet 206. In other examples the airflow passage 208 may have an annular shape. The outlet 206 is located at the mouthpiece 209 of the consumable 103, and is also referred to as a mouthpiece aperture 206.

The flavour pod portion 202 comprises a storage 214, which stores a first aerosol precursor. The storage 214 comprises a reservoir 216 located within a chamber 218. The reservoir 216 is formed of a first porous material.

The flavour pod portion 202 comprises a member 220, which comprises an aerosol generator portion 222 and a supporting portion 223. The aerosol generator portion 222 is located at a downstream end (an upper end in FIG. 6) of the member 220, while the supporting portion 223 makes up the rest of the member 220. The supporting portion 223 is elongate and substantially cylindrical. The aerosol generator portion 222 is bulb-shaped, and comprises a portion which is wider than the supporting portion 223. The aerosol generator portion 222 tapers to a tip at a downstream end of the aerosol generator portion 222.

The member 220 extends into and through the storage 214. The member 220 is in contact with the reservoir 216. More specifically, the supporting portion 223 extends into and through the storage 204 and is in contact with the reservoir 216. The member 220 is located in a substantially central position within the reservoir 216 and is substantially parallel to a central axis of the consumable. The member 220 is formed of a second porous material.

The first and second airflow branches 210, 212 are located on opposite sides of the member 220. Additionally, the first and second airflow branches 210, 212 are located on opposite sides of the reservoir 216. The first and second airflow branches 210, 212 branch in a radial outward direction (with respect to the central axis of the consumable 200) downstream of the inlet 204 to reach the opposite sides of the reservoir 216.

The aerosol generator portion 222 is located in the airflow passage 208 downstream of the first and second airflow branches 210, 212. The first and second airflow branches 210, 212 turn in a radially inward direction to merge at the member 220, at a point upstream of the aerosol generator portion 222.

The aerosol generator portion 222 is located in a narrowing section 224 of the airflow passage 208. The narrowing section 224 is downstream of the point at which the first and second airflow branches 210 212 merge, but upstream of the mouthpiece aperture 207. The mouthpiece aperture 207 flares outwardly in the downstream direction, such that a width of the mouthpiece aperture 207 increases in the downstream direction.

In use, when a user draws on the mouthpiece 209, air flow is generated through the air flow passage 208. Air (comprising the second aerosol from the cartomiser portion as explained above with respect to FIG. 5) flows through the inlet 204 before the air flow splits to flow through the first and second airflow branches 210, 212. Further downstream, the first and second airflow branches 210, 212 provide inward airflow towards the member 220 and the aerosol generator portion 222.

As air flows past the aerosol generator portion in the narrowing section 224, the velocity of the air increases, resulting in a drop in air pressure. This means that the air picks up the first aerosol precursor from the aerosol generator portion 222 to form the first aerosol. The first aerosol has the particle size and other properties described above with respect to FIG. 5.

As the first aerosol precursor is picked up by the air, the member 220 transfers further first aerosol precursor from the storage 214 to the aerosol generator portion 222. More specifically, the member 220 wicks the first aerosol precursor from the storage 214 to the aerosol generator portion 223.

In other examples, the storage 214 comprises a tank containing the first aerosol precursor as free liquid, rather than the reservoir 216 and the chamber 218. In such examples, the member 220 still extends into the tank to transfer first aerosol precursor from the tank to the aerosol generator portion 223.

Further arrangements of the present disclosure will now be described, which arrangements incorporate one or more features of the aspects of the present disclosure. In the subsequent arrangements, the smoking substitute device 100 includes a consumable 103 in the form of a cartomiser, but does not include a flavour pod. However the smoking substitute device 100 of the subsequent arrangements may be modified to incorporate a flavour pod in a way similar to the arrangement of FIGS. 5 and 6.

Figure 7:
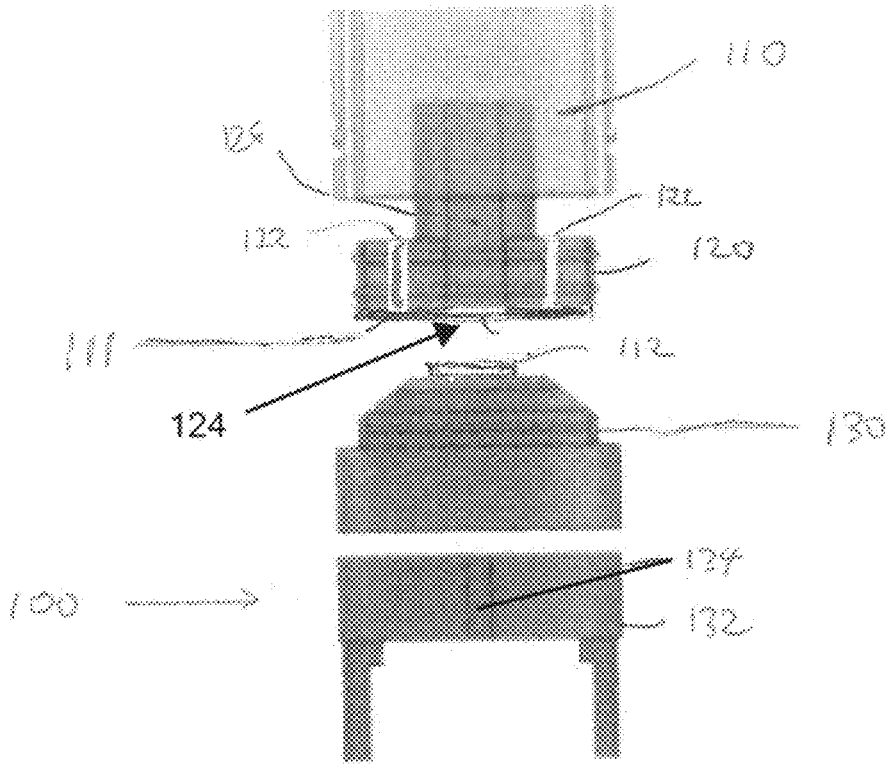
FIG. 7 shows in detail parts of another arrangement of a smoking substitute system in accordance with the first mode.

As mentioned above, the wick 111 is supported by a wick support element 120. FIG. 7 illustrates an arrangement of a smoking substitute system in which these components are illustrated in more detail, and in an exploded view. The wick support element 120 is mounted at an end of the second storage reservoir 111 and has bores 122 therethrough to allow aerosol precursor in the second storage reservoir 110 to pass to the wick 110. These bores may be sized so that aerosol precursor may flow therethrough in a non-capillary manner. Although, two bores 122 are visible in FIG. 7, there may be more arranged around the wick support element 120.

In the arrangement of FIG. 7, the wick support element 120 is made of a resilient material, such as rubber, and thus may deform when force is applied thereto. In particular, when the consumable 103 is mounted on the main body 100, the wick 111 is brought into contact with the heater 112, and is held thereto by the resilience of the wick support element 120. The wick support element 120 may be sized so that it deforms slightly when the wick 111 is in contact with the heater 112, so as to provide a biasing force to urge the wick 111 into firm contact with the heater 112.

The wick 111 has an opening 124 at its centre, which is aligned with a passageway 126 through the wick support element 122. The passageway 126 communicates with the air-flow passage 108 shown in FIG. 5 so that air, together with vapour or a mixture of vapour and aerosol, will pass to the user. The surface of the wick 111 closest to the heater 112 acts as an activation surface for the aerosol precursor and, as the wick 111 is heated by the heater 112, aerosol precursor is released from the activation surface in the form of vapour or a mixture of vapour and aerosol, it can then pass through the opening 124 and the passageway 126 into the air-flow passage 108.

Figure 8:
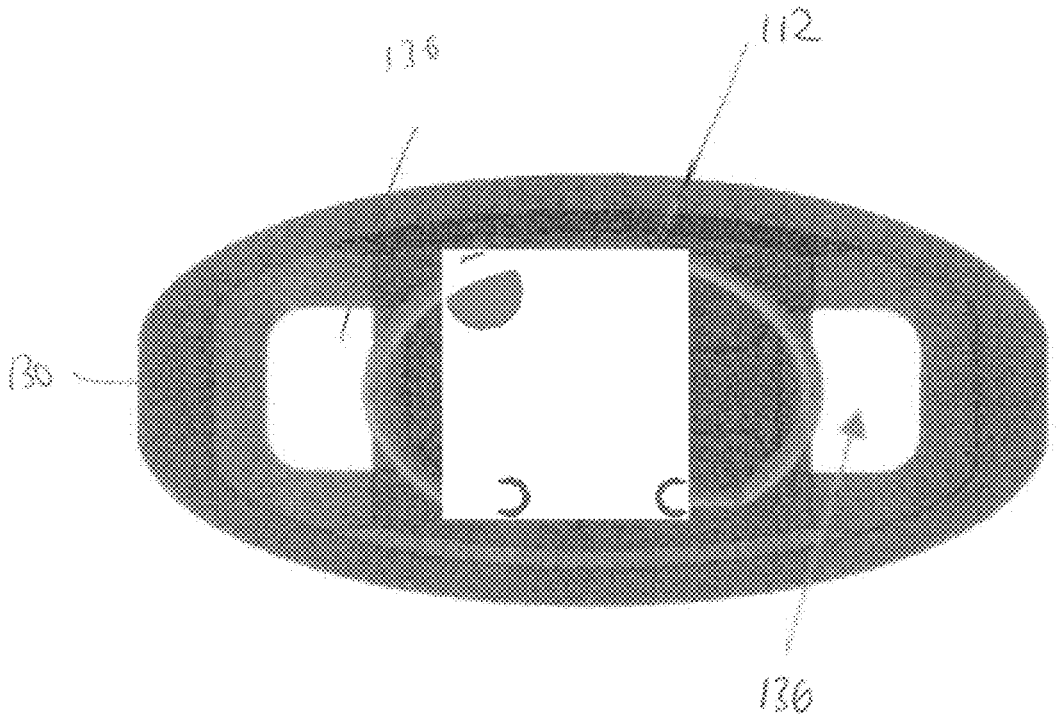
FIG. 8 shows detail of the heater and the heater support in the arrangement of FIG. 7.

As illustrated in FIG. 7, the heater 112 is mounted on a heater support element 130, which may act as an end wall of a battery housing and which may itself be supported by a support wall 132. The casing of the main body 100 (not shown in FIG. 7) will enclose the support wall 132 and parts of the heater support element 130. In order for air to flow from the activation surface of the wick 111 through the opening 124 and into the passage 126, air must first reach the activation surface of the wick 111. The support wall 132 may thus have a bore 134 therethrough, which communicates with passages 136 (not shown in FIG. 7) through the heater support element 130. FIG. 8 illustrates these passages 136 and shows that they open immediately adjacent the heater 112 and hence adjacent the activation surface of the wick 111. The casing of the main body 100 may be provided with an inlet at a suitable location, to allow air to reach the bore 134, and hence to flow to the passages 136 in the heater support element 130. Hence, when the user draws on the mouthpiece 109 of the consumable 103, air is drawn into the casing of the main body 100 through the bore 134 and the passages 136 to reach the activation surface of the wick 111 adjacent the heater 112. That air then passes, together with vapour or mixture of aerosol and vapour generated by heating of the aerosol precursor by the heater 112, through the opening 124 in the wick 111 to the passage 126, and hence to the air-flow passage 108, and then to user, as has previously been described.

Note that in the arrangement of FIGS. 7 and 8, the heater 112 will need to be connected to a power source, such as a battery, and there may then need to be additional bores (not shown in FIGS. 7 and 8) through the heater support element 130 and the support wall 132 to allow electrical leads to pass therethrough.

Figure 9:
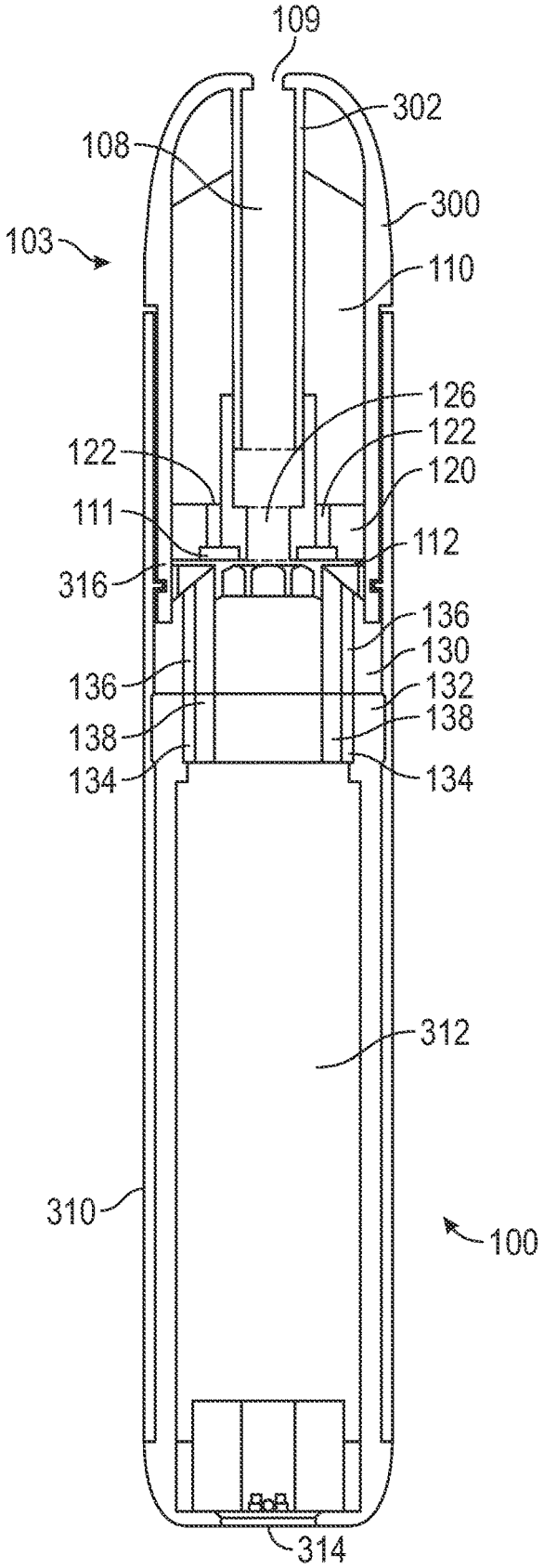
FIG. 9 shows another arrangement of a smoking substitute system in accordance with the first mode.

FIG. 9 illustrates another arrangement of a smoking substitute system, in which the consumable has a single reservoir for aerosol precursor which corresponds to the second storage reservoir 110 in the embodiment of FIG. 5. In this arrangement, the consumable does not have a flavour pod portion. For simplicity, parts corresponding to those of FIGS. 5 to 8 are indicated by the same reference numerals. Note that in FIG. 9, the support wall 132 has multiple bores 134 therethrough, aligned with the passages 136 in the heater support element 130.

FIG. 9 also shows the casings of the device. In particular, there is a casing 300 (the "first" casing), being a casing of the consumable 103. That casing contains the reservoir 110 for aerosol precursor, and also supports the wick support element 120 and the wick 111. A tube 302 within that first casing 300 forms a bounding wall of the air-flow passage 108, and the mouthpiece 109 is formed at an end of the first casing 300. The main device 100 also has a casing 310 (the "second" casing on which are mounted the support wall 132 and the heater support element 130. There is a space 312 within the second casing 310 for a battery and other electronic components used to power the heater 112, and the second casing 310 may also have an inlet 314 to allow air to enter the space 312 and hence pass to the bores 134 and the passages 136 to enable it to reach the activation surface of the wick 110.

FIG. 9 also shows electrical leads 138 which extend through the support wall 132 and the heater support element 130 to enable the heater 112 to be connected to a battery in space 312. Small bores may be formed in the heater support element 130 and the support wall 132 through which the leads 138 may pass. The first and second casings 300, 310 are separable and held together by a "click" engagement 316. When the two casings 300,310. are interconnected, as shown in FIG. 9, the wick 111 is forced into contact with the heater 112 by the resilience of the wick support element 120, so that good heating of the activation surface of the wick 111 will occur when the heater 112 is active. The separability of the two casings 300, 310 allows the consumable 103 to be removed from the main body 100, and replaced, e.g. when the aerosol precursor in the reservoir 110 is exhausted.

Figure 10:
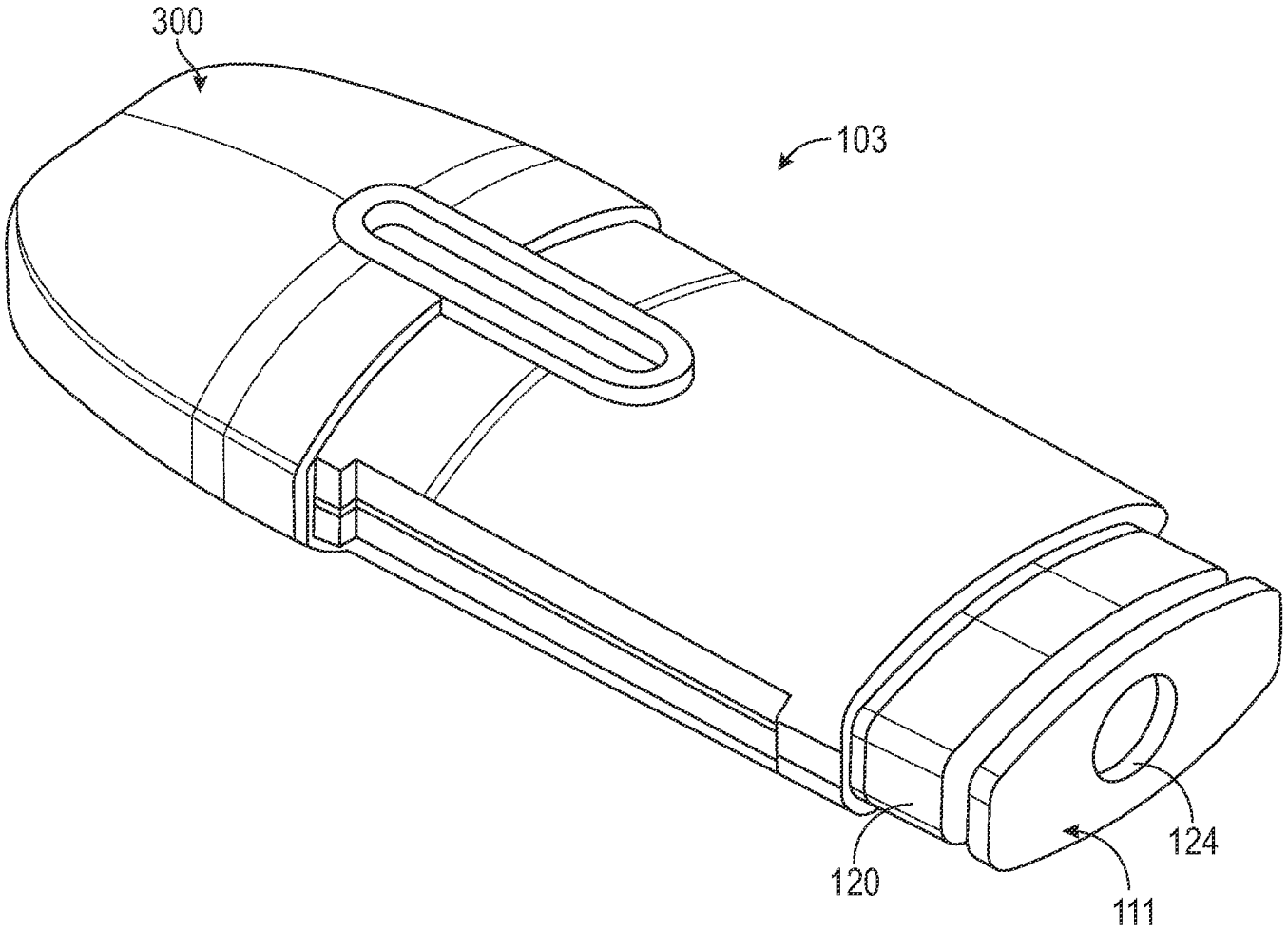
FIG. 10 shows detail of part of a smoking substitute system.

FIG. 10 shows a perspective view of the consumable 103 in FIG. 9, with the part of the first casing 300 removed so that the wick 111 and the wick support element 120 are clearly visible. It can be seen from FIG. 10 that the wick 111 is flat and so has a planar activation surface (the exposed surface of the wick 111 in FIG. 10). FIG. 10 also shows clearly the opening 124 in the wick 111, which allows communication with the passageway 126 through the wick support element 120. The wick support element 120 in this embodiment, and in some other embodiments, is preferably made of rubber material. In a similar way, the wick 111 is preferably made of silica material, which material is suitably porous to allow the aerosol precursor to pass therethrough. Alternatively, the wick may be of fibrous material, woven material or porous ceramic material.

Figure 11:
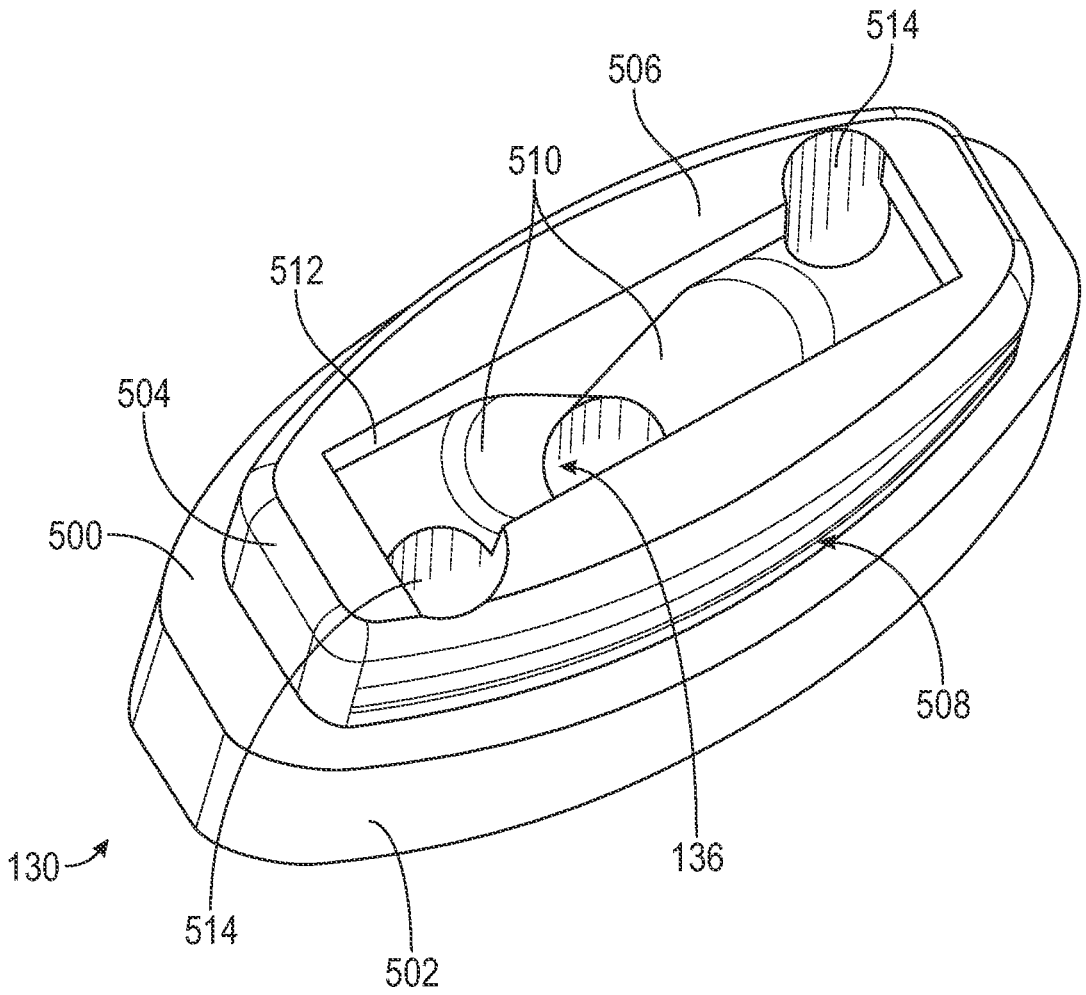
FIG. 11 shows detail of a heater support which may be used in a smoking substitute system in accordance with the first mode.
Figure 12:
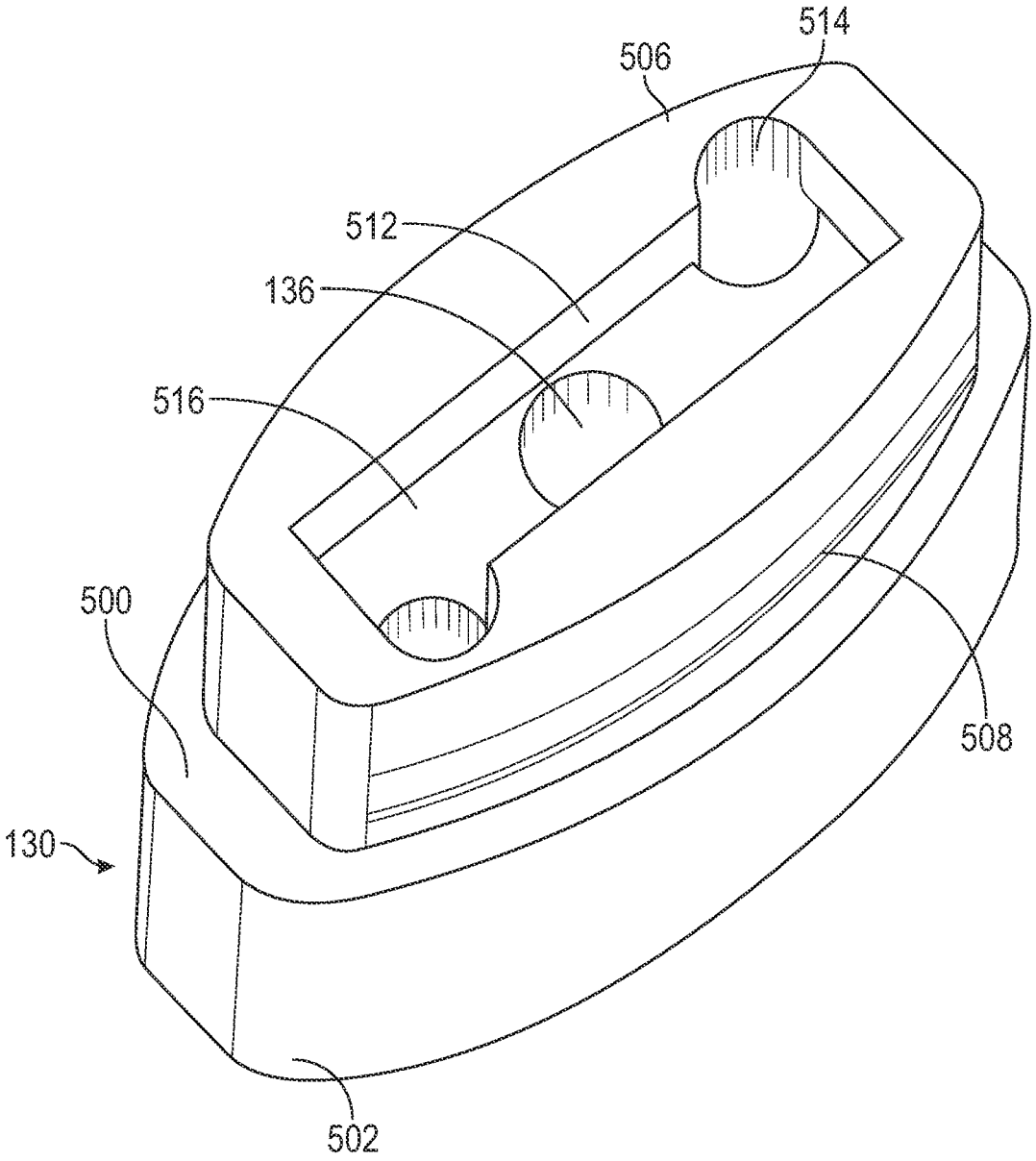
FIG. 12 shows detail of an alternative heater support which may be used in a smoking substitute system in accordance with the first mode.

FIGS. 11 and 12 illustrate two alternative configurations of a heater support element 130 which may be used in the present disclosure. They differ in the shape of the mouth of the passage 136 through the heater support element 130 which allows air to pass through the heater support element from e.g. the interior of the casing of the main body 100 to the vicinity of the heater 112 and the activation surface of the wick 111. Note that, in FIGS. 11 and 12, the heater itself is not shown and there is a single passage 134 through the heater support element 132. In each of the alternative configurations, the heater support element 130 is preferably made of resilient material, which must also be suitable to resist the heat generated by the heater 112.

In FIG. 11, the heater support element 130 comprises a body part 500 which has a peripheral seal surface 502 which seals to the casing 310 (not shown in FIG. 11). The seal between the seal surface 502 and the casing 310 needs to be sufficiently strong to prevent, or at least significantly resist, movement of the heater support element 130 in the casing 310, particularly when the consumable 103 is removed from the main body 100.

A projecting part 504 projects from the body part 500, terminating in a flat heater support face 506. The periphery of the projecting part 504 seals to the casing 300 of the consumable 103, and for this purpose may have ribs 508 on its side surface. However, unlike the sealing of the seal surface 502 to the casing 310 of the main body 100, the sealing of the projecting part 504 to the casing 300 of the consumable 103 needs to allow the consumable 103 to be removed to allow another consumable 103 to be mounted thereon without too much resistance. Nevertheless, the sealing must be sufficiently good to limit leakage of any aerosol precursor which has passed through the wick 111 but has not been vaporised by the heater 112. As in the arrangement of FIG. 9, the passage 136 passes through the heater support element 130 to enable air to pass towards the heater 112 and the wick 111. In the heater support element 130 shown in FIG. 11, the passage 136 terminates in a splayed or funneled mouth 510, which opens into a slot 512 in the heater support surface 506, so that air which has passed through the bore 136 can expand in the funneled mouth 510 before reaching the heater 112.

FIG. 11 also shows bores 514 through which pass leads from the heater 112, which leads will provide electrical connection to the battery.

The heater support element 130 shown in FIG. 11 is resilient and is preferably made of silicone material, with provision to resist high temperatures which may be generated by the heater 112. For example, the material known as Polygraft HT-3120 silicone, which is a two-part mix, may be a suitable material from which the heater support element 132 may be made. The configuration shown in FIG. 11 will normally be made by moulding the silicone material in a suitable mould.

FIG. 12 illustrates an alternative heater support element 130. It is generally similar to the heater support element 130 shown in FIG. 11 and the same reference numerals indicate corresponding parts. It may be made of the same materials as the heater support element 130 of FIG. 11. The heater support element 130 of FIG. 12 differs from that of FIG. 11 in that the passage 136 opens directly into the channel 512 in the heater support surface 506. There is thus a flat face 516 at the bottom of the channel 516, rather than the funnel mouth 510 shown in FIG. 11.

Figure 13:
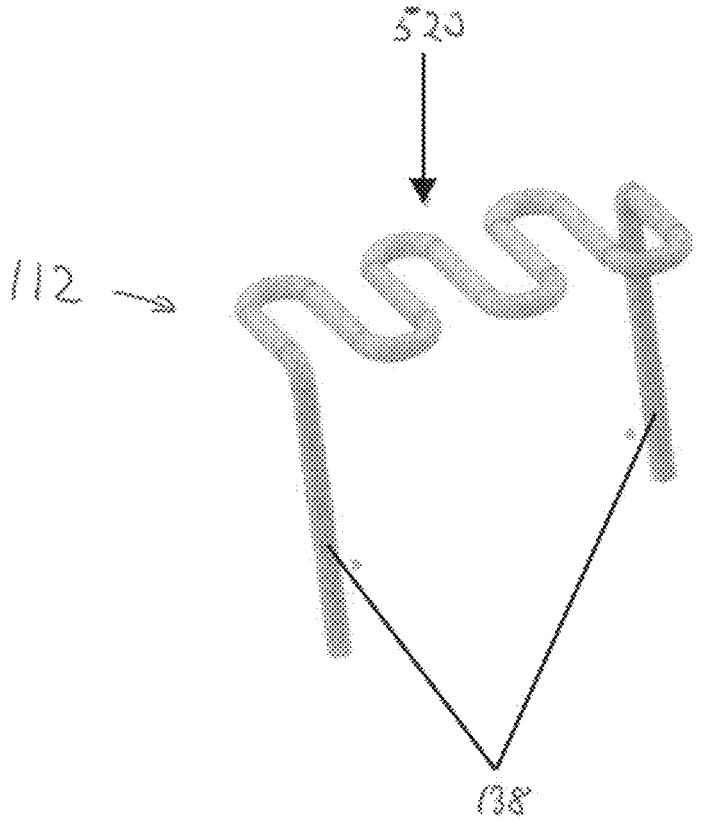
FIG. 13 shows detail of a heater which may be used in a smoking substitute system in accordance with the first mode.

FIG. 13 shows a heater that may be used with the heater support element 130 shown in FIG. 11 or FIG. 12. The heater comprises a heater filament 520 which is generally flat and rests on the heater support face 506 of the heater support element 130. For this reason, the filament 520 is not straight but meanders in its plane. FIG. 13 also shows the leads 138 which extend through the bores 514 of the heater support 130 shown in FIG. 11 or FIG. 12, to enable the heater 112 to be connected to a battery.

Figure 14:
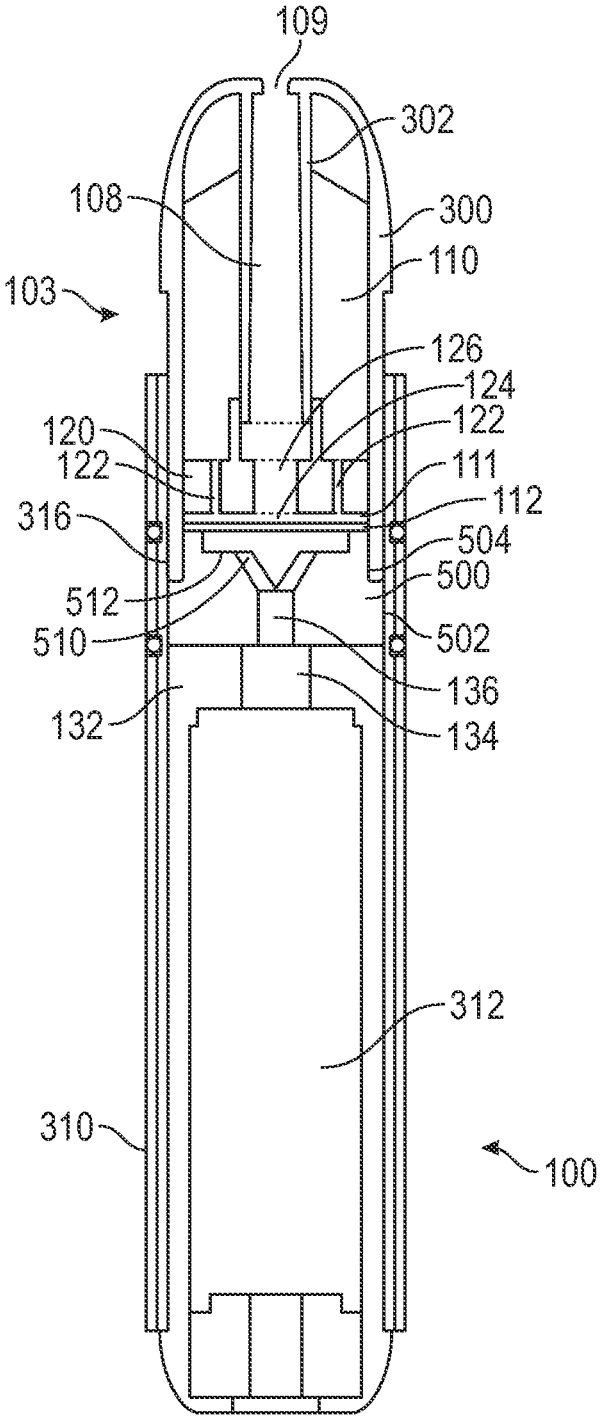
FIG. 14 shows yet another arrangement of a smoking substitute system in accordance with the first mode.

FIG. 14 illustrates an arrangement of a smoking substitute system which incorporates the heater support element 132 of FIG. 11, and also the heater 112 of FIG. 13. The arrangement of FIG. 14 is generally similar to that of FIG. 9, and corresponding parts are indicated by the same reference numerals. As mentioned previously, when the heater support element 132 of FIG. 11 is used, there is only a single bore 136 therein for air, hence there is only a single bore 134 in the support 132 in the main body 100. The bore 136 extends to the funneled mouth 510 which opens into the slot 512 directly below the heater 112. Note that the leads 138 of the heater 112 are not visible in FIG. 14.

FIG. 14 illustrates how the seal surface 502 of the main body 500 seals to the second casing 310, and the projecting part 504 seals to the first casing 300. This sealing is illustrated in more detail in the enlarged view of FIG. 15. In particular, the first casing 300 of the consumable 103 extends sufficiently far within the second casing 310 of the main body 100 so as to contact the projecting part 504 of the heater support element 130 at a sealing interface 518. Similarly, the main body 500 of the heater support element 130 seals at a sealing interface 520 with the casing 310 of the main body 100. As mentioned previously, the degrees of sealing at these two sealing interfaces 518 and 520 are preferably different, since the heater support element 130 does not normally release from the second casing 310, but must release from the first casing 300 when the consumable 103 is removed.

Figure 15:
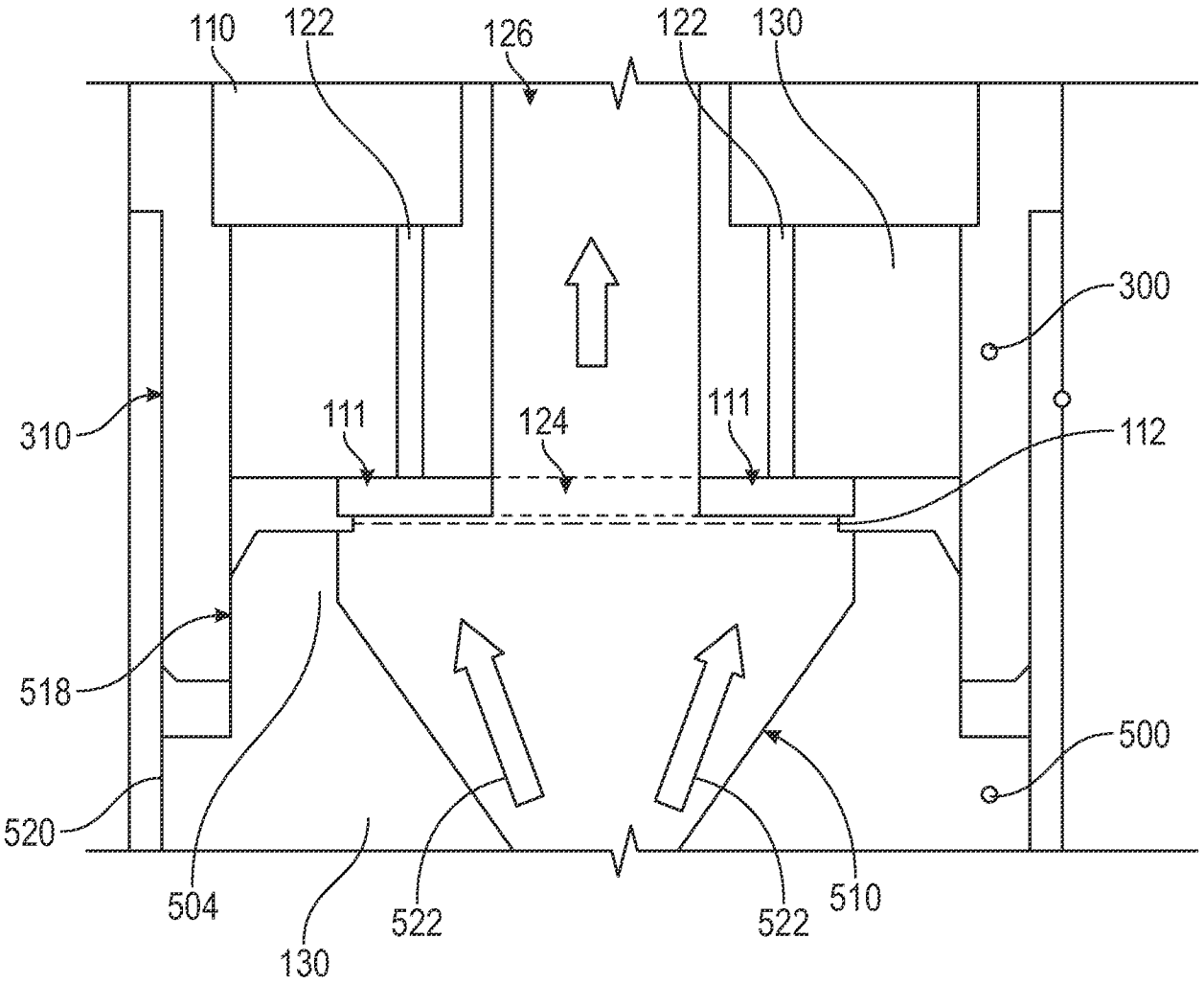
FIG. 15 shows a detailed schematic sectional view of a part of a smoking substitute system in accordance with the first mode.

FIG. 15 also shows how the funneled mouth 510 of the passage 136 opens within the heater support element 130 towards the heater 112 and the wick 111. This causes the air flow from the passage 136 to expand, as illustrated by the arrows 522, so that there is a good air flow where the heater 112 meets the wick 111, to entrain vapour therein prior to flow to the passage 126 in the wick support element 120.

With the arrangement shown in FIG. 15, as in the other arrangements, the sealing between the first casing 300 and the heater support element 130 at the sealing interface 518 prevents any leakage of aerosol precursor which has come from the wick 111 and has not been vaporised by the heater 112. Hence, when the consumable 103 is fitted in place on the main body 100, the only escape route for the aerosol precursor is via the air flow passage 108 and the mouthpiece 109. This helps to ensure efficient consumption of the aerosol precursor.

The arrangement of FIG. 14 also differs from the arrangement of FIG. 9 (and also that of FIG. 15), in that the wick 111 extends across the whole of the end face of the wick support element 120, as in the arrangement of FIG. 10. As before, the wick 111 has an opening 124 therein to allow air to pass through the wick 111 and into the passage 126, and hence through the air-flow passage 108 so that it can reach the outlet 109 and thus pass to the user.

Figure 16:
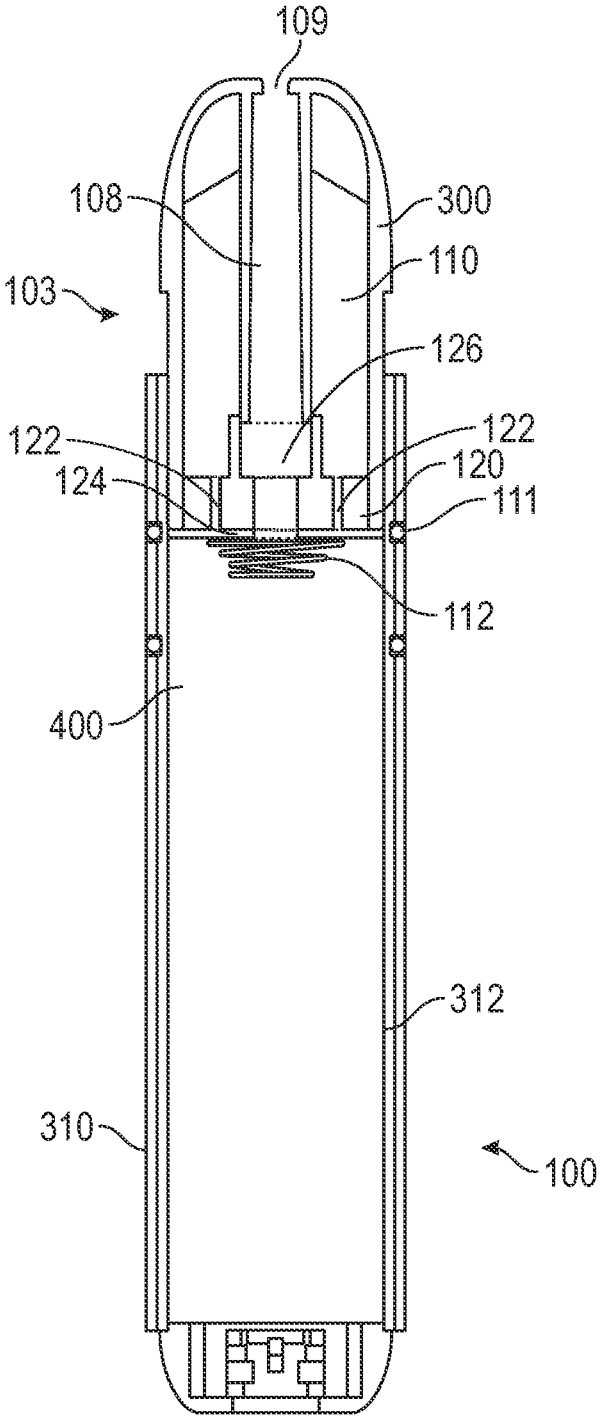
FIG. 16 shows another arrangement of a smoking substitute system in accordance with the first mode.

FIG. 16 shows another arrangement of a smoking substitute system, which is generally similar to that of the embodiment of FIGS. 9 and 10 and corresponding parts are indicated by the same reference numerals. In the embodiment of FIG. 16, however, there is no heater support element 130, and instead the heater 112 is a coil or other filament held within the second casing 310, which has a space 400 adjacent thereto. The space 400 communicates with inlets (not shown in FIG. 16) which allow air to enter the casing 310 and pass to the activation surface of the wick 111. Again, the wick 111 is forced into contact with the heater 112 by the resilience of the wick support element 120. In this arrangement, the flow of air to the activation surface is not restricted by the size of the passage or passages through the heater support element 130. In this arrangement the heater 112 needs to be sufficiently stiff that it is not deformed when the wick 111 is urged into contact therewith by the resilient wick support element 120.

Figure 17:
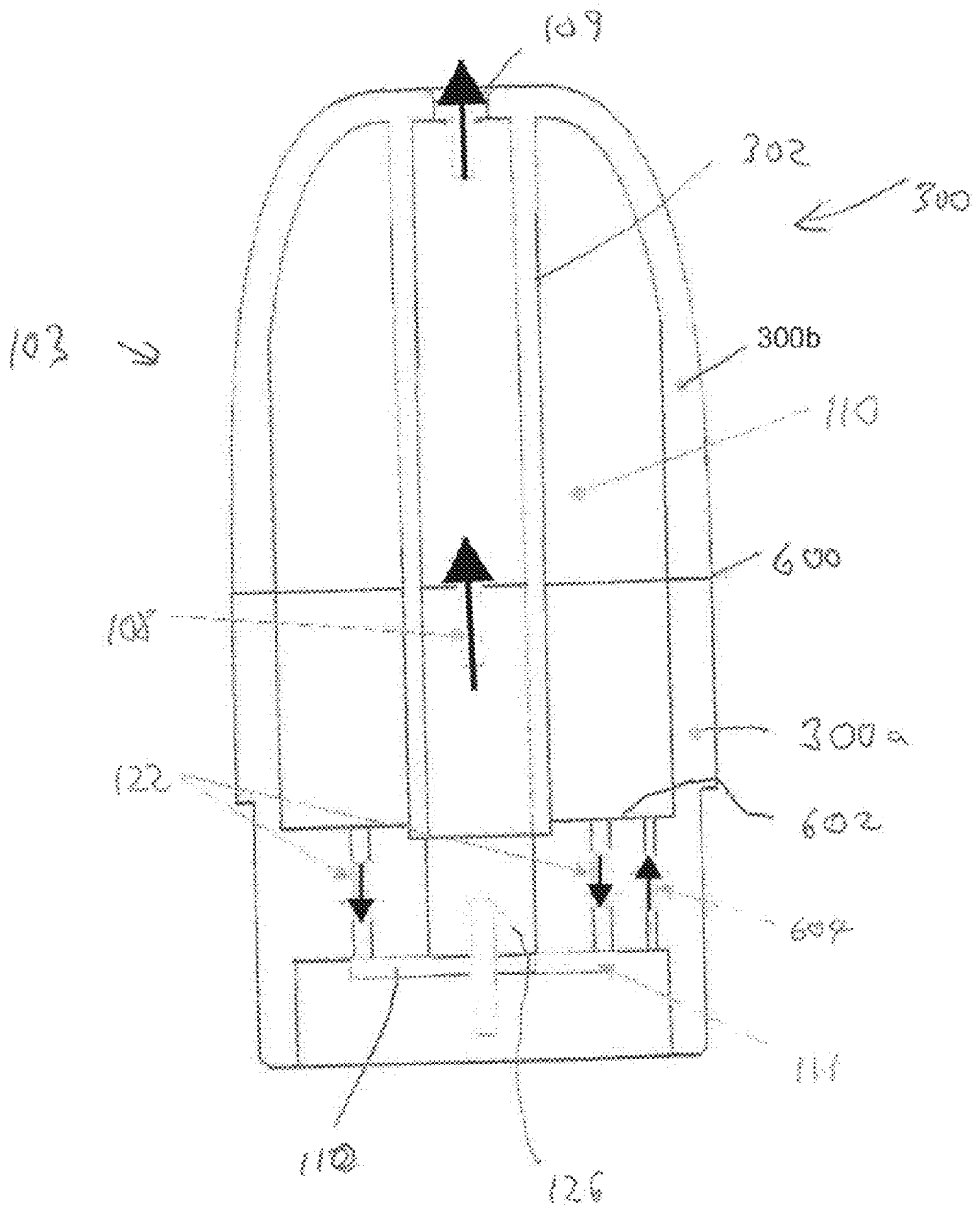
FIG. 17 shows a consumable part of another smoking substitute system in accordance with the first mode.

In the arrangements of the smoking substitute system described above, the wick support element 120 is a separate element from the first casing 300 of the consumable 103. FIG. 17 illustrates an alternative arrangement, in which the wick support element is integral with part of the first casing 300.

In the arrangement of FIG. 17, parts which correspond to arrangements described previously are indicated by the same reference numerals. Note that, in FIG. 17, the main body 100 is not shown. It may be the same as in the other arrangements of a smoking substitute system described previously.

In the arrangement of FIG. 17, the first casing 300 has a lower part **300*a* and an upper part 300*b*. The mouthpiece 109 is in the upper part 300*b*, and the tube 302 is also integral with that upper part 300*b***.

The lower part **300*a* has an upper rim which meets a lower rim of the upper part 300*b* at a sealing surface 600, and has an internal flange 602 adjacent its lower end. The internal flange 602 corresponds to the wick support element 120 of the arrangements previously described. The internal flange 602 has a central bore forming passage 126, which passage is aligned with the passage 108 within the tube 302. The end of the tube 302 furthest from the mouth piece 109 engages the flange 602** and is sealed thereto.

The interiors of the upper and lower parts 300*b* and 300*a* of the casing 300 are hollow, and form the reservoir 110. There are bores 122 in the flange 602 to allow the reservoir 110 to communicate with the wick 111, in the same way as the bores 122 in the earlier arrangements described previously. Thus, aerosol precursor in the reservoir 110 may pass through the bores 122 to saturate the wick 111, and then be heated by the heater 112 (not visible in FIG. 17). The arrangement of FIG. 17 prevents any leakage of aerosol precursor between the wick support element 120 and the casing 300. Whilst there could be leakage between the upper and lower parts 300*b*, 300*a* of the casing 300, this can be prevented by suitable configuration of the sealing interface 600. However, if the sealing of the reservoir 110 is too good, air may not be able to enter it to replace aerosol precursor which has been consumed.

Therefore, FIG. 17 shows that there may be at least one additional bore 604 in the flange 602, to allow passage of air to the reservoir 110 from outside the first casing. The or each additional bore 604 needs to be sufficiently small that it will not allow a significant amount of aerosol precursor to pass therethrough. For example, the or each additional bore 604 may be e.g. 0.2 to 0.5 mm in diameter, more preferably 0.32 to 0.5 mm, even more preferably 0.32 to 0.4 mm. If the flange has a thickness of e.g. 0.5 to 5 mm, preferably 1 to 5 mm, aerosol precursor should not be able to escape reservoir 110 through the or each additional bore 604. In general, the thicker the flange 602, the greater the possible diameter of the or each additional bore 604 may be, without it allowing aerosol precursor to flow therethrough. A thin flange 602 (which thinness may be desirable for manufacture) will thus need the diameter of the or each additional bore to be small.

The upper and lower parts 300*a*, 300*b* of the casing 300 may be separable to allow for refiling of the reservoir 110 once the aerosol precursor wherein has been consumed. In such an arrangement, the sealing at the sealing surface 640 needs to be sufficiently good to prevent leakage of aerosol precursor therethrough when the smoking substitute system is in use. Alternatively, the seal at the sealing surface 600 may be a permanent one, with the upper and lower parts 300*a* and 300*b* if the casing bonded together. In such an arrangement, the reservoir 110 may not be refillable, and the consumable 101 would need to be replaced once the aerosol precursor in the reservoir 110 had been consumed.

In the arrangements described previously, the bores 122 in the wick support element 120 (or in the flange 602 in the case of FIG. 17) were described as being sized so that aerosol precursor may flow therethrough in a non-capillary manner. In an alternative, applicable to all the arrangements described previously, the bores 122 may be capillary ducts (hereinafter referred to as capillary bores) which allow aerosol precursor to flow therethrough in a capillary manner. The capillary bores allow the flow of aerosol precursor to the wick 111, in a controlled manner, so that there is less chance of there being excess aerosol precursor at the wick 111. In general, the capillary bores may have a diameter range of 0.3 mm to 2 mm, as a diameter of less than 0.3 mm will generally not allow sufficient aerosol precursor to pass to the wick 111. Preferably, the diameter is at least 0.5 mm, preferably 0.8 to 1.5 mm, and more preferably 1 mm or 1.3 mm. In practice, the diameter of the capillary bores may be affected by the thickness of the wick support element 120, which can have a thickness of e.g. 0.5 mm to 5 mm, more preferably 1 to 5 mm, such as 4 mm, 3 mm, 2 mm and 1 mm. In general, the width of the capillary bores will need to be greater with greater thickness of the wick support element 120.

Figure 18:
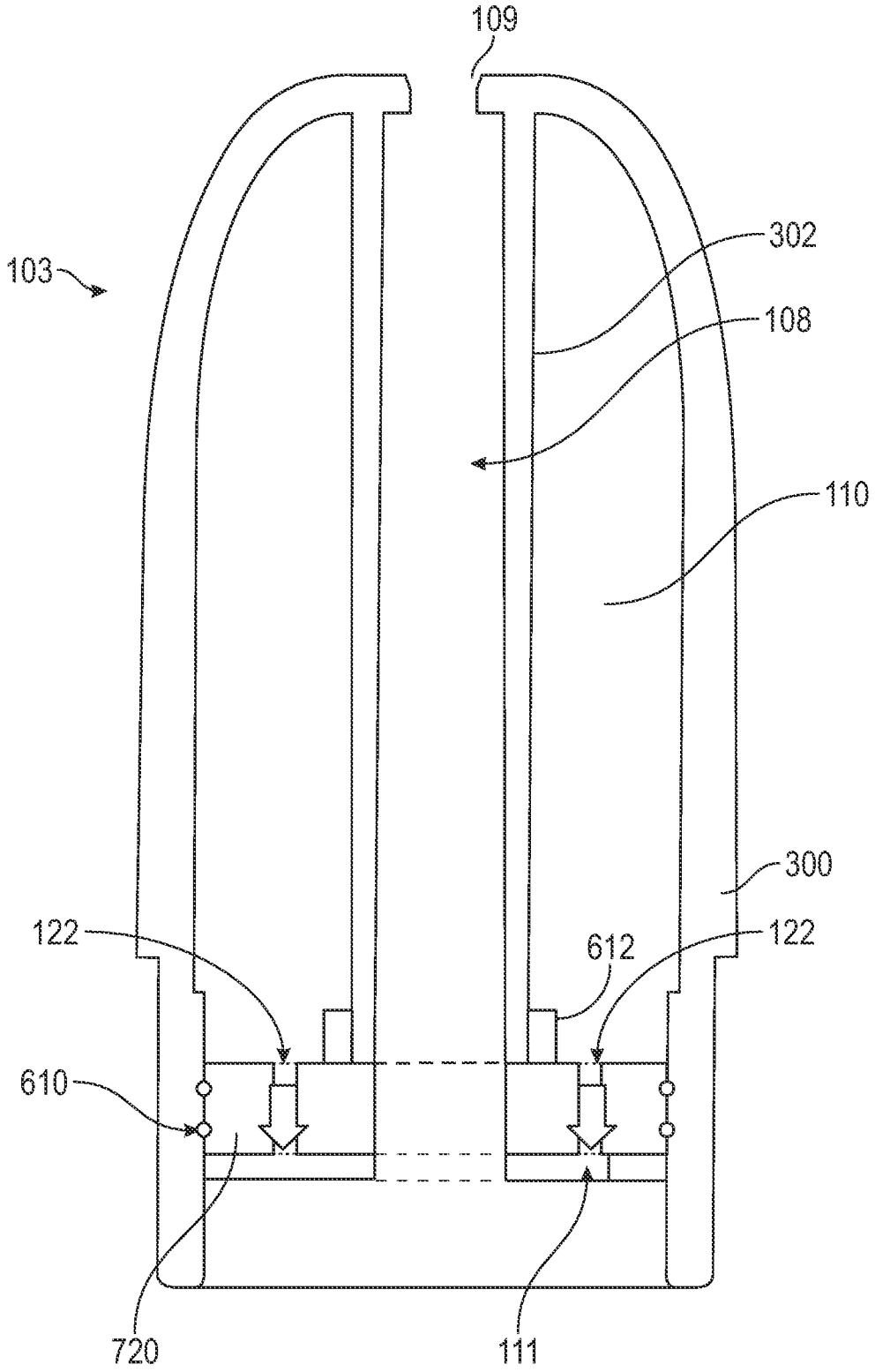
FIG. 18 shows another consumable part of a smoking substitute system in accordance with the first mode.
Figure 19:
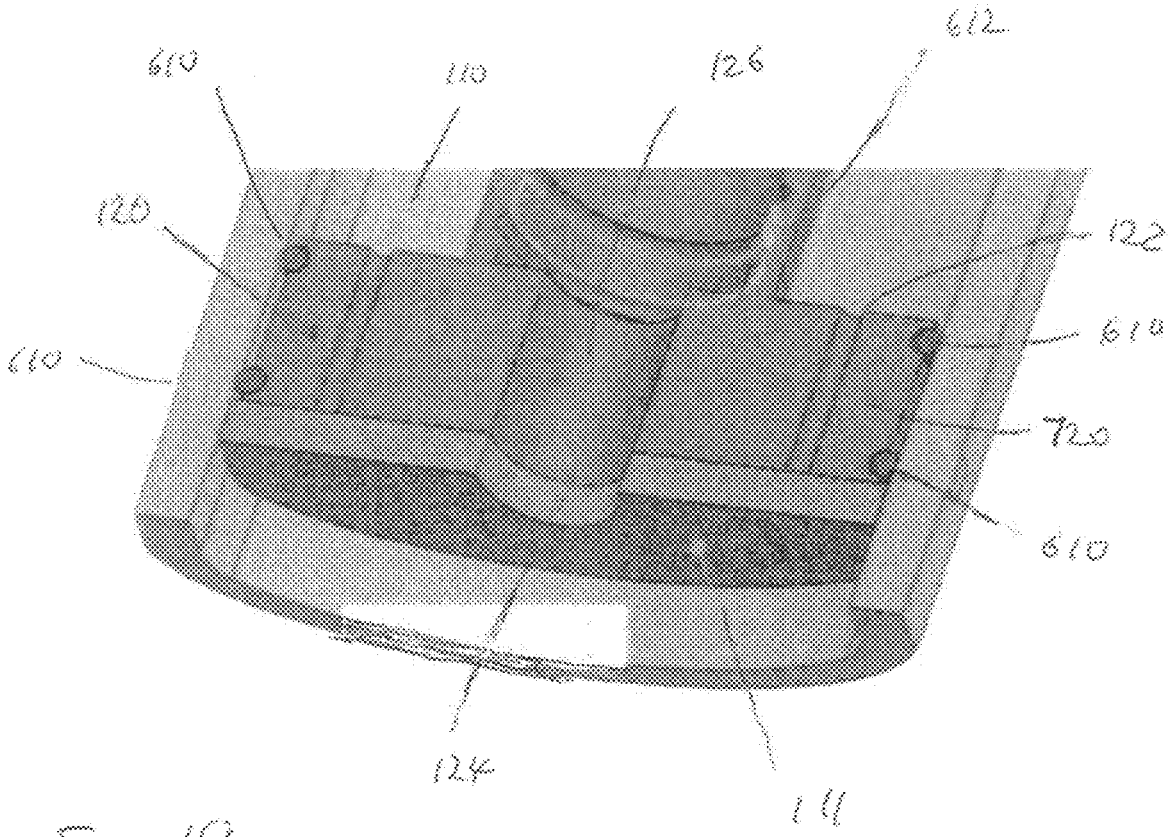
FIG. 19 shows detail of the consumable part of FIG. 18.

In the arrangements of FIGS. 6 to 16, the wick support element 120 is made of resilient material such as rubber. In the arrangement of FIG. 17 on the other hand, the support for the wick 111 is rigid, because it was formed by the internal flange 602 which was integral with, and therefore made of the same material as, the casing 300. FIGS. 18 and 19 then illustrate another arrangement in which the wick is supported by a rigid element. Unlike the arrangement of FIG. 17, however, in the arrangement of FIGS. 18 and 19, that rigid element is a separate wick support element 720. In FIGS. 18 and 19, parts which correspond to parts of earlier arrangements are indicated by the same reference numerals. Moreover, as in FIG. 17, only the consumable 103 is illustrated. The main part 100 may be the same as in earlier arrangements.

In particular, in the arrangements of FIGS. 18 and 19, the rigid wick support element 720 is formed at an end of the reservoir 110, within the first casing 300. Bores 122 through the wick support element 720 allow aerosol precursor from the reservoir 110 to pass to wick 111. Whilst the bores 122 may be non-capillary bores, they are preferably capillary bores. The diameter of the capillary bores may be as previously described, as may the thickness of the wick support element 720. Although not illustrated in FIGS. 18 and 19, there may need to be an additional bore or bores in the wick support element 720 to allow passage of air to the reservoir 110, corresponding to the at least one additional bore 604 in FIG. 17.

In order to prevent escape of liquid from the reservoir, the wick support element 720 is preferably sealed to the first casing 300 by seals 610. For example, the seals 610 may be O-ring seals extending around the wick support element 120. The seals can be seen clearly in FIG. 19, as can the opening 124 in the wick 111, which leads to the passage 126 through the wick support element 720 to the air-flow passage 108. The wick support element 720 also needs to be sealed to the tube 302, to prevent escape of aerosol precursor from the reservoir 110. To achieve this, the wick support element 720 may have an upstanding ring 612, which then seals (e.g. by O-rings and/or an interference fit) to the tube 302. Grooves for those O-rings are illustrated in FIG. 19. Another possibility is for the tube 302 to be integral with the wick support element 720, with the end of the tube 302 being sealed to the casing 300 adjacent the mouthpiece 109.

The rigidity of the wick support element 720 and the tube 302 means that the positioning of the wick support element 720 on the tube 302 and the positioning of the tube 302 relative to the casing 300 may be determined to good precision. This ensures that the wick 111 is accurately positioned relative to the casing 300, and hence accurately positioned relative to the casing 310 and the heater 112.

In the arrangement of FIGS. 18 and 19, the wick support element 720 may be made of the same material as the casing 300 (and the casing 310) such as being made from moulded polypropylene plastics material. Other suitable materials to form the wick support element 720 include ABS and PEAK materials. The seals 610 may be O-rings of e.g. rubber material or silicone seals co-moulded with the wick support element 720, but preferably are nitrile or thermoplastic polymer O-ring seals. The moulding of the wick support element 720 and the first and second casings 300, 310 simplifies manufacture.

Because the wick support element 720 is rigid in the arrangement of FIGS. 18 and 19, it may be thinner than the resilient wick support elements 120 described with reference to e.g. FIGS. 5 to 16. Thus, it may then be possible to have a wick support element 720 with a thickness of e.g. 0.5 to 2 mm, preferably 1 mm, allowing the bores 122 to have a small diameter, and still provide a capillary effect. The same is true in the arrangement of FIG. 17. Thus, at least in the arrangements of FIGS. 17 to 19, the bores 122 may have a diameter of 0.3 mm to 2 mm, most preferably 0.5 mm. If one or more additional bores are provided, corresponding to the additional bores 604 in the arrangement of FIG. 18, to allow air to enter the reservoir volume to replace aerosol precursor which has passed to the wick 111, those additional bores will have small diameters, due to the reduced thickness of the wick support element 720, so e.g. less than 0.3 mm. The diameter of the additional bores will always be less than the diameter of the capillary bores. It should be noted that, even in the arrangements of FIGS. 5 to 16, it may be possible to have small diameter capillary bores, if the wick support element 120 is thin enough.

In the arrangements of FIGS. 17 to 19, the position of the wick 111 is precisely determined, relative to the casing 300, either because the wick support element is part of the casing itself, as in the arrangement of FIG. 17, or because the position of the wick support element 720 is determined by a component of the casing such as the tube 302, as in the arrangement of FIGS. 18 and 19. This precise positioning of the wick 111 in the casing 300 means that manufacture will be consistent and hence replacement of one consumable with another will not alter the relationship between the wick 111 and the heater 112, and so will not affect the efficiency of the smoking substitute device.

The use of capillary bores 122 in the wick support element 720 in the arrangements of FIGS. 17 to 19 mean that it is possible to optimise the flow of aerosol precursor to the wick 111 to minimise leakage.

The length and diameter of the capillary bores 122 may be chosen to control the flow of a specific aerosol precursor formulation to the wick 111, based on the viscosity and liquid characteristics of that aerosol precursor. When aerosol precursor is vaporised from the wick 111 by the heater 112, there will be an available volume of air in the wick 111 allowing additional aerosol precursor to flow into the wick 111, so that the wick 111 is maintained in a saturated state when the device is in use. The rigid nature of the wick support element 720 improves the consistency of liquid flow to the wick 111, compared to a wick support element 120 of resilient material, so that efficient operation may be achieved.

The sealing configuration in the arrangement of FIGS. 18 and 19 makes use of O-rings, with the effect of minimising leakage in use and in transit, as a robust seal is created between the wick support element 720 and the casing 300, so that there is no leakage path therebetween. O-ring technology is well established, so it is straight forward to put in to practice in the smoking substitute device to reduce or eliminate variation between parts, improving repeatability of manufacture.

The use of a rigid wick support element 720 in the arrangements of FIGS. 17 to 19 means that the wick support element 720 is easy to manufacture with high precision, and the assembly of the consumable may easily be automated. This ensures efficient manufacture, thereby reducing costs.

Second Mode of the Disclosure

In general outline, one or more embodiments in accordance with the second mode of the present disclosure may provide a system for aerosol delivery in which an aerosol carrier may be inserted into a receptacle (e.g. a "heating chamber") of an apparatus for initiating and maintaining release of an aerosol from the aerosol carrier.

Another end, or another end portion, of the aerosol carrier may protrude from the apparatus and can be inserted into the mouth of a user for the inhalation of aerosol released from the aerosol carrier cartridge during operation of the apparatus.

Hereinafter, and for convenience only, "system for aerosol delivery" shall be referred to as "aerosol delivery system".

Figure 20:
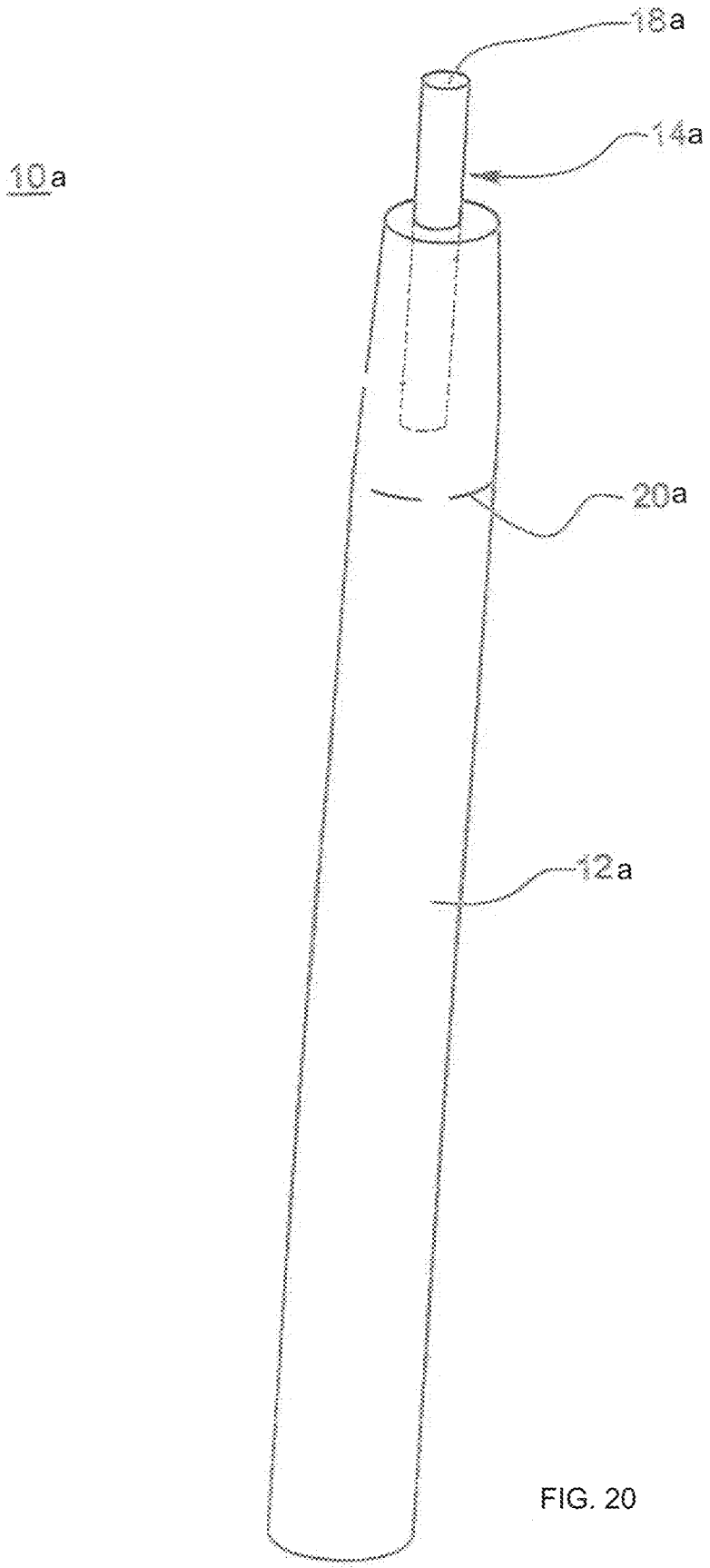
FIG. 20 is a perspective view illustration of a system for aerosol delivery according to one or more embodiments of the second mode of the present disclosure.

Referring now to FIG. 20, there is illustrated a perspective view of an aerosol delivery system 10*a* comprising an aerosol generation apparatus 12*a* operative to initiate and maintain release of aerosol from a fluid-transfer article in an aerosol carrier 14*a*. In the arrangement of FIG. 20, the aerosol carrier 14*a* is shown with a first end thereof and a portion of the length of the aerosol carrier 14*a* located within a receptacle of the apparatus 12*a*. A remaining portion of the aerosol carrier 14*a* extends out of the receptacle. This remaining portion of the aerosol carrier 14*a*, terminating at a second end 18*a* of the aerosol carrier, is configured for insertion into a user's mouth. The second end 18*a* thus acts as a mouthpiece. A vapour and/or aerosol is produced when a heater (not shown in FIG. 20) of the apparatus 12*a* heats the aerosol carrier 14*a* to form a mixture of vapour and air, and this can be atomised aerosol precursor, and this can be delivered to the user, when the user sucks or inhales, via a fluid passage (air duct) in communication with an outlet of the aerosol carrier 14*a* from the fluid-transfer article to the second end 18*a*.

The device 12*a* also comprises air-intake apertures 20*a* in the housing of the apparatus 12*a* acting as inlets to provide a passage for air to be drawn into the interior of the apparatus 12*a* (when the user sucks or inhales) for delivery to the first end 16*a* of the aerosol carrier 14*a*, so that the air can be drawn into the device. Optionally, these apertures may be perforations in the housing of the apparatus 12*a*.

Figure 21:
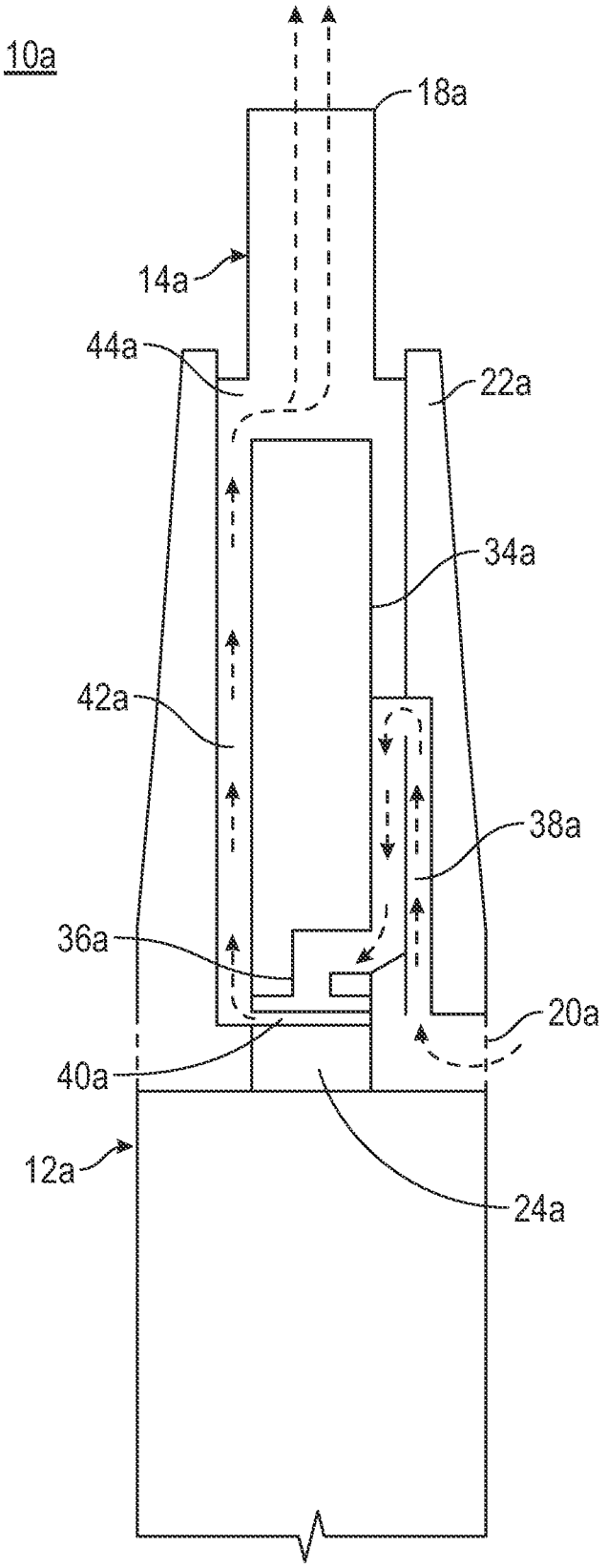
FIG. 21 is a cross-section side view illustration of part of an apparatus of the system for aerosol delivery of FIG. 20.
Figure 26:
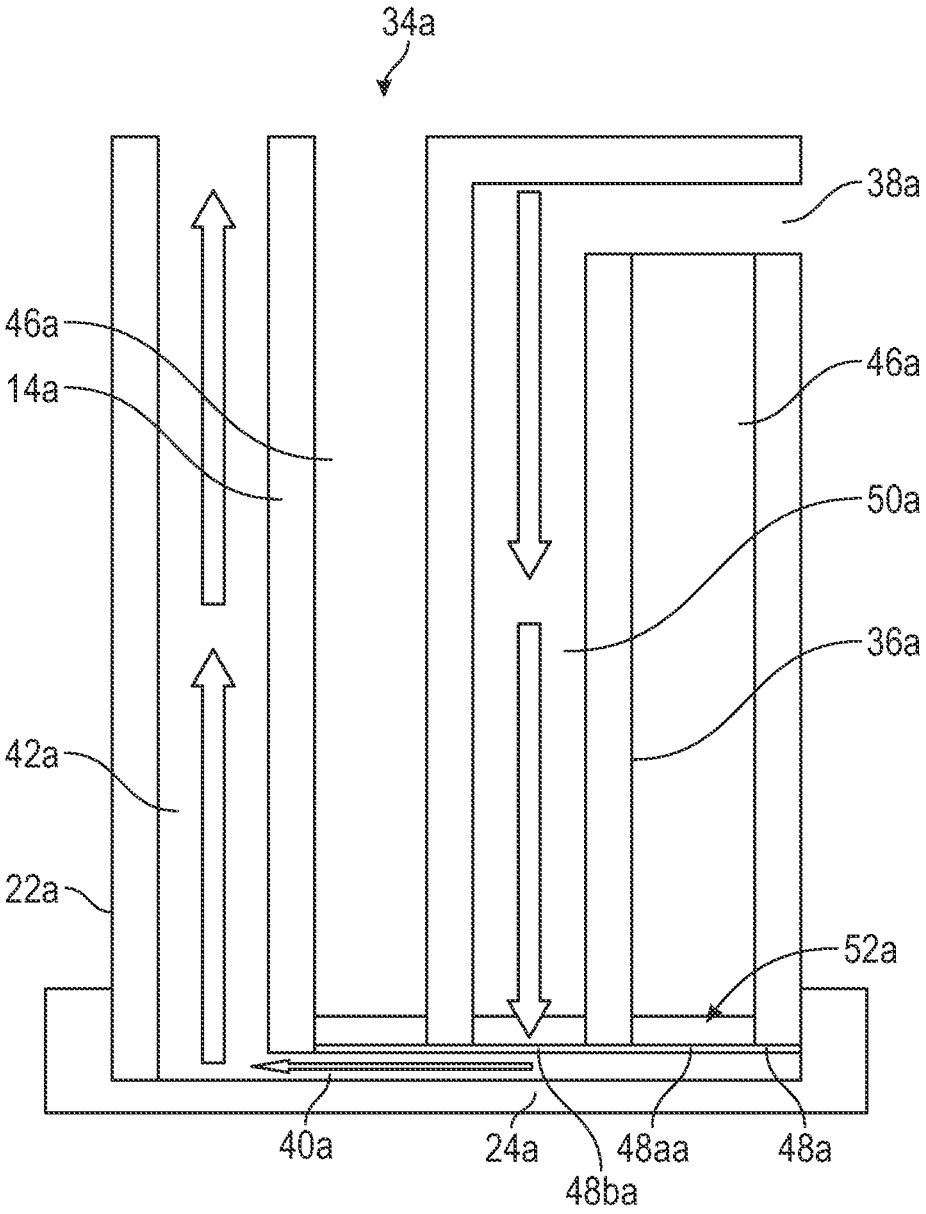
FIG. 26 is a cross-section side view of part of the system and apparatus of FIGS. 21 and 23.

A fluid-transfer article 34*a* (not shown in FIG. 20, but described hereinafter with reference to FIGS. 21 and 26 is located within a housing of the aerosol carrier 14*a*. The fluid-transfer article contains an aerosol precursor material, which may include at least one of: nicotine; a nicotine precursor material; a nicotine compound; and one or more flavourings. The fluid-transfer article is located within the housing of the aerosol carrier 14*a*.

The substrate of the fluid-transfer article 34*a* may comprise a porous material where pores of the porous material hold, contain, carry, or bear the aerosol precursor material and thus act as a reservoir for the aerosol precursor. In particular, the porous material of the fluid-transfer article may be a porous polymer material such as, for example, a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET). All such materials may be described as heat resistant polymeric wicking material in the context of the present disclosure.

Alternatively, the fluid-transfer article 34*a* may comprise a simple liquid reservoir in the form of an empty tank for the receipt and storage of liquid aerosol precursor, rather than a porous material for holding the aerosol precursor.

The aerosol carrier 14*a* is removable from the apparatus 12*a* so that it may be disposed of when expired. After removal of a used aerosol carrier 14*a*, a replacement aerosol carrier 14*a* can be inserted into the apparatus 12*a* to replace the used aerosol carrier 14*a*.

FIG. 21 is a cross-sectional side view illustration of a part of apparatus 12*a* of the aerosol delivery system 10*a*. The apparatus 12*a* comprises a receptacle 22*a* in which is located a portion of the aerosol carrier 14*a*. In one or more optional arrangements, the receptacle 22*a* may enclose the aerosol carrier 14*a*. The aerosol carrier 14*a* and the receptacle 22*a* are separable, so they may be considered first and second housings. The apparatus 12*a* also comprises a heater 24*a*, which opposes an atomiser 36*a* of the fluid-transfer article 34*a* when the aerosol carrier 14*a* is located within the receptacle 22*a*.

Air flows into the apparatus 12*a* (in particular, into a closed end of the receptacle 22*a*) via air-intake apertures 20*a*. From the closed end of the receptacle 22*a*, the air is drawn through a duct 38*a* into the atomiser 36*a*. The internal components of the atomiser 36*a*, and the fluid therethrough, will be described later with reference to FIG. 26. The air passes through the atomiser 36*a* and out into a gap 40*a* between the atomiser 36*a* and the heater 24*a*. This will be described in more detail later, but it can be noted that the gap 40*a* acts as an activation region for aerosol precursor. From gap 40*a* the air passes through a further duct 42*a* in the receptacle 22*a*, through an opening 44*a* in the aerosol carrier 14*a*, and may then pass to the second end 18*a*, which acts as a mouthpiece. The air flow is as illustrated by the dotted arrows in FIG. 21. In effect, a continuous air duct is formed from the air-intake apertures 20*a* to the second end 19*a*, through the duct 38*a*, through the atomiser 36*a*, through the gap 40*a*, through the further duct 42*a*, through the opening 44*a* and through the carrier 14*a* to the mouthpiece. When the user draws air from the mouthpiece, air flow is generated along the whole of that air duct.

To achieve release of the captive aerosol from the fluid-transfer article, aerosol precursor is released from a reservoir (not shown in FIG. 21) of the fluid transfer article 34*a*, to the atomiser 36*a* and passes to the heater 24*a* where it is heated. As a user sucks or inhales on the second end 18*a* of the aerosol carrier 14*a*, the aerosol released from the fluid-transfer article 34 is entrained in the air flowing through the atomiser 36*a* to be atomised and subsequently vapourised by the heater 24*a*, and is then drawn through the ducts 42*a* towards the second end 18*a* and onwards into the user's mouth.

Figure 23:
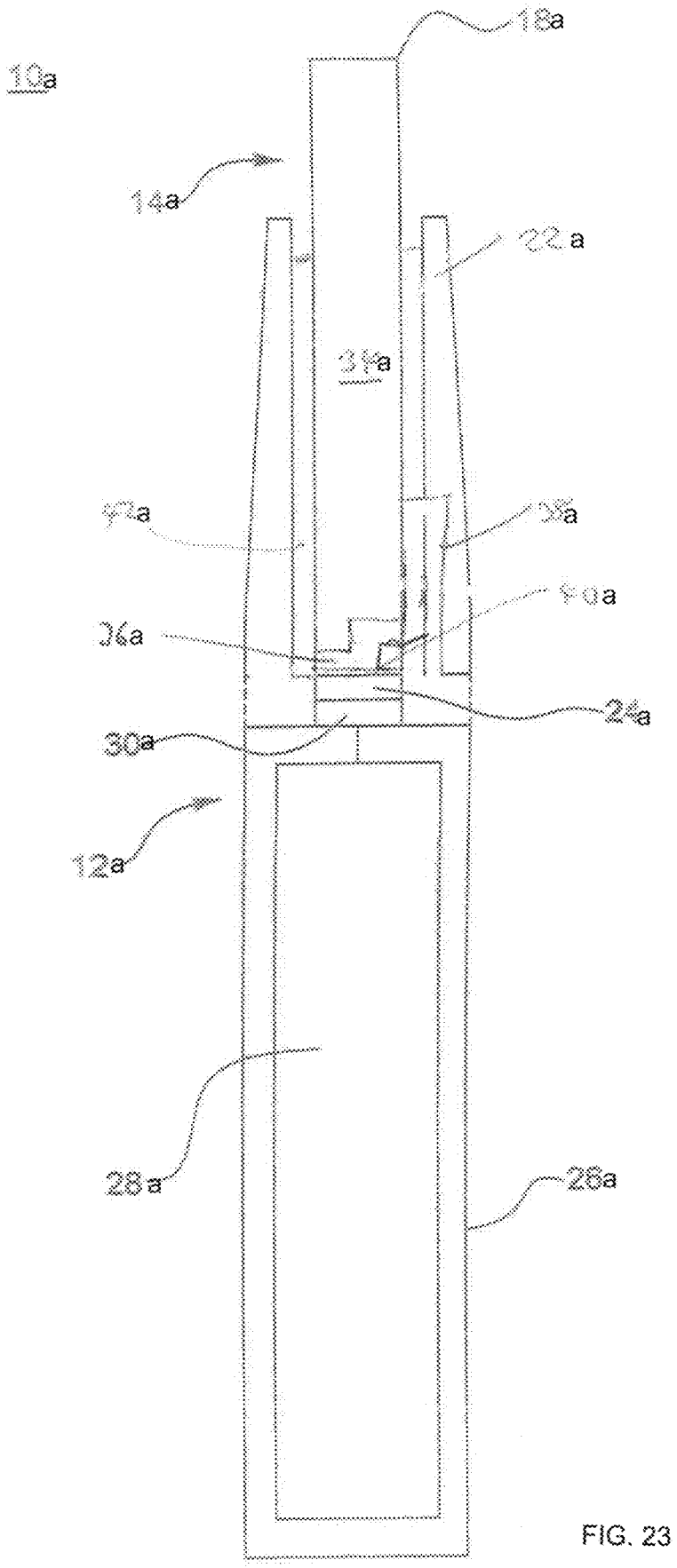
FIG. 23 is a cross-section side view illustration of the system and apparatus for aerosol delivery of FIG. 21.

Turning now to FIG. 23, a cross-sectional side view of the aerosol delivery system 10*a* is schematically illustrated showing the features described above in relation to FIGS. 20 and 21 in more detail. As can be seen, apparatus 12*a* comprises a housing 26*a*, which may support or be integral with the receptacle 22*a*. The housing 26*a* also contains control circuitry (not shown) operative by a user, or upon detection of air and/or vapour being drawn into the device 12*a* through air-intake apertures 20*a*, i.e. when the user sucks or inhales. Additionally, the housing 26*a* comprises an electrical energy supply 28*a*, for example a battery. Optionally, the battery comprises a rechargeable lithium ion battery. The housing 26*a* also comprises a coupling 30*a* for electrically (and optionally mechanically) coupling the electrical energy supply 28*a* to control circuitry (not shown) for powering and controlling operation of the heater 24*a*.

Responsive to activation of the control circuitry of the apparatus 12*a*, the heater 24*a* heats the activation region in gap 40*a*. This heating process initiates (and, through continued operation, maintains) vaporisation of atomised aerosol precursor on the heater 24*a* and/or present in the gap 40*a*. The vapour formed as a result of the heating process is entrained into a stream of air being drawn through the activation region formed by the gap 40*a* (as the user sucks or inhales). The stream of air with the entrained vapour passes through the duct 42*a* and exits the aerosol carrier 14*a* at second end 18*a* for delivery to the user. This process is briefly described above in relation to FIG. 21, where arrows schematically denote the flow of the air stream into the device 12*a* and through the aerosol carrier 14*a*, and the flow of the air stream with the entrained vapour and/or aerosol through the aerosol carrier 14*a*.

Note that, as previously mentioned, the atomisation of aerosol precursor by the atomiser 36*a* and/or the vapourisation of atomised aerosol precursor by the heater 24*a* need not be complete. Therefore, there may be un-atomised or un-vapourised aerosol precursor in the air flow at gap 40*a* and/or in the duct 42*a*, which may then pass to the second end 18*a*. The mixture of air and vapour which passes to the user may itself be mixed with some un-atomised or un-vapourised aerosol precursor, although some of that aerosol precursor may stick to the sides of the duct 42*a* and flow back towards the heater 24*a*. In general, it is desirable that the amount of un-atomised and/or un-vapourised aerosol precursor is small.

Figure 25:
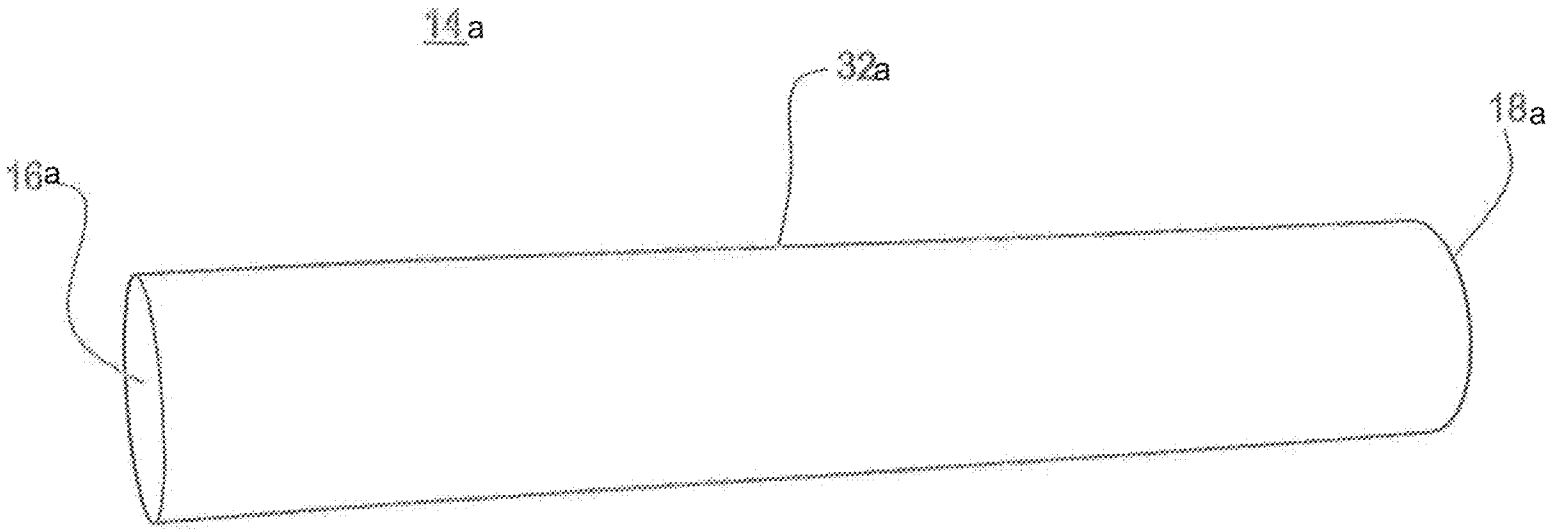
FIG. 25 is a perspective view illustration of an aerosol carrier for use in the system for aerosol delivery according to one or more embodiments of the second mode of the present disclosure.

FIGS. 25 and 26 schematically illustrate the aerosol carrier 14*a* in more detail, and FIG. 26 illustrates features within the receptacle in more detail. FIG. 25 illustrates an exterior of the aerosol carrier 14*a*, and FIG. 26 illustrates internal components in one optional configuration.

FIG. 25 illustrates the exterior of the aerosol carrier 14*a*, which comprises housing 32*a* for housing said fluid-transfer article (not shown). The particular housing 32*a* illustrated in FIG. 25 comprises a tubular member, which may be generally cylindrical in form, and which is configured to be received within the receptacle of the apparatus. Of course, in other arrangements the housing 32*a* need not be cylindrical and can take alternative forms. The first end 16*a* of the aerosol carrier 14*a* is for location to oppose the intermediate structure and the heater 24*a* of the apparatus, and the second end 18*a* (and the region adjacent the second end 18*a*) is configured for insertion into a user's mouth.

FIG. 26 illustrates some internal components of the aerosol carrier 14*a*, atomiser 36*a* and the heater 24*a* of apparatus 12*a*, in one proposed embodiment of the second mode of the disclosure.

As described above, the aerosol carrier 14*a* comprises a fluid-transfer article 34*a*. The fluid-transfer article 34*a* may be removable from the carrier 14*a*, to enable it to be replaced. The fluid-transfer article 34*a* acts as a reservoir for aerosol precursor and that aerosol precursor will be consumed as the apparatus is used. Once sufficient aerosol precursor has been consumed, the aerosol precursor will need to be replaced. It may then be easiest to replace it by replacing the fluid-transfer article 34*a*, rather than trying to re-fill the fluid-transfer article 34*a* with aerosol precursor while it is in the carrier 14*a*.

FIG. 26 then illustrates in more detail parts of the fluid-transfer article 34*a*, which includes the atomiser 36*a*, the heater 24*a* and adjacent ducts and housings. The fluid-transfer article has a reservoir 46*a* which may, as previously described, be of porous material holding the aerosol precursor, or may be a tank for the storage of liquid aerosol precursor. The atomiser 36*a* then comprises a duct 50*a*, a mesh 48*a*, and a wick 52*a*. In this arrangement, the atomiser 36*a* is part of the fluid-transfer article 34*a*, and contained within the carrier 14*a*. The reservoir 46*a* extends around the duct 50*a*.

The wick 52*a* is in contact with the reservoir 46*a* to receive aerosol precursor therefrom. It is also in contact with an outer part 48*aa* of the mesh 48*a*, so that aerosol precursor is transferred via the wick 52*a* to that outer part 48*aa* of the mesh 48*a*. Further wicking action within the mesh 48*a* itself causes the aerosol precursor to transfer from the outer part 48*aa* of the mesh 48*a* to an inner part 48*ba* of the mesh 48*a*, that inner part 48*ba* being aligned with the duct 50*a*. The air path from the duct 50*a* passes through the mesh 48*a*, and flow of air through the duct 50*a* causes liquid at the inner part 46*ba* of the mesh to be expelled from the mesh 48*a* in atomised form. In particular, as the air flows through the mesh 48*a*, it forces the aerosol precursor from the voids in the mesh 48*a*, which generates atomised aerosol precursor in the air flow. The atomised aerosol precursor crosses the gap 40*a* onto the heater 24*a* to be vaporised by the heat therefrom.

Whilst it would be possible for the mesh 48*a* to receive aerosol precursor directly from the reservoir 46*a*, the presence of the wick 52*a* is advantageous, as it controls or regulates the flow of liquid onto the mesh, so that the mesh does not become over-saturated. The amount of aerosol precursor reaching the mesh will be determined by the degree of wicking occurring within the wick 52*a*. Thus, the amount of aerosol precursor reaching the central region 48*ba* of the mesh 48*a* may be regulated by the wick 52*a* so that substantially all of the aerosol precursor at that central region 48*ba* will be atomised by the air flow from the duct 50*a*. Similarly, the amount of aerosol precursor which has been atomised at the mesh 48*a* can be regulated (for example, by choice of the sizes of the duct 50*a* and the central region 48*a* of the mesh 48*a*, so that substantially all of the atomised aerosol precursor is vaporised by the heater 24*a*. It is not necessary that the atomisation and/or vaporisation processes are complete, although it is preferable that they are as efficient as possible.

As aerosol precursor is removed from the central region 46*ba* of the mesh 48*a* further aerosol precursor will transfer from the outer region 46*aa*, and similarly additional aerosol precursor will then pass to the outer region 48*aa* and the wick 52*a*. Such removal of the aerosol precursor from the wick 52*a* causes more aerosol precursor to be drawn from the reservoir 46*a*, to maintain the wick 52*a* in a saturated or semi-saturated state.

In the arrangement shown in FIG. 26, the mesh 48*a* and the wick 52*a* are at an end of the casing 14*a*, and thus part of with the fluid-transfer article 34*a*. The duct 50*a* also forms part of the structure. Thus, when the carrier 14*a* is removed from the receptacle 22*a*, the mesh 48*a* and wick 52*a* are also removed, but the heater 24*a* remains. As an alternative, it may be possible for the mesh 48*a* to be supported by the receptacle 22*a*, and be separable from the casing 14*a*. In such an arrangement, it will normally be preferable for the wick 52*a* to be removed with the casing 14*a*, as the wick 52*a* closes the reservoir 46*a*.

Thus, with the present disclosure, the passage of air through the central region 48*ba* of the mesh 48*a* from the duct 50*a* generates a spray of atomised aerosol precursor in the gap 40*a*, with the movement of air causing that spray to impinge on the heater 24*a*. The heater 24*a* then heats the atomised aerosol precursor deposited thereon, to vaporise at least some of the atomised aerosol precursor at the activation region formed by the gap 40*a*. A mixture of vapour and air, or a mixture of vapour, aerosol, and air then passes through the duct 42*a*, and ultimately to the second end 18*a* forming the mouthpiece, as was described with reference to FIG. 21. In practice, a plurality of ducts 38*a* and ducts 42*a* may be provided at different radial positions around the fluid-transfer article 34*a*, via multiple air flow paths to the venturi 36*a* and to the second end 18*a*.

In the arrangement of FIG. 26, there is no direct contact between the mesh 48*a* and the heater 24*a* Instead, the atomised aerosol precursor is heated by being sprayed from the mesh 48*a* on to the heater. This means that the mesh 48*a* can be made of a material with less heat resistance then would be needed if it was in contact with the heater 24*a*. Similarly the wick 52*a* can be made of less expensive material. For example, the wick 52*a* may be of a fibrous material, such as glass fibre, cotton or ceramic fibre. Alternatively, it may be a porous polymer material, such as a sintered polymer, or a porous ceramic material, such as a sintered ceramic. The separability of the carrier 14*a* from the rest of the device enables the aerosol precursor in the reservoir 46*a* to be replaced as it is consumed during use of the device. This may be done by re-filling the reservoir 46*a* or replacing the fluid-transfer article 34*a* with another such article having a filled reservoir 46*a*. The heater 24*a* thus remains with the device even when the reservoir 46*a* is removed and the fluid-transfer article replaced, optimising the cost of the fluid-transfer article 34*a*.

Figure 22:
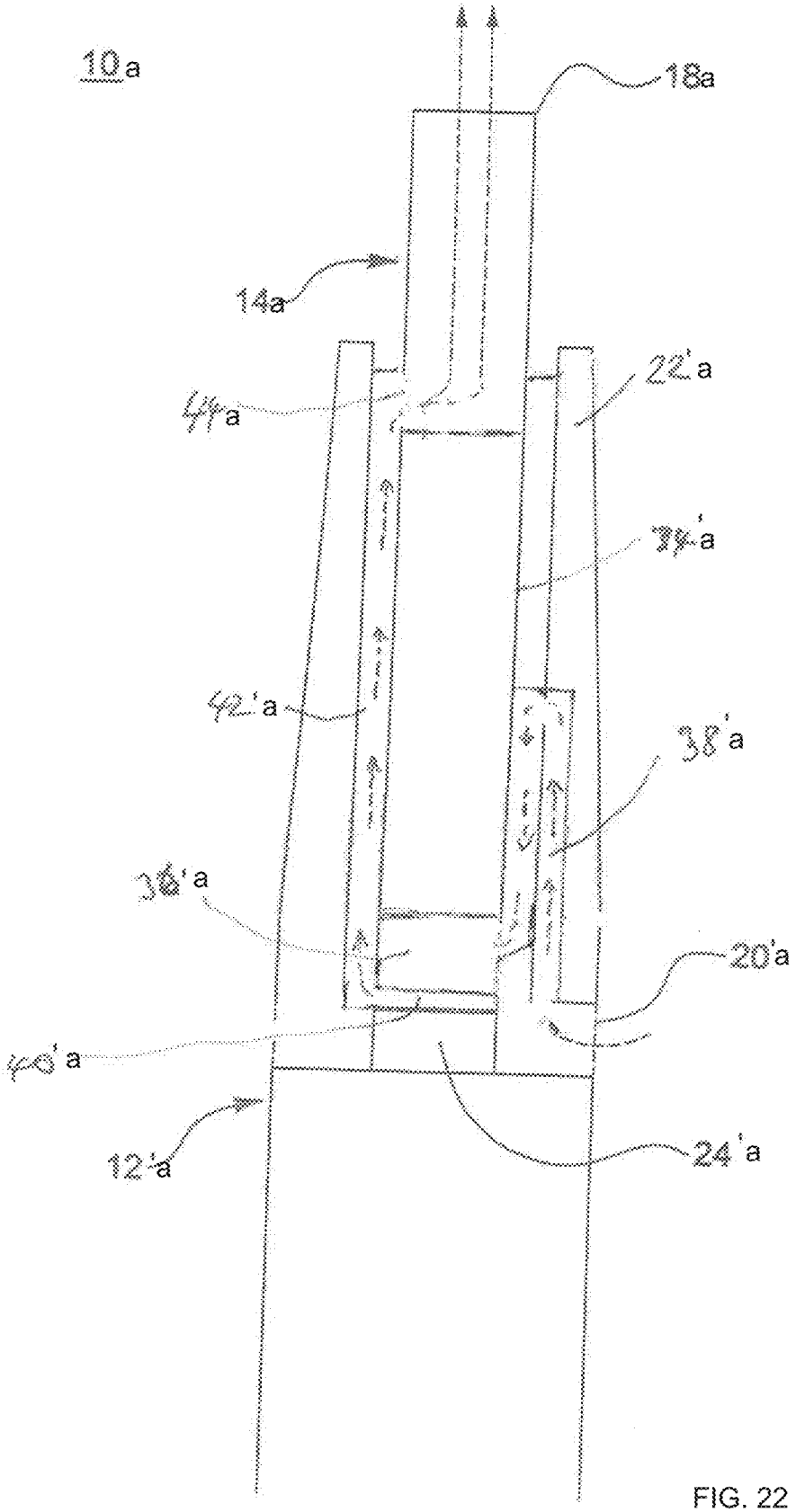
FIG. 22 is a cross-section side view illustration of part of an alternative apparatus of the system for aerosol delivery of FIG. 20.

Turning now to consider FIG. 22, there is shown a cross-sectional side view illustration of a part of an alternative apparatus 12'*a* of the aerosol delivery system 10*a*. The apparatus 12'*a* is similar in some respects to the apparatus 12*a* described above with reference to FIGS. 21, 23 and 26.

The alternative apparatus 12'*a* comprises a receptacle 22'*a* in which is located a portion of the aerosol carrier 14*a*. In one or more optional arrangements, the receptacle 22'*a* may enclose the aerosol carrier 14*a*. The apparatus 12'*a* also comprises a heater 24'*a*, which opposes a venturi 36'*a* between the fluid-transfer article 34*a* and the heater 24'*a* when an aerosol carrier 14*a* is located within the receptacle 22'*a*.

Air flows into the apparatus 12'*a* (in particular, into a closed end of the receptacle 22'*a*) via air-intake apertures 20'*a*. From the closed end of the receptacle 22'*a*, the air is drawn through a duct 38'*a* into the venturi 36'*a*. The internal components of the venturi 36'*a*, and the fluid therethrough, will be described later with reference to FIG. 27. The air passes through the venturi 36'*a* and out into a gap 40'*a* between the venturi 36'*a* and the heater 24'*a*. This will be described in more detail later, but it can be noted that the gap 40'*a* acts as an activation region for aerosol precursor. From gap 40'*a* the air passes through a further duct 42'*a* in the receptacle 22'*a*, through an opening 44'*a* in the aerosol carrier 14*a*, and may then pass to the second end 18*a*, which acts as a mouthpiece. The air flow is as illustrated by the dotted arrows in FIG. 2B. In effect, a continuous air duct is formed from the air-intake apertures 20*a* to the second end 18*a*, through the duct 38'*a*, through the venturi 36'*a*, through the gap 40'*a*, through the further duct 42'*a*, through the opening 34'*a* and through the carrier 14*a*. When the user draws air from the mouthpiece, air flow is generated along the whole of that air duct.

To achieve release of the captive aerosol from the fluid-transfer article, aerosol precursor is released from a reservoir (not shown in FIG. 22) of the fluid transfer article 34*a*, into the air duct 38'*a* at or upstream of the venturi 36'*a*, and directed to the heater 24'*a* where it is heated. As a user sucks or inhales on second end 18*a* of the aerosol carrier 14*a*, the aerosol released from the fluid-transfer article 34*a* is entrained in the air flowing through the venturi 36'*a* to be atomised and subsequently vapourised by the heater 24'*a*, and is then drawn through the ducts 42'*a* towards the second end 18*a* and onwards into the user's mouth.

Figure 24:
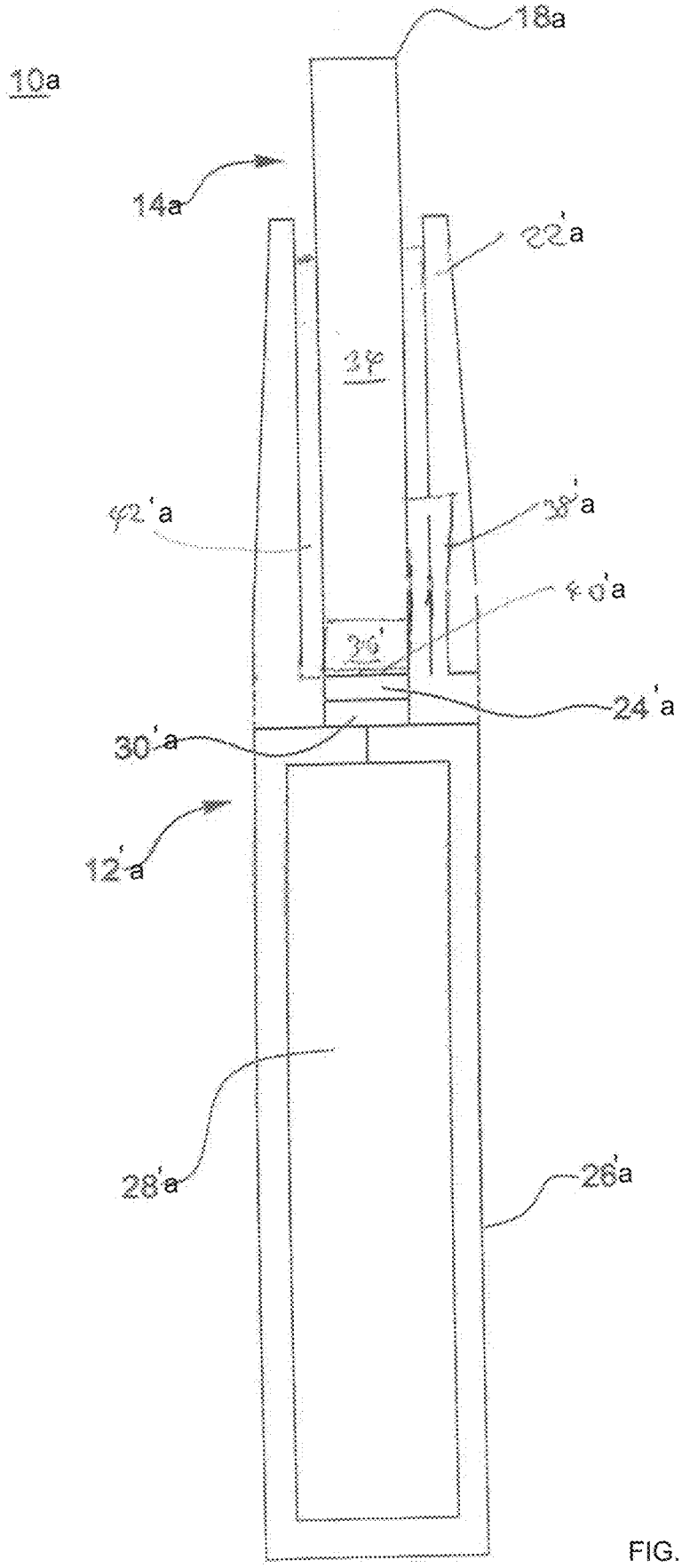
FIG. 24 is a cross-section side view illustration of the system and alternative apparatus for aerosol delivery of FIG. 22.

Turning now to FIG. 24, a cross-sectional side view of the aerosol delivery system 10*a* is schematically illustrated showing the features described above in relation to FIGS. 20 and 22 in more detail. As can be seen, apparatus 12'*a* comprises a housing 26'*a*, in which is located the receptacle 22'*a*. The housing 26'*a* also contains control circuitry (not shown) operative by a user, or upon detection of air and/or vapour being drawn into the device 12'*a* through air-intake apertures 20'*a*, i.e. when the user sucks or inhales. Additionally, the housing 26'*a* comprises an electrical energy supply 28'*a*, for example a battery. Optionally, the battery comprises a rechargeable lithium ion battery. The housing 26'*a* also comprises a coupling 30'*a* for electrically (and optionally mechanically) coupling the electrical energy supply 28'*a* to control circuitry (not shown) for powering and controlling operation of the heater 24'*a*.

Responsive to activation of the control circuitry of the apparatus 12'*a*, the heater 24'*a* heats the activation region in gap 40'*a*. This heating process initiates (and, through continued operation, maintains) vaporisation of atomised aerosol precursor present in the gap 40'*a*. The vapour formed as a result of the heating process is entrained into a stream of air being drawn through the activation region formed by the gap 40'*a* (as the user sucks or inhales). The stream of air with the entrained vapour passes through the duct 42'*a* and exits the aerosol carrier 14*a* at second end 18*a* for delivery to the user. This process is briefly described above in relation to FIG. 22, where arrows schematically denote the flow of the air stream into the device 12'*a* and through the aerosol carrier 14*a*, and the flow of the air stream with the entrained vapour and/or aerosol through the aerosol carrier cartridge 14*a*.

Note that, as previously mentioned, the atomisation of aerosol precursor by the venturi 36'*a* and/or the vapourisation of atomised aerosol precursor by the heater 24'*a* need not be complete. Therefore, there may be un-atomised or un-vapourised aerosol precursor in the air flow at gap 40'*a* and/or in the duct 42*a*, which may then pass to the second end 18*a*. The mixture of air and vapour which passes to the user may itself be mixed with some un-atomised or un-vapourised aerosol precursor, although some of that aerosol precursor may stick to the sides of the duct 42'*a* and flow back towards the heater 24'*a*. In general, it is desirable that the amount of un-atomised and/or un-vapourised aerosol precursor is small.

Figure 27:
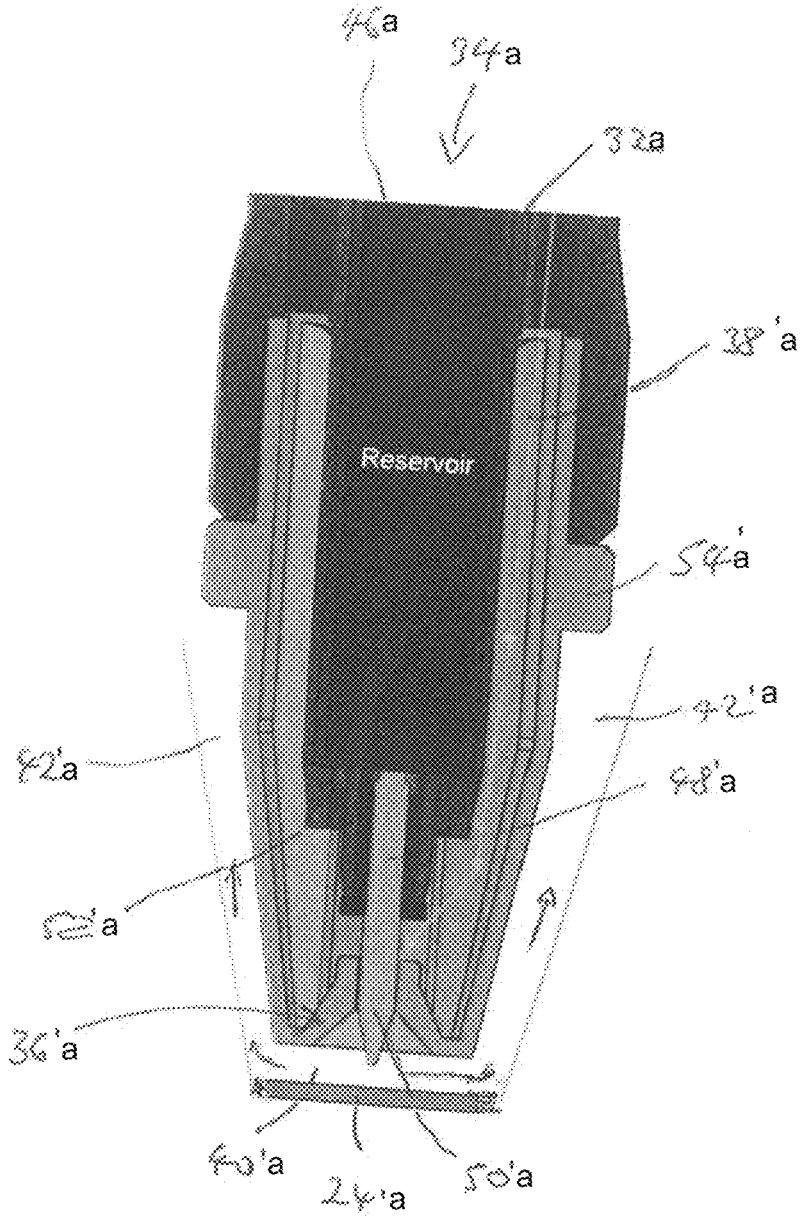
FIG. 27 is a cross-section side view of part of the system and alternative apparatus of FIGS. 22 and 24.

FIG. 27 illustrates in more detail the internal structure of the fluid-transfer article 34*a*, the venturi 36'*a* and the heater 24'*a*. As can be seen, the fluid-transfer article 34*a* comprises a reservoir 46*a* which may, as previously described, be porous material holding the aerosol precursor, or may be a tank for the storage of aerosol precursor as a free liquid. An elongate wick 48'*a* extends from the reservoir 46*a*, with the wick being made of heat resistant material and being arranged to transfer aerosol precursor from the reservoir 46*a*. For example, the wick 48'*a* may be of porous material or fibrous material. The wick 48'*a* extends to the venturi 36'*a*, and terminates at a nib 50'*a* within the venturi 36'*a*. There is a gap between the nib 50'*a* and the walls of the venturi 36'*a*, to allow air which has passed through the duct 38'*a* to pass through the venturi 36'*a*.

In the arrangement illustrated, the nib takes the form of a tapered end region of the wick 48'*a*, which narrows towards a somewhat sharpened tip at the extreme end of the wick. The wick terminates in spaced relation to the heater 24'*a*.

As illustrated in FIG. 27, there is a structure 52'*a* at the end of the reservoir 46*a* which holds the wick 48'*a* in place at the end of the reservoir 46*a*. The structure 52'*a* may form part of the fluid-transfer article 34*a*, and be supported by the housing 32'*a*. The venturi 36'*a* is mounted in another structure 54'*a*, through which the duct 38'*a* passes, and which forms part of the receptacle 22'*a*. The housing 32*a* is separable from the structure 54'*a*, and hence from the carrier 22'*a*, to enable it to be removed and replaced when necessary.

Note that it would also be possible for the wick 48'*a* and the structure 52'*a* to be separable, with the wick 48'*a* held by the structure 54'*a*, so that the wick 48'*a* is not part of the fluid-transfer article 34*a*, provided satisfactory linkage between the reservoir 46*a* and the wick 48'*a* is achieved when the fluid-transfer article 34*a* is in place.

As mentioned above, the user draws air through the structure from the air-intake apertures 20'*a* to the second end 18*a* forming the mouthpiece. As illustrated in FIG. 5B and as shown by arrows in that figure, the air passes through the duct 38'*a* and reaches the wick 48'*a* adjacent the venturi 36'*a*. The passage of air over the wick entrains aerosol precursor from the wick 48' into the air, drawing aerosol precursor from the wick 48'*a*. This forms a mixture of air and aerosol precursor. Such removal of aerosol precursor from the wick causes more aerosol precursor to be drawn from the reservoir, to maintain the wick 48' in a saturated or semi-saturated state.

The air containing aerosol precursor then passes through the venturi 36'*a* at the nib 50'*a* with the venturi atomising at least some of the aerosol precursor in the air as it passes therethrough. This generates a spray of atomised aerosol precursor into gap 40'*a*, with the movement of air causing that spray to impinge on the heater 24'*a*. The heater 24'*a* then heats the atomised aerosol precursor deposited thereon, to vaporise at least some of the atomised aerosol precursor at the activation region formed by the gap 40'*a*.

A mixture of vapour and air, or a mixture of vapour, aerosol, and air then passes through the duct 42'*a*, and ultimately to the second end 18*a* forming the mouthpiece, as was described with reference to FIG. 22. Note that in FIG. 5B, the duct 42'*a* exists on both sides of the structure. In practice, a plurality of ducts 38'*a* and ducts 42'*a* may be provided at different radial positions around the fluid-transfer article 34*a*, via multiple air flow paths to the venturi 36'*a* and to the second end 18*a*.

Note that the nib 50'*a* of the wick extends into the venturi 36'*a* so that the mixture of air and aerosol precursor only needs to travel a short distance from the nib to the heater before the aerosol precursor is atomised.

In the arrangement of FIG. 27, there is no direct contact between the wick 48'*a* and the heater 24'*a*. Instead, the atomised aerosol precursor is heated by being sprayed from the venturi 36'*a* on to the heater. This means that the wick 48'*a* can be made of a material with less heat resistance then would be needed if it was in contact with the heater 24'*a*, so that the wick 48*a* can be made of less expensive material. This also helps to avoid the occurrence of so-called 'dry burn' as the aerosol precursor content of the wick becomes depleted, which can result in degradation of the wick material in conventional e-cigarette arrangements due to its direct contact with a heater, and the creation of an unpleasant burnt taste to the user.

The separability of the housing 32*a* from the rest of the device enables the aerosol precursor in the reservoir 46*a* to be replaced as it is consumed during use of the device. This may be done by re-filling the reservoir 46*a* or replacing the fluid-transfer article 34*a* with another such article having a filled reservoir 46*a*. As mentioned above, the wick 48'*a* may be separated with the fluid-transfer article 34*a*, or may remain with the venturi 36'*a* and the heater 24'*a*, provided a suitable junction could be achieved when the apparatus is in use. The venturi 36'*a* and the heater 24*a* and also possibly the wick 48'*a*, thus remain with the device even when the reservoir is removed and the fluid-transfer article replaced, optimising the cost of the fluid-transfer article 34*a*.

Figure 28:
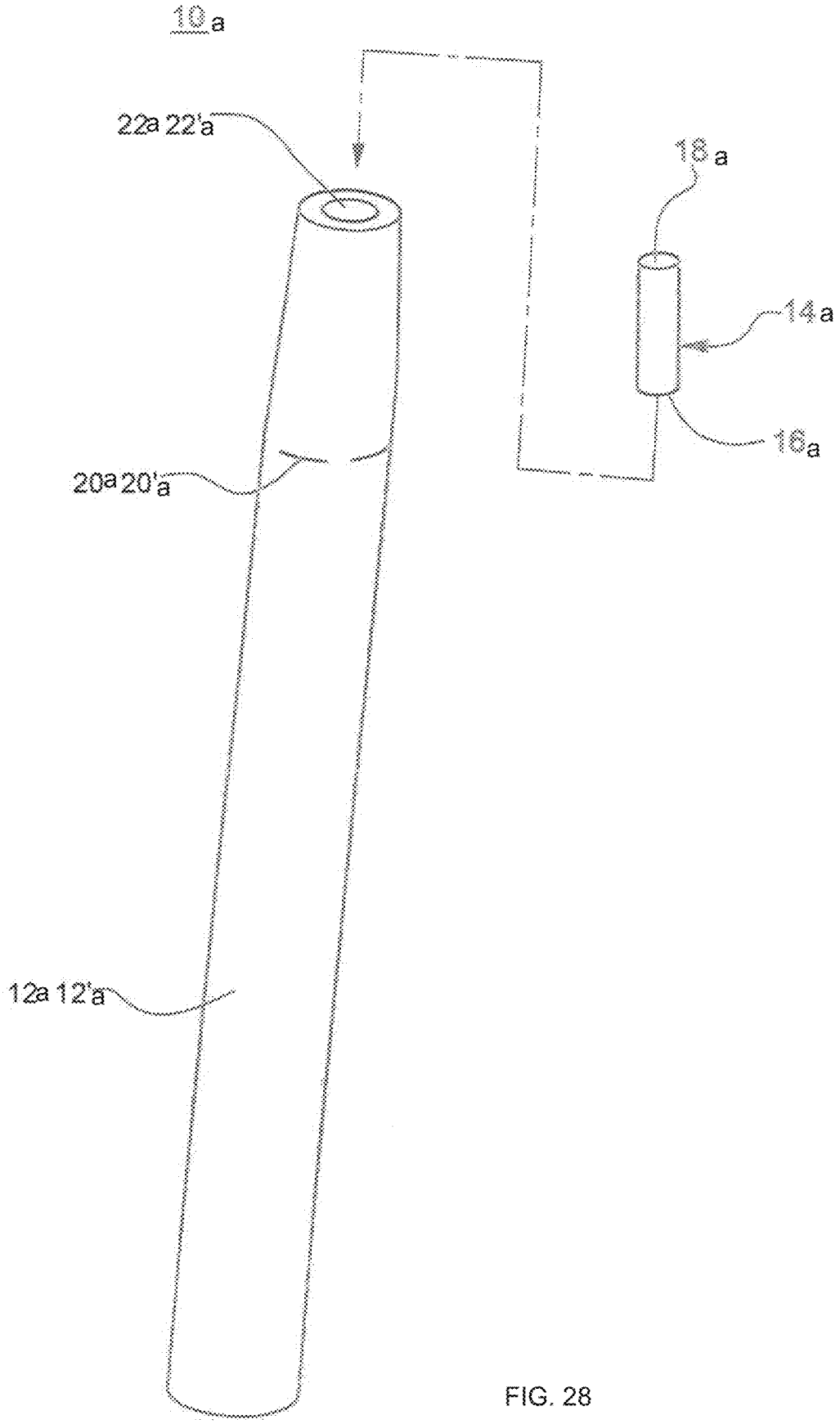
FIG. 28 is an exploded perspective view illustration of a kit-of-parts for assembling the system according to one or more embodiments of the second mode of the present disclosure.

FIG. 28 is an exploded perspective view illustration of a kit-of-parts for assembling an aerosol delivery system 10*a*.

As will be appreciated, in the arrangements described above, the fluid-transfer article 34*a* is provided within a housing 32*a* of the aerosol carrier 14*a*. In such arrangements, the housing of the carrier 14*a* serves to protect the aerosol precursor-containing fluid-transfer article 34*a*, whilst also allowing the carrier 14*a* to be handled by a user without his/her fingers coming into contact with the aerosol precursor liquid retained therein.

Third Mode of the Disclosure

In general outline, one or more embodiments in accordance with the present disclosure may provide a system for aerosol delivery in which an aerosol carrier may be inserted into a receptacle (e.g. a "heating chamber") of an apparatus for initiating and maintaining release of an aerosol from the aerosol carrier. Another end, or another end portion, of the aerosol carrier may protrude from the apparatus and can be inserted into the mouth of a user for the inhalation of aerosol released from the aerosol carrier cartridge during operation of the apparatus.

Hereinafter, and for convenience only, "system for aerosol delivery" shall be referred to as "aerosol delivery system".

Figure 29:
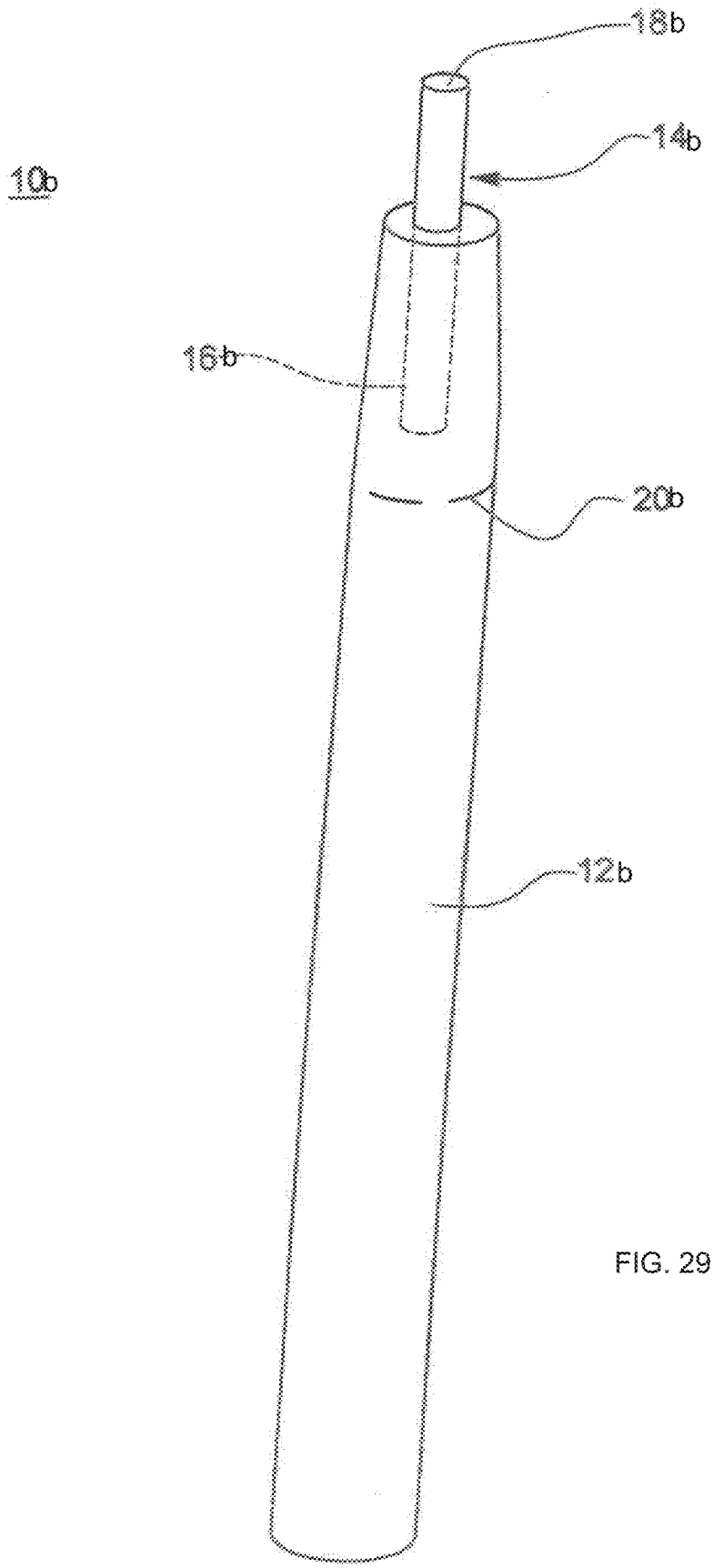
FIG. 29 is a perspective view illustration of a system for aerosol delivery according to one or more embodiments of the third mode of the present disclosure.

Referring now to FIG. 29, there is illustrated a perspective view of an aerosol delivery system 10*b* comprising an aerosol generation apparatus 12*b* operative to initiate and maintain release of aerosol from a fluid-transfer article in an aerosol carrier 14*b*. In the arrangement of FIG. 29, the aerosol carrier 14*b* is shown with a first end 16*b* thereof and a portion of the length of the aerosol carrier 14*b* located within a receptacle of the apparatus 12*b*. A remaining portion of the aerosol carrier 14*b* extends out of the receptacle. This remaining portion of the aerosol carrier 14*b*, terminating at a second end 18*b* of the aerosol carrier, is configured for insertion into a user's mouth. A vapour and/or aerosol is produced when a heater (not shown in FIG. 29) of the apparatus 12*b* heats a fluid-transfer article in the aerosol carrier 14*b* to release a vapour and/or an aerosol, and this can be delivered to the user, when the user sucks or inhales, via a fluid passage in communication with an outlet of the aerosol carrier 14*b* from the fluid-transfer article to the second end 18*b*.

The device 12*b* also comprises air-intake apertures 20*b* in the housing of the apparatus 12*b* to provide a passage for air to be drawn into the interior of the apparatus 12*b* (when the user sucks or inhales) for delivery to the first end 16*b* of the aerosol carrier 14*b*, so that the air can be drawn across an activation surface of a fluid-transfer article located within a housing of the aerosol carrier cartridge 14*b* during use. Optionally, these apertures may be perforations in the housing of the apparatus 12*b*.

A fluid-transfer article (not shown in FIG. 29, but described hereinafter with reference to FIGS. 33 to 36 is located within a housing of the aerosol carrier 14*b*. The fluid-transfer article contains an aerosol precursor material, which may include at least one of: nicotine; a nicotine precursor material; a nicotine compound; and one or more flavourings. The fluid-transfer article is located within the housing of the aerosol carrier 14*b* to allow air drawn into the aerosol carrier 14*b* at, or proximal, the first end 16*b* to flow at an activation region of the fluid-transfer article. As air passes the activation region of the fluid-transfer article, an aerosol may be entrained in the air stream from a substrate forming the fluid-transfer article, e.g. via diffusion from the fluid-transfer article to the air stream and/or via vaporisation of the aerosol precursor material and release from the fluid-transfer article under heating.

In some embodiments, the fluid-transfer article 34*b* may comprise a first region of a porous material where pores of the porous material hold, contain, carry, or bear the aerosol precursor material, and a second region formed of a multiplicity of plates. In particular, the porous material of the fluid-transfer article is a porous polymer material such as, for example, a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET). All such materials may be described as heat resistant polymeric wicking material in the context of the present disclosure.

The aerosol carrier 14*b* is removable from the apparatus 12*b* so that it may be disposed of when expired. After removal of a used aerosol carrier 14*b*, a replacement aerosol carrier 14*b* can be inserted into the apparatus 12*b* to replace the used aerosol carrier 14*b*.

Figure 30:
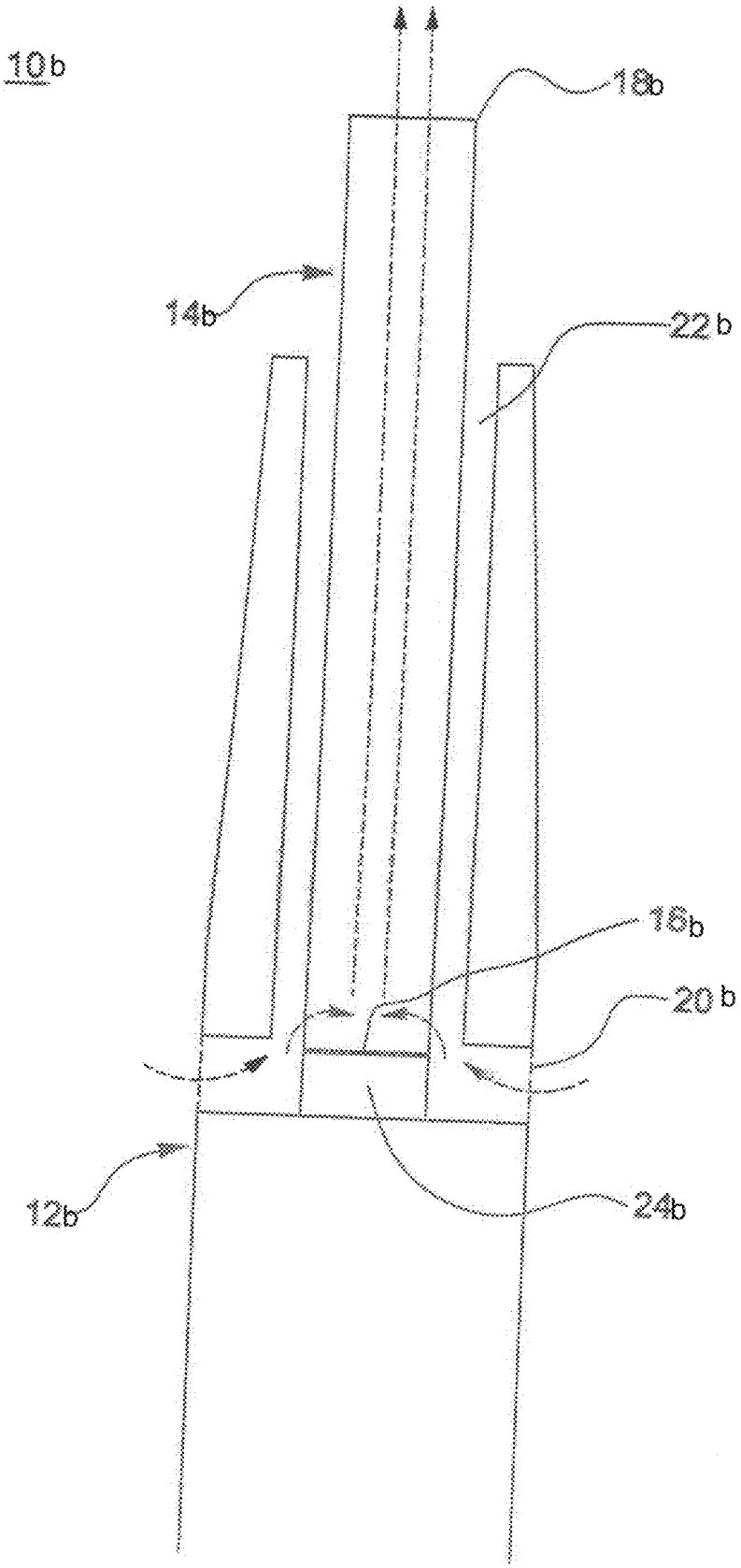
FIG. 30 is a cross-section side view illustration of part of an apparatus of the system for aerosol delivery of FIG. 29.

FIG. 30 is a cross-sectional side view illustration of a part of apparatus 12*b* of the aerosol delivery system 10. The apparatus 12*b* comprises a receptacle 22*b* in which is located a portion of the aerosol carrier 14*b*. In one or more optional arrangements, the receptacle 22*b* may enclose the aerosol carrier 14*b*. The apparatus 12 also comprise a heater 24*b*, which opposes an activation region of the fluid-transfer article (not shown in FIG. 30) of the aerosol carrier 14*b* when an aerosol carrier 14*b* is located within the receptacle 22*b*.

Air flows into the apparatus 12*b* (in particular, into a closed end of the receptacle 22*b*) via air-intake apertures 20*b*. From the closed end of the receptacle 22*b*, the air is drawn into the aerosol carrier 14*b* (under the action of the user inhaling or sucking on the second end 18*b*) and expelled at the second end 18*b*. As the air flows into the aerosol carrier 14*b*, it passes across an end of the fluid-transfer article. Heat from the heater 24*b*, which opposes that end of the fluid-transfer article, causes vaporisation of aerosol precursor material at the end of the fluid-transfer article and an aerosol is created in the air flow. Thus, through the application of heat in the region of the end of the fluid-transfer article (the activation region), an aerosol is released, or liberated, from the fluid-transfer article, and is drawn from the material of the aerosol carrier unit by the air flow and is transported in the air flow to via outlet conduits (not shown in FIG. 30) in the housing of the aerosol carrier 14*b* to the second end 18*b*. The direction of air flow is illustrated by arrows in FIG. 30. To achieve release of the captive aerosol from the fluid-transfer article, the fluid-transfer article of the aerosol carrier 14*b* is heated by the heater 24*b*. As a user sucks or inhales on second end 18*b* of the aerosol carrier 14*b*, the aerosol released from the fluid-transfer article and entrained in the air is drawn through the outlet conduits (not shown) in the housing of the aerosol carrier 14*b* towards the second end 18*b* and onwards into the user's mouth.

Figure 31:
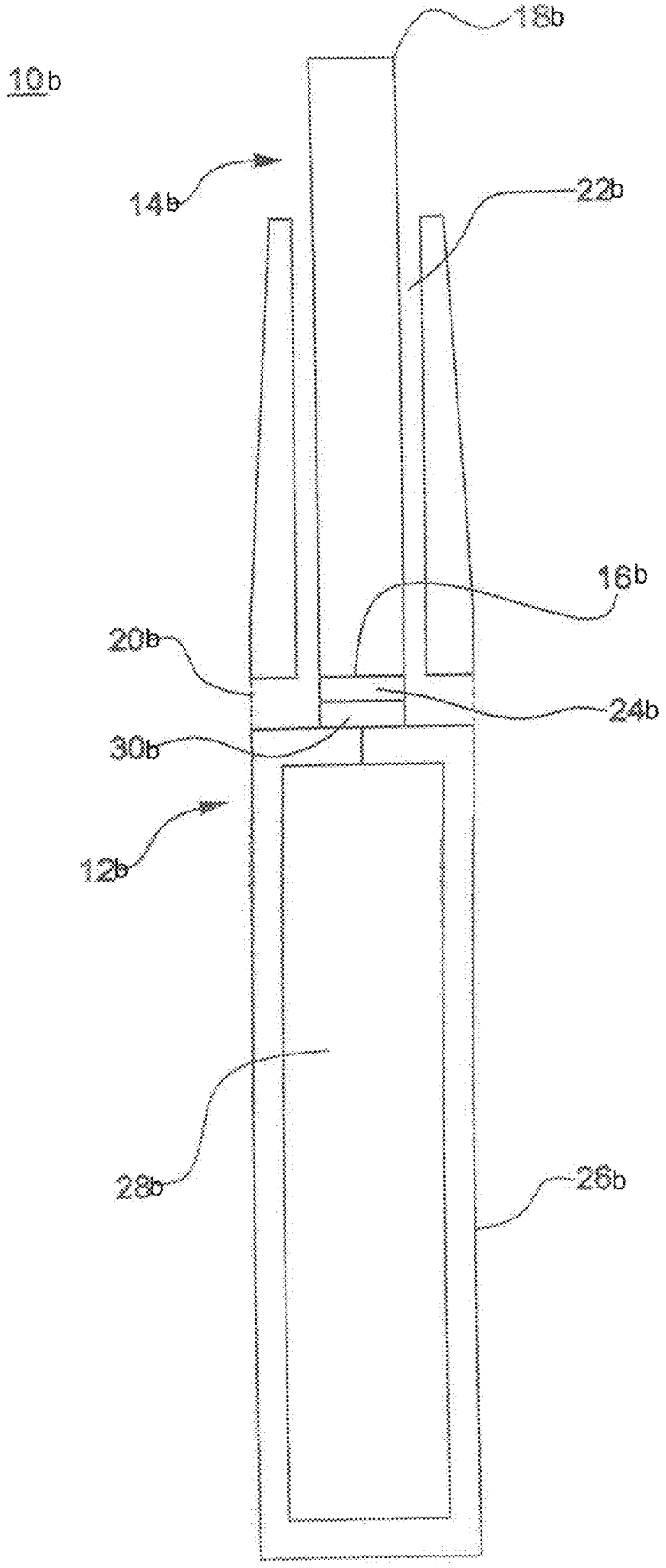
FIG. 31 is a cross-section side view illustration of the system and apparatus for aerosol delivery of FIG. 29.

Turning now to FIG. 31, a cross-sectional side view of the aerosol delivery system 10*b* is schematically illustrated showing the features described above in relation to FIGS. 29 and 30 in more detail. As can be seen, apparatus 12*b* comprises a housing 26*b*, in which are located the receptacle 22*b* and heater 24*b*. The housing 26*b* also contains control circuitry (not shown) operative by a user, or upon detection of air and/or vapour being drawn into the device 12*b* through air-intake apertures 20*b*, i.e. when the user sucks or inhales. Additionally, the housing 26*b* comprises an electrical energy supply 28*b*, for example a battery. Optionally, the battery comprises a rechargeable lithium ion battery. The housing 26*b* also comprises a coupling 30*b* for electrically (and optionally mechanically) coupling the electrical energy supply 28*b* to control circuitry (not shown) for powering and controlling operation of the heater 24*b*.

Figure 32:
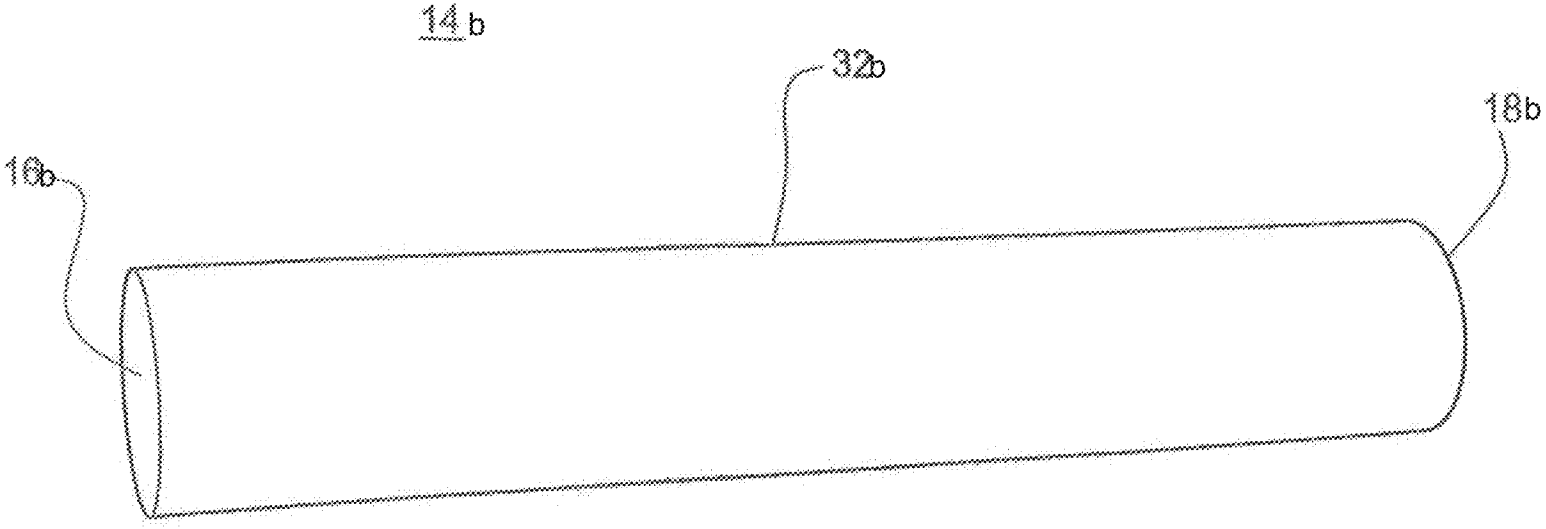
FIG. 32 is a perspective view illustration of an aerosol carrier for use in the system for aerosol delivery according to one or more embodiments of the third mode of the present disclosure.
Figure 33:
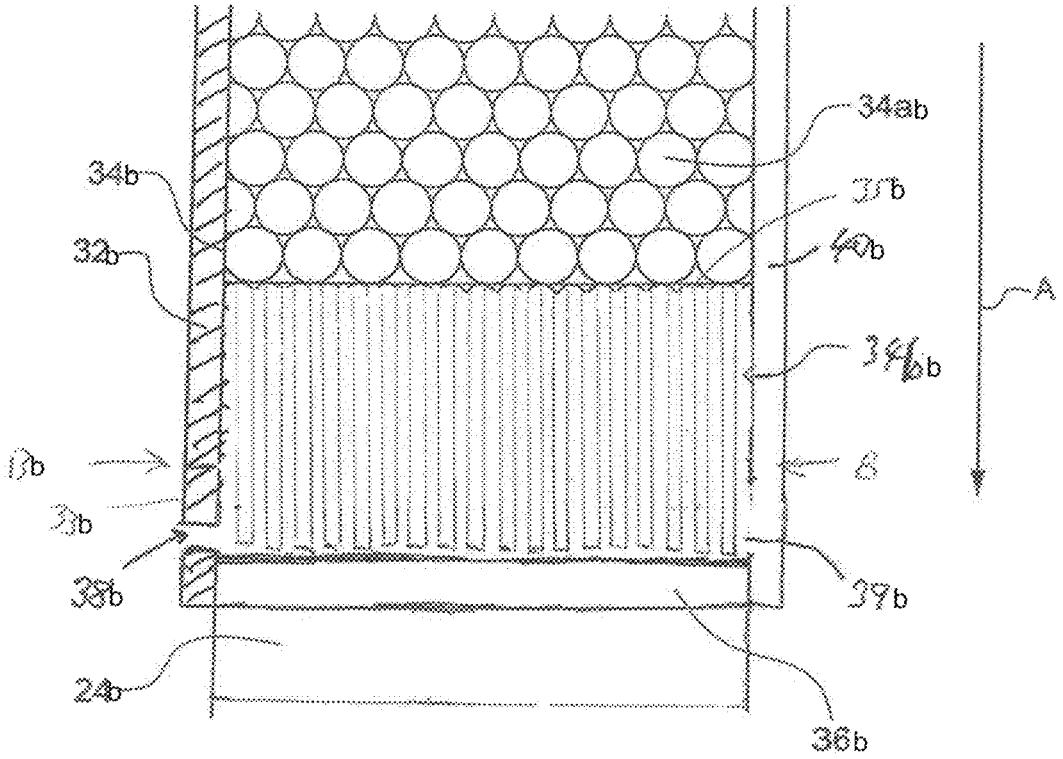
FIG. 33 is a cross-section side view of elements of an aerosol carrier and a part of an apparatus of the system for aerosol delivery according to one or more embodiments of the third mode of the present disclosure.
Figure 34:
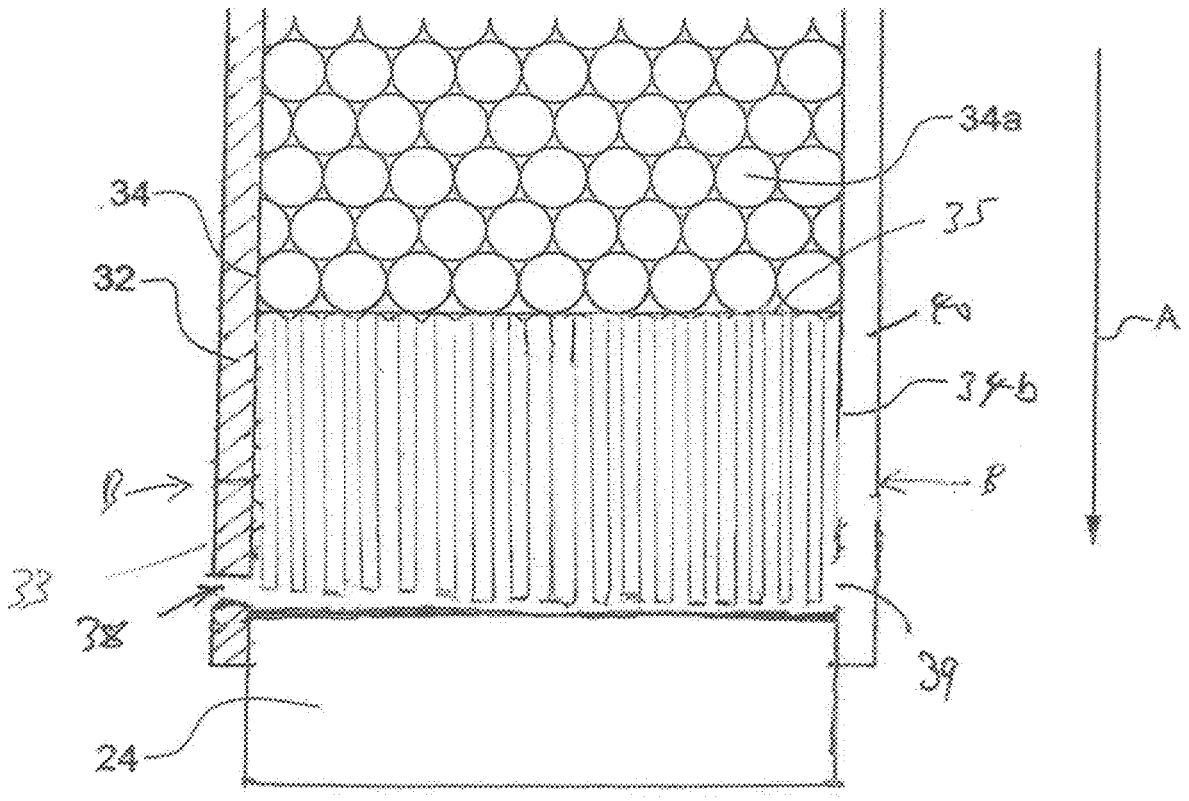
FIG. 34 is a cross-section side view of elements of an aerosol carrier and a part of an apparatus of the system for aerosol delivery according to one or more embodiments of the third mode of the present disclosure, in an alternative configuration from that of FIG. 33.

Responsive to activation of the control circuitry of apparatus 12*b*, the heater 24*b* heats the fluid-transfer article (not shown in FIG. 31) of aerosol carrier 14*b*. This heating process initiates (and, through continued operation, maintains) release of vapour and/or an aerosol from the end of the fluid-transfer article adjacent the heater. The vapour and/or aerosol formed as a result of the heating process is entrained into a stream of air being drawn across or adjacent the heating surface of the heater (as the user sucks or inhales). The stream of air with the entrained vapour and/or aerosol passes through the aerosol carrier 14*b* via outlet conduits (not shown) and exits the aerosol carrier 14*b* at second end 18*b* for delivery to the user. This process is briefly described above in relation to FIG. 30, where arrows schematically denote the flow of the air stream into the device 12*b* and through the aerosol carrier 14*b*, and the flow of the air stream with the entrained vapour and/or aerosol through the aerosol carrier cartridge 14*b*. FIGS. 32 to 34 schematically illustrate the aerosol carrier 14*b* in more detail (and, in FIGS. 33 and 34, features within the receptacle in more detail). FIG. 32 illustrates an exterior of the aerosol carrier 14*b*, FIG. 33 illustrates internal components of the aerosol carrier 14*b* in one optional configuration, and FIG. 34 illustrates internal components of the aerosol carrier 14*b* in another optional configuration. FIG. 32 illustrates the exterior of the aerosol carrier 14*b*, which comprises a housing 32*b* for housing said fluid-transfer article (not shown). The particular housing 32*b* illustrated in FIG. 4 comprises a tubular member, which may be generally cylindrical in form, and which is configured to be received within the receptacle of the apparatus. First end 16*b* of the aerosol carrier 14*b* is for location to oppose the heater of the apparatus, and second end 18*b* (and the region adjacent the second end 18*b*) is configured for insertion into a user's mouth.

FIG. 33 illustrates some internal components of the aerosol carrier 14*b* and of the heater 24*b* of apparatus 12*b*, in in one embodiment of the disclosure.

As described above, the aerosol carrier 14*b* comprises a fluid-transfer article 34*b*. Optionally, there may be a conduction element 36*b* (as shown in FIG. 33), being part of the heater 24*b*. In one or more arrangements, the aerosol carrier 14*b* is located within the receptacle of the apparatus such that an end of the fluid-transfer article opposes and is adjacent the heater 24*b* of the apparatus and receives heat directly from the heater 24*b* of the apparatus. When aerosol carrier 14*b* is located within the receptacle of the apparatus such that the adjacent end of the fluid-transfer article is located to oppose the heater of the apparatus, the conduction element 36*b* is disposed between the rest of the heater 24*b* and the end of the fluid-transfer article. Heat may be transferred to the end of the fluid-transfer article via conduction through conduction element 36*b* (i.e. application of heat to the activation surface is indirect).

Further components not shown in FIG. 33 comprise: an inlet conduit, via which air can be drawn into the aerosol carrier 14*b*; an outlet conduit, via which an air stream entrained with aerosol can be drawn from the aerosol carrier 14*b*; a filter element; and a reservoir for storing aerosol precursor material and for providing the aerosol precursor material to the fluid-transfer article 34*b*.

In FIG. 33, the aerosol carrier is shown as comprising the fluid-transfer article 34*b* located within housing 32. The fluid transfer article 34*b* comprises a first region 34*a* holding an aerosol precursor. In one or more arrangements, the first region of 34*a* of the fluid transfer article 34*b* comprises a reservoir for holding the aerosol precursor. The first region 34*a* can be the sole reservoir of the aerosol carrier 14*b*, or it can be arranged in fluid communication with a separate reservoir, where aerosol precursor is stored for supply to the first region 34*a*. In the particular arrangement illustrated, the material forming the first region of 34*a* comprises a porous structure, whose pore diameter size may vary between one end of the first region 34*a* and another end of the first region 34*a*. For example, the pore diameter size may decrease from a first end remote from heater 24*b* (the upper end is as shown in the figure) to a second end. This configuration of pores having a decreasing diameter size can provide a wicking effect, which can serve to draw fluid through the first region 34*a*, towards heater 24*b*. As mentioned above, the porous polymer material may be a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET).

Alternatively, the first region 34*a* may be a simple liquid reservoir in the form of an empty tank for the receipt and storage of liquid aerosol precursor, rather than porous material for holding the aerosol precursor. The fluid transfer article 34*b* also comprises a second region 34*b*. In arrangements in which the first region 34*a* is formed from material having a porous structure, aerosol precursor is drawn from the first region of 34*a* to the second region 34*b* by the wicking effect of the material forming the first region of 34*a*. Thus, the first region 34*a* is configured to transfer the aerosol precursor to the second region 34*b* of the article 34*b*.

The second region 34*b* is formed of a multiplicity of plates. The plates may be arranged in a generally parallel manner, with small spaces therebetween. The plates extend from an end of the first region 34*a*, which end will be referred to as a transfer surface 35*b*, towards the heater 24*b*. In FIG. 5, where the optional conduction element 36*b* is present, the plates forming the second region 34*b* may extend to that conduction element 36*b*, but it is preferable that they terminate just short of the conduction element 36*b* as shown in FIG. 33.

Note that the thickness of the plates and the spacing therebetween is exaggerated in FIG. 33 for the sake of clarity. Normally, the spacing between the plates will be very small, as will any gap between the edges of the plates close to the conduction element 36*b*, and that conduction element 36*b* itself. The spacing between the plates needs to be sufficiently small to provide a capillary effect in the gaps between the plates.

Aerosol precursor at the transfer surface 35*b* will pass into the spaces between the plates of the second region 34*b*, and be drawn along the plates by capillary action. Aerosol precursor will thus pass to end of the second region 34*b* proximate to the conduction element 36*b*, with the end parts of the plates acting as an activation region for the aerosol precursor. When the heater 24*b* is active, heat will be transferred via that conduction element 36*b* to the aerosol precursor at the adjacent end of the second region 34*b* which forms the activation region (i.e. at the ends of the fibres furthest from the transfer surface 35*b*) cause that aerosol precursor to vaporise.

FIG. 33 also illustrates an opening 38*b* in a further housing 33*b*, which opening 38*b* is in communication with the air-intake apertures 20*b*. A further opening 39*b* communicates with a duct 40*b* within the housing 32*b*, which duct 40*b* communicates with the second end 18*b*.

The further housing 33*b* supports the heater 24*b* (and optional conduction element 36*b* if present). The housing 32*b* and the further housing 33*b* are separable, e.g. along the line B-B in FIG. 33, to allow the housing 32*b*, and hence the fluid-transfer article 34*b*, to be removed from the rest of the apparatus. Since the aerosol precursor in the fluid-transfer article will be consumed as the user uses the apparatus, it will be necessary periodically to replace it. This can be done by removing the housing 32*b* from the rest of the apparatus, and refilling the aerosol precursor, or replacing the housing 32*b* with another in which the fluid-transfer article is full of aerosol precursor. The further housing 33*b* may be integral with the housing 26*b* containing the electrical energy supply 28*b*. There is thus a fluid-flow path for air (hereinafter referred to as an air-flow pathway) between openings 38*b* and 39, linking the apertures 20*b* and the second end 18*b* of the aerosol carrier. When the user sucks or inhales, air is drawn along the air-flow pathway, along the surface of the conduction element 36*b*, and adjacent the ends of the plates forming the second region 34*b* (and between the ends of the plates and the conducting element 36*b* if the plates terminate just short of the conduction element 36*b*).

Aerosol precursor which has reached the ends of the plates of the second region 34*b* and has been heated and transferred by the conduction element 36*b* will pass into the air flowing in the air-flow pathway between the openings 38*b* and 39. The vapour or mixture passes, as the user sucks and inhales, to the second end 18*b*. This has the effect of removing aerosol precursor from the ends of the plates proximate the conduction element 36*b*. This will have the effect of drawing further aerosol precursor down the plates from the first region 34*a* of the transfer article. There may also be a low-pressure effect due to the movement of the air along the air-flow pathway, which draws fluid along the plates to the conduction element 36*b*. There may be a small gap between the ends of the plates forming the second region of 34*b* and the conduction element 36*b*, with the air flow is through that space. That gap needs to be small to ensure maximum heat transfer to the aerosol precursor. The air-flow pathway will pass around the ends of the plates, in the small spaces between the plates, and between the ends of the plates and the conduction element 36*b* to enable vapour and/or aerosol and vapour mixture to enter the air flow. The spacing between each of the plates is desirably chosen so as to facilitate that air flow, but also to create a capillary effect which will transfer aerosol precursor from the transfer surface 35*b*.

As noted above, the conduction element 36*b* may be absent in some arrangements.

The conduction element 36*b*, if present, may comprise a thin film of thermally conductive material, such as, for example, a metal foil (for example, aluminium, brass, copper, gold, steel, silver, or an alloy comprising anyone of the foregoing together with thermally conductive plastics and/or ceramics).

In the illustrative examples of FIG. 33, the first region 34*a* of the fluid-transfer article 34*b* is located at an "upstream" end of the fluid-transfer article 34*b* and the second region 34*b* is located at a downstream" end of the fluid-transfer article 34*b*. That is, aerosol precursor is wicked, or is drawn, from the "upstream" end of the fluid-transfer article 34*b* to the "downstream" end of the fluid-transfer article 34*b* (as denoted by arrow A in FIG. 33).

As mentioned above, the conduction element 36*b* need not be present. FIG. 34 illustrates an embodiment corresponding to that of FIG. 33, but without such a conduction element 36*b*. The arrangement of FIG. 34 is otherwise similar to that of FIG. 33, and corresponding parts are indicated by the same reference numerals.

Figure 35:
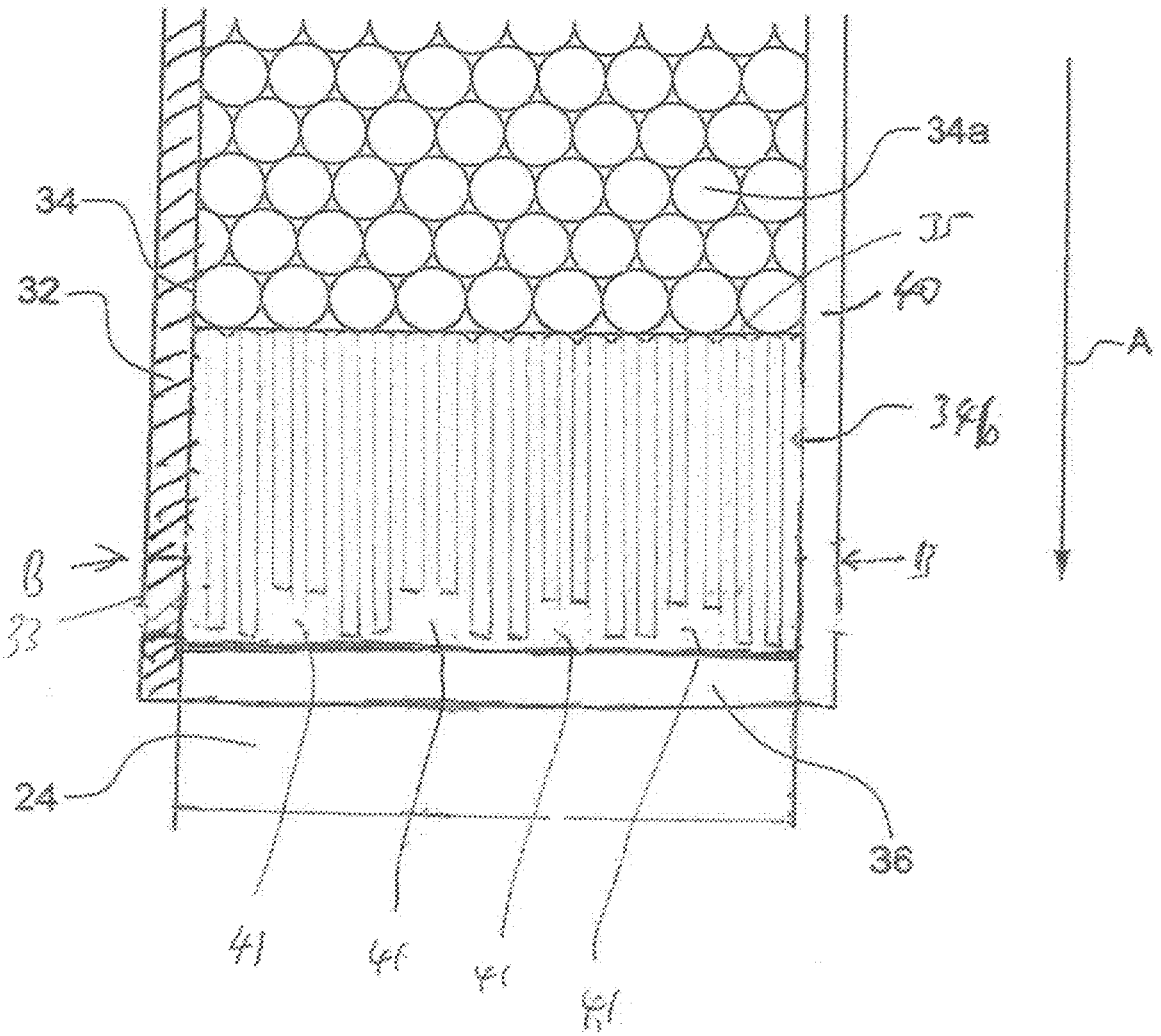
FIG. 35 is a cross-section side view of elements of an aerosol carrier and a part of an apparatus of the system for aerosol delivery according to one or more embodiments of the present disclosure, in yet another alternative configuration from that of FIG. 33.

In the arrangements of FIGS. 33 and 34, the plates of the second region 34*b* extend the same distance from the transfer surface 35*b*, so that each has an edge close to, or at the heating surface of the heater 24*b*. FIG. 35 illustrates an alternative arrangement, where some of the plates extend to, or very close to, the heating surface of the heater 24*b* (formed by the conduction element 36*b* in FIG. 35), but others extend a shorter distance so their edges remote from the transfer surface 35*b* have a significant clearance from the heating surface of the heater 24*b*. This has the effect of forming channels 41*b* between those plates and the heating surface, which channels 41*b* extend along the heating surface, due to the clearance provided by the gaps between the ends of the plates and the heating surface 36*b*, with those gaps forming the channels 41*b*. In such an arrangement, it is then possible for the plates not at the gaps 41*b* to extend all the way to the heating surface (the conductive element 36*b* in FIG. 35) and yet still have satisfactory air flow along the heating surface. Note that, in FIG. 35, the openings 38*b* and 39 are not visible because they are at the ends of the channels 41*b*. Such an arrangement has the advantage that it is easier to control the air flow through the apparatus.

In FIG. 35 the channels 41*b* have a generally square shape, because the plates are of two different lengths. Other arrangements are possible, by varying the lengths of the plates in the direction away from the transfer surface 35*b*, to form e.g. curved or stepped channels.

Figure 36:
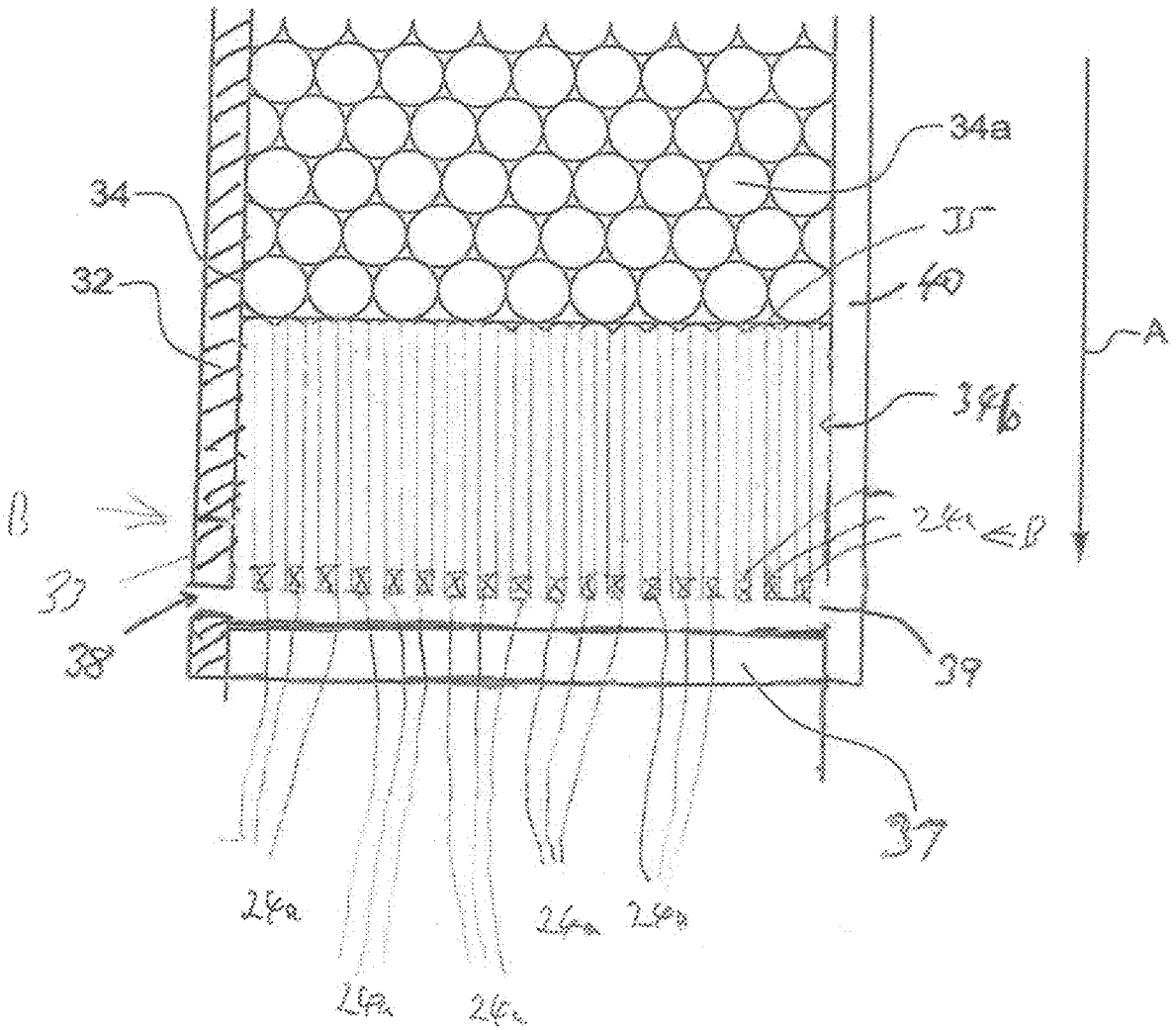
FIG. 36 is a cross-section side view of elements of an aerosol carrier and a part of an apparatus of the system for aerosol delivery according to one or more embodiments of the present disclosure, another alternative from that of FIG. 33.

In all of the arrangements of FIGS. 33 to 35, the heater 24*b* is formed as a single unit with a heating surface adjacent the ends of all of the plates. FIG. 36 illustrates a further alternative, in which the heater is formed by heating elements 24*a* extending along the edge of the plates which are remote from the transfer surface 35*b*. In FIG. 36, heating elements 24*a* are provided on the edge of each of the plates forming the second region 34*b*. It is also possible for the heating elements 24*a* to be provided only on some of the plates. The heating elements 24*a* heat the ends of the plates forming the second region 34*b*, and hence any aerosol precursor which has been drawn along the plates by capillary action from the transfer surface 35*b*. Thus, the heating effect of the heating elements 24*a* will cause the aerosol precursor at the edges of the plates remote from the transfer surface 35*b* to be vapourised and so pass in to the air in the air-flow pathway between openings 38*b* and 39. That air-flow pathway may be bounded by a plate 37 forming part of the further housing 33*b*.

Figure 37:
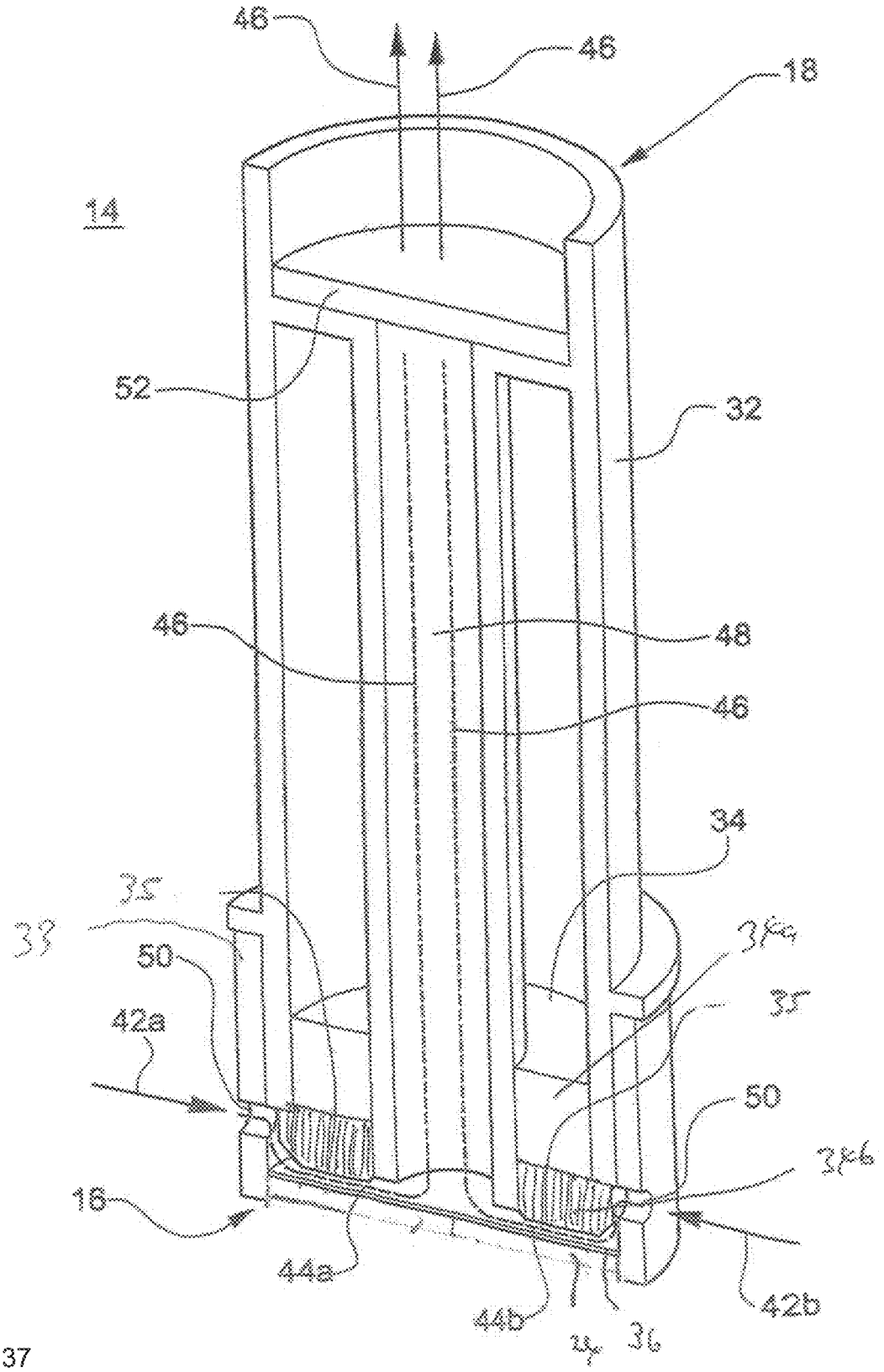
FIG. 37 is a cross-section side view of aerosol carrier according to one or more embodiments of the third mode of the present disclosure.
Figure 38:
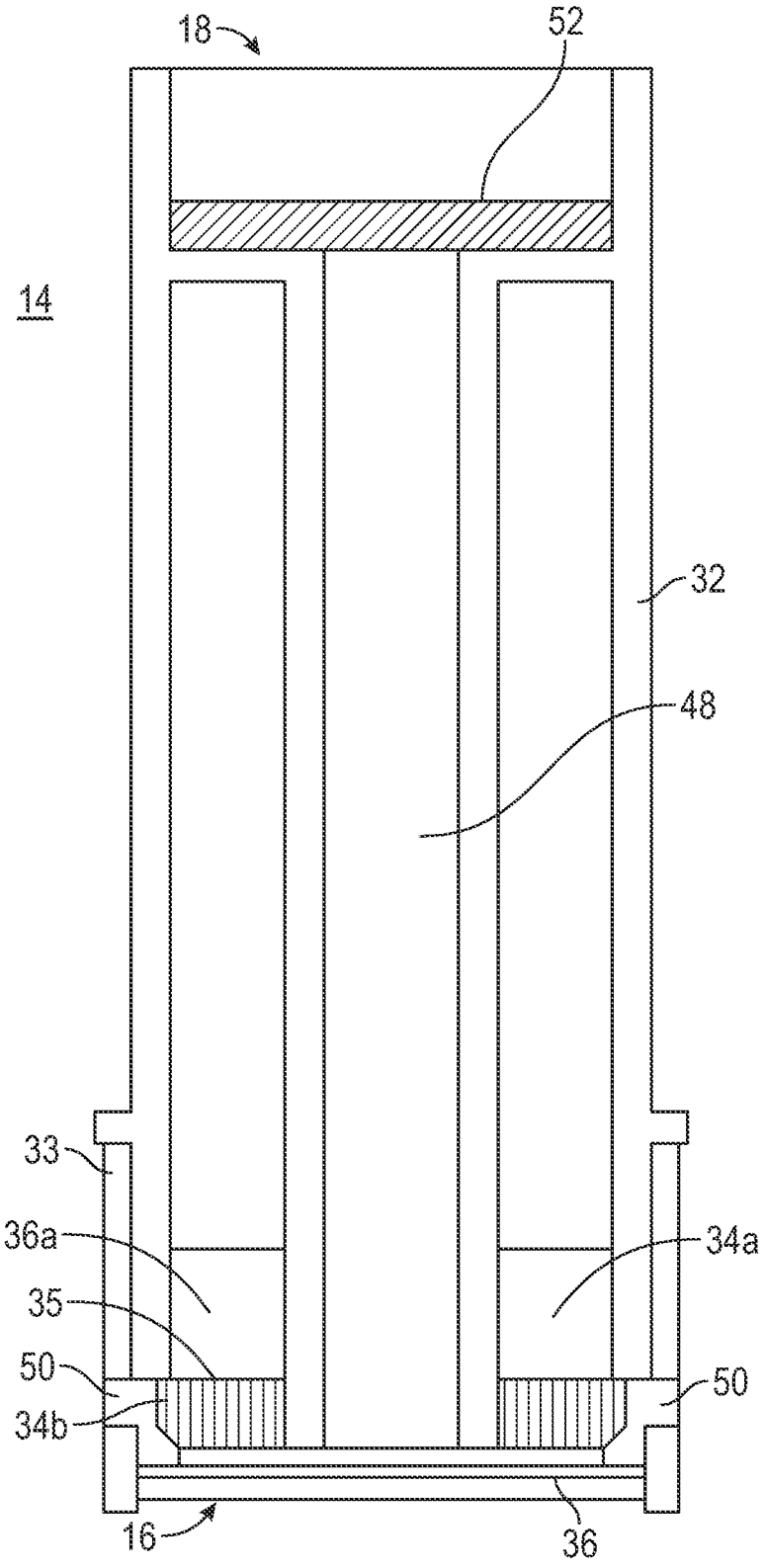
FIG. 38 is a perspective cross-section side view of the aerosol carrier of FIG. 35.

In the arrangements shown in FIGS. 33 to 36, the apertures 38*b*, 39 are on opposite sides of the housing 32. FIGS. 9 and 10 shows an alternative configuration, in which the fluid-transfer article is annular, and the second region 34*b* is then in the form of annular diaphragm. Note that, in FIGS. 9 and 10, the ends of the plates forming the second region 34*b* are illustrated terminating just short of the conduction element 36*b*. This is a possible arrangement, but it is also possible that the fibres extend to the conduction surface 36*b*, as in the arrangements of FIGS. 33 and 34. The small space between the ends of the plates and the conduction surface 36*b* in FIGS. 37 and 38 is shown to enable the air flow in the apparatus to be illustrated. It is also possible for the arrangement of the plates forming the second part 34*b* to be similar to the arrangement of FIG. 35, in which there are channels in the second part 34*b*, or the arrangement of FIG. 36 in which the heating elements are on the edge of some or all of the plates, that edge being remote form the transfer surface 35*b*. Note that the illustration of the plates of the second part 34*b* is schematic in FIGS. 37 and 38, as the size of the Figures prevents detailed illustration of the plates. The plates may be annular so that the second region 34*b* of the fluid-transfer article has a series of concentric plates, on the plates may extend radially. Thus, FIGS. 37 and 38 illustrate an aerosol carrier 14*b* according to one or more possible arrangements in more detail.

FIG. 37 is a cross-section side view illustration of the aerosol carrier 14*b* and FIG. 38 is a perspective cross-section side view illustration of the aerosol carrier 14*b*. As can be seen from FIGS. 37 and 38, the aerosol carrier 14*b* is generally tubular in form. The aerosol carrier 14*b* comprises housing 32*b*, which defines the external walls of the aerosol carrier 14*b* and which defines therein a chamber in which are disposed the fluid-transfer article 34*b* (adjacent the first end 16*b* of the aerosol carrier 14*b*) and internal walls defining the fluid communication pathway 48*b*. Fluid communication pathway 48*b* defines a fluid pathway for an outgoing air stream from the channels 40*b* to the second end 18*b* of the aerosol carrier 14*b*. In the examples illustrated in FIGS. 37 and 38, the fluid-transfer article 34*b* is an annular shaped element located around the fluid communication pathway 48*b*. As in the arrangements of FIGS. 33 and 34, the heater 24*b* (and optional conduction element 36*b* if present) are mounted in a further housing 33*b*, which further housing 33*b* is separable from the housing 32*b* containing the fluid-transfer article.

In walls of the further housing 33*b*, there are provided inlet apertures 50*b* to provide a fluid communication pathway for an incoming air stream to reach the fluid-transfer article 34*b*, and particularly the air-flow pathway defined across the surface of the conduction element 36*b* (or across the surface of the heater 24*b*), and passing among the ends of the plates forming the second region 34*b* of the aerosol-transfer article 34*b*, or between the ends of those plates and the conduction element 36*b*. In the illustrated example of FIGS. 37 and 38, the aerosol carrier 14*b* further comprises a filter element 52*b*. The filter element 52*b* is located across the fluid communication pathway 48*b* such that an outgoing air stream passing through the fluid communication pathway 48*b* passes through the filter element 52*b*.

With reference to FIG. 38, when a user sucks on a mouthpiece of the apparatus (or on the second end 18 of the aerosol carrier 14*b*, if configured as a mouthpiece), air is drawn into the carrier through inlet apertures 50*b* extending through walls in the housing 32*b* of the aerosol carrier 14*b*.

An incoming air stream 42*a* from a first side of the aerosol carrier 14*b* is directed to a first side of the second part 34*b* of the fluid-transfer article 34*b* (e.g. via a gas communication pathway within the housing of the carrier). An incoming air stream 42*b* from a second side of the aerosol carrier 14*b* is directed to a second side of the second part 34*b* of the fluid-transfer article 34*b* (e.g. via a gas communication pathway within the housing of the carrier). When the incoming air stream 42*a* from the first side of the aerosol carrier 14*b* reaches the first side of the second part 34*b*, the incoming air stream 42*a* from the first side of the aerosol carrier 14*b* flows adjacent the ends of the plates of the second part 34*b* across the conduction element 36*b* (or across the heater 24*b*). Likewise, when the incoming air stream 42*b* from the second side of the aerosol carrier 14*b* reaches the second side of the second part 34*b*, the incoming air stream 42*b* from the second side of the aerosol carrier 14*b* flows around the ends of the plates of the second part 34*b* across the conduction element 36*b* (or across heater 24*b*). The air streams from each side are denoted by dashed lines 44*a* and 44*b* in FIG. 36. As these air streams 44*a* and 44*b* flow, aerosol precursor at the ends of the plates or on the conduction element 36*b* (or on the heater 24*b*) is entrained in air streams 44*a* and 44*b*.

In use, the heater 24*b* of the apparatus 12*b* to raise a temperature of the conduction element 36*b* to a sufficient temperature to release, or liberate, captive substances (i.e. the aerosol precursor) to form a vapour and/or aerosol, which is drawn downstream. As the air streams 44*a* and 44*b* continue their passages, more released aerosol precursor is entrained within the air streams 44*a* and 44*b*. When the air streams 44*a* and 44*b* entrained with aerosol precursor meet at a mouth of the outlet fluid communication pathway 48*b*, they enter the outlet fluid communication pathway 48*b* and continue until they pass through filter element 52*b* and exit outlet fluid communication pathway 48*b*, either as a single outgoing air stream, or as separate outgoing air streams 46*b* (as shown). The outgoing air streams 46*b* are directed to an outlet, from where it can be inhaled by the user directly (if the second end 18*b* of the aerosol capsule 14*b* is configured as a mouthpiece), or via a mouthpiece. The outgoing air streams 46*b* entrained with aerosol precursor are directed to the outlet (e.g. via a gas communication pathway within the housing of the carrier).

Figure 39:
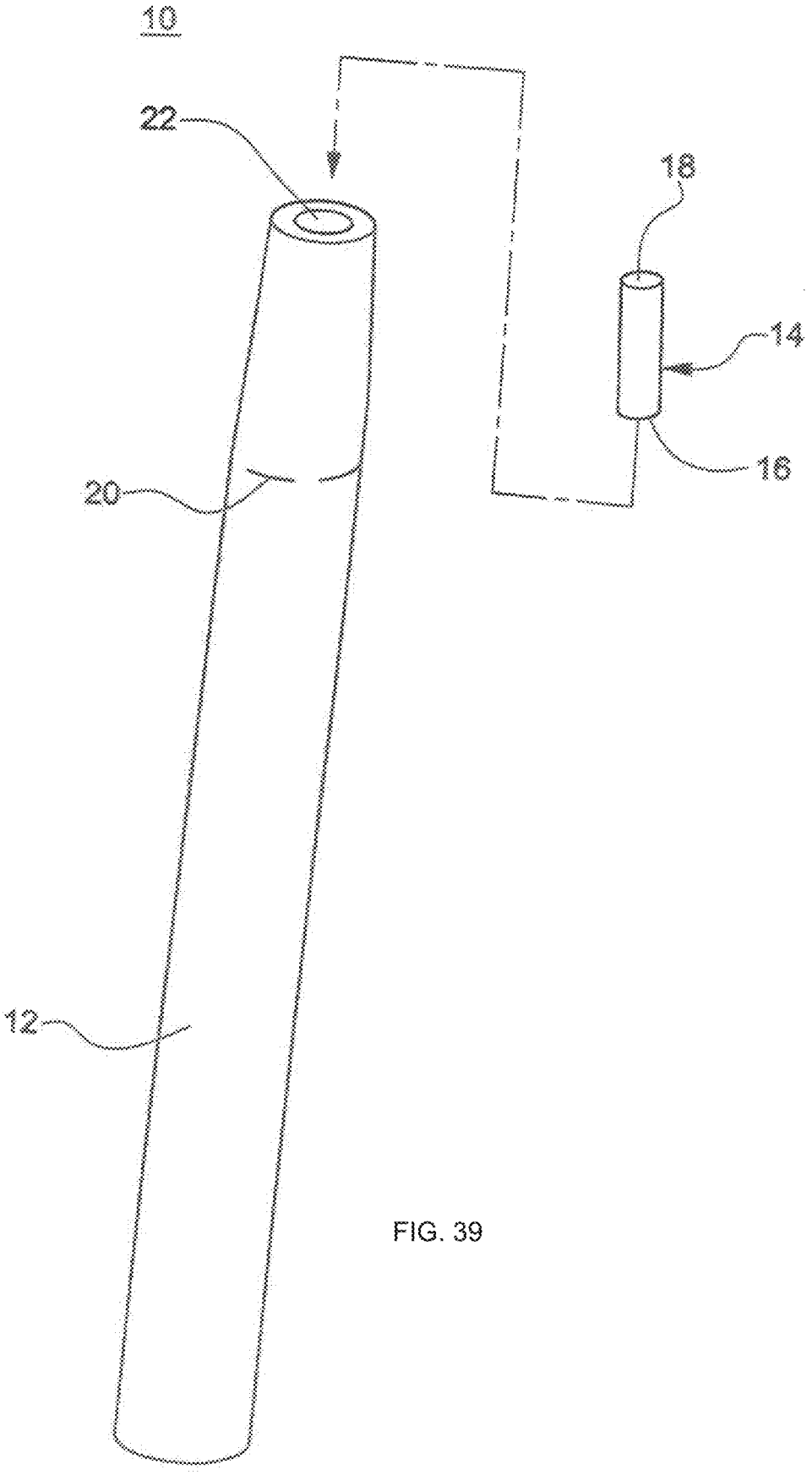
FIG. 39 is an exploded perspective view illustration of a kit-of-parts for assembling the system according to one or more embodiments of the third mode of the present disclosure.

FIG. 39 is an exploded perspective view illustration of a kit-of-parts for assembling an aerosol delivery system 10*b*.

As will be appreciated, in the arrangements described above, the fluid-transfer article 34*b* is provided within a housing 32*b* of the aerosol carrier 14*b*. In such arrangements, the housing of the carrier 14*b* serves to protect the aerosol precursor-containing fluid-transfer article 34*b*, whilst also allowing the carrier 14*b* to be handled by a user without his/her fingers coming into contact with the aerosol precursor liquid retained therein.

Fourth Mode of the Disclosure

In general outline, one or more embodiments in accordance with the present disclosure may provide a system for aerosol delivery in which an aerosol carrier may be inserted into a receptacle (e.g. a "heating chamber") of an apparatus for initiating and maintaining release of an aerosol from the aerosol carrier.

Another end, or another end portion, of the aerosol carrier may protrude from the apparatus and can be inserted into the mouth of a user for the inhalation of aerosol released from the aerosol carrier cartridge during operation of the apparatus.

Hereinafter, and for convenience only, "system for aerosol delivery" shall be referred to as "aerosol delivery system".

Figure 40:
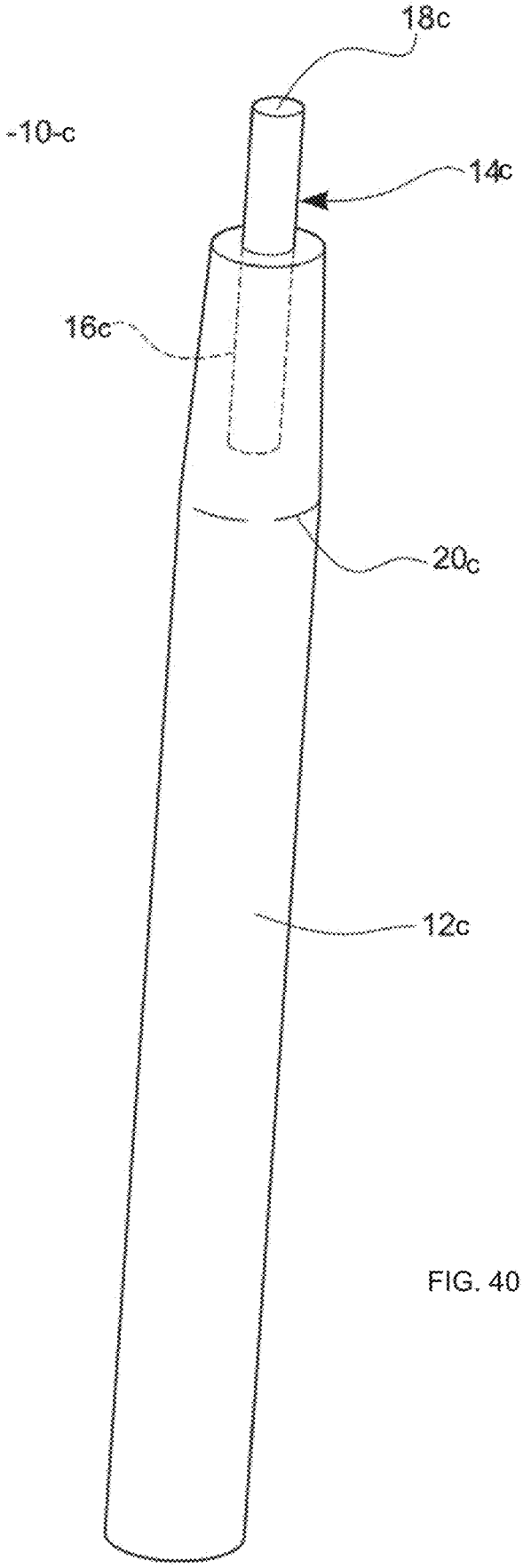
FIG. 40 is a perspective view illustration of a system for aerosol delivery according to one or more embodiments of the fourth mode of the present disclosure.

Referring now to FIG. 40, there is illustrated a perspective view of an aerosol delivery system 10*c* comprising an aerosol generation apparatus 12*c* operative to initiate and maintain release of aerosol from a fluid-transfer article in an aerosol carrier 14*c*. In the arrangement of FIG. 40, the aerosol carrier 14*c* is shown with a first end 16*c* thereof and a portion of the length of the aerosol carrier 14*c* located within a receptacle of the apparatus 12*c*. A remaining portion of the aerosol carrier 14*c* extends out of the receptacle. This remaining portion of the aerosol carrier 14*c*, terminating at a second end 18*c* of the aerosol carrier, is configured for insertion into a user's mouth. A vapour and/or aerosol is produced when a heater (not shown in FIG. 40) of the apparatus 12*c* heats a fluid-transfer article in the aerosol carrier 14*c* to release a vapour and/or an aerosol, and this can be delivered to the user, when the user sucks or inhales, via a fluid passage in communication with an outlet of the aerosol carrier 14*c* from the fluid-transfer article to the second end 18*c*.

The device 12*c* also comprises air-intake apertures 20*c* in the housing of the apparatus 12*c* to provide a passage for air to be drawn into the interior of the apparatus 12*c* (when the user sucks or inhales) for delivery to the first end 16*c* of the aerosol carrier 14*c*, so that the air can be drawn through an activation region of a fluid-transfer article located within a housing of the aerosol carrier cartridge 14*c* during use. Optionally, these apertures may be perforations in the housing of the apparatus 12*c*.

A fluid-transfer article (not shown in FIG. 40, but described hereinafter with reference to FIGS. 44 to 47 is located within a housing of the aerosol carrier 14*c*. The fluid-transfer article contains an aerosol precursor material, which may include at least one of: nicotine; a nicotine precursor material; a nicotine compound; and one or more flavourings. The fluid-transfer article is located within the housing of the aerosol carrier 14*c* to allow air drawn into the aerosol carrier 14*c* at, or proximal, the first end 16*c* to flow through an activation region of the fluid-transfer article. As air passes through the activation region of the fluid-transfer article, an aerosol may be entrained in the air stream from a substrate forming the fluid-transfer article, e.g. via diffusion from the substrate to the air stream and/or via vaporisation of the aerosol precursor material and release from the fluid-transfer article under heating.

The fluid-transfer article 34*c* comprises a first region of a porous material where pores of the porous material hold, contain, carry, or bear the aerosol precursor material, and a second region formed of a multiplicity of fibres. In particular, the porous material of the first region to fluid-transfer article is a porous polymer material such as, for example, a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET). All such materials may be described as heat resistant polymeric wicking material in the context of the present disclosure.

The aerosol carrier 14*c* is removable from the apparatus 12*c* so that it may be disposed of when expired. After removal of a used aerosol carrier 14*c*, a replacement aerosol carrier 14*c* can be inserted into the apparatus 12*c* to replace the used aerosol carrier 14*c*.

Figure 41:
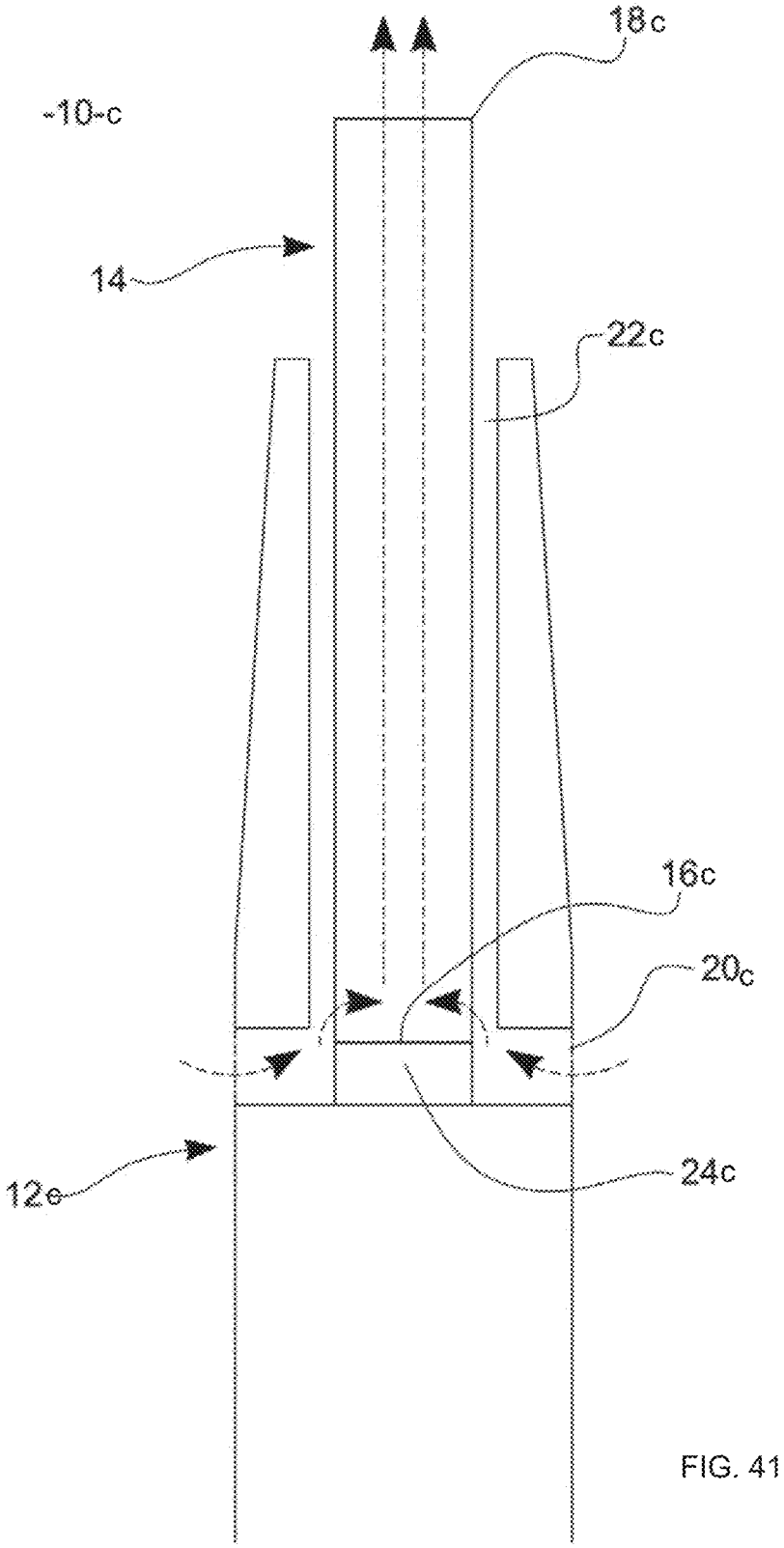
FIG. 41 is a cross-section side view illustration of part of an apparatus of the system for aerosol delivery of FIG. 40.

FIG. 41 is a cross-sectional side view illustration of a part of apparatus 12*c* of the aerosol delivery system 10. The apparatus 12*c* comprises a receptacle 22*c* in which is located a portion of the aerosol carrier 14*c*. In one or more optional arrangements, the receptacle 22*c* may enclose the aerosol carrier 14*c*. The apparatus 12*c* also comprise a heater 24*c*, which opposes an activation region of the fluid-transfer article (not shown in FIG. 41) of the aerosol carrier 14*c* when an aerosol carrier 14*c* is located within the receptacle 22*c*.

Air flows into the apparatus 12*c* (in particular, into a closed end of the receptacle 22*c*) via air-intake apertures 20*c*. From the closed end of the receptacle 22*c*, the air is drawn into the aerosol carrier 14*c* (under the action of the user inhaling or sucking on the second end 18*c*) and expelled at the second end 18*c*. As the air flows into the aerosol carrier 14*c*, it passes across an end of the fluid-transfer article. Heat from the heater 24*c*, which opposes that end of the fluid-transfer article, causes vaporisation of aerosol precursor material at the end of the fluid-transfer article and an aerosol is created in the air flow. Thus, through the application of heat in the region of the end of the fluid-transfer article, an aerosol is released, or liberated, from the fluid-transfer article, and is drawn from the material of the aerosol carrier unit by the air flow and is transported in the air flow to via outlet conduits (not shown in FIG. 41) in the housing of the aerosol carrier 14*c* to the second end 18*c*. The direction of air flow is illustrated by arrows in FIG. 41.

To achieve release of the captive aerosol from the fluid-transfer article, the fluid-transfer article of the aerosol carrier 14*c* is heated by the heater 24*c*. As a user sucks or inhales on second end 18*c* of the aerosol carrier 14*c*, the aerosol released from the fluid-transfer article and entrained in the air is drawn through the outlet conduits (not shown) in the housing of the aerosol carrier 14*c* towards the second end 18*c* and onwards into the user's mouth.

Figure 42:
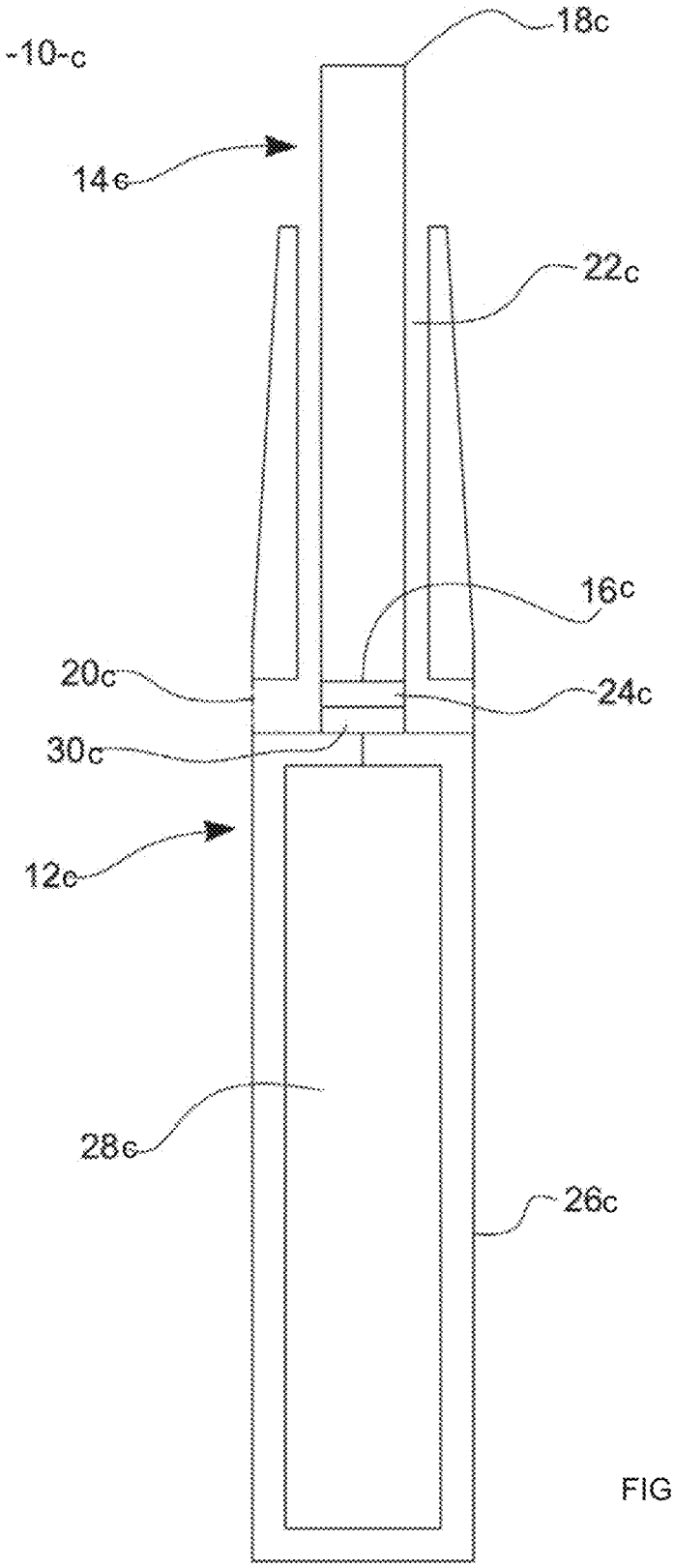
FIG. 42 is a cross-section side view illustration of the system and apparatus for aerosol delivery of FIG. 40.

Turning now to FIG. 42, a cross-sectional side view of the aerosol delivery system 10*c* is schematically illustrated showing the features described above in relation to FIGS. 40 and 41 in more detail. As can be seen, apparatus 12*c* comprises a housing 26*c*, in which are located the receptacle 22*c* and heater 24*c*. The housing 26*c* also contains control circuitry (not shown) operative by a user, or upon detection of air and/or vapour being drawn into the device 12*c* through air-intake apertures 20*c*, i.e. when the user sucks or inhales. Additionally, the housing 26*c* comprises an electrical energy supply 28*c*, for example a battery. Optionally, the battery comprises a rechargeable lithium ion battery. The housing 26*c* also comprises a coupling 30*c* for electrically (and optionally mechanically) coupling the electrical energy supply 28*c* to control circuitry (not shown) for powering and controlling operation of the heater 24*c*.

Responsive to activation of the control circuitry of apparatus 12*c*, the heater 24*c* heats the fluid-transfer article (not shown in FIG. 42) of aerosol carrier 14*c*. This heating process initiates (and, through continued operation, maintains) release of vapour and/or an aerosol from the end of the fluid-transfer article adjacent the heater. The vapour and/or aerosol formed as a result of the heating process is entrained into a stream of air being drawn across the heating surface of the heater (as the user sucks or inhales). The stream of air with the entrained vapour and/or aerosol passes through the aerosol carrier 14*c* via outlet conduits (not shown) and exits the aerosol carrier 14*c* at second end 18*c* for delivery to the user. This process is briefly described above in relation to FIG. 41, where arrows schematically denote the flow of the air stream into the device 12*c* and through the aerosol carrier 14*c*, and the flow of the air stream with the entrained vapour and/or aerosol through the aerosol carrier cartridge 14*c*.

Figure 43:
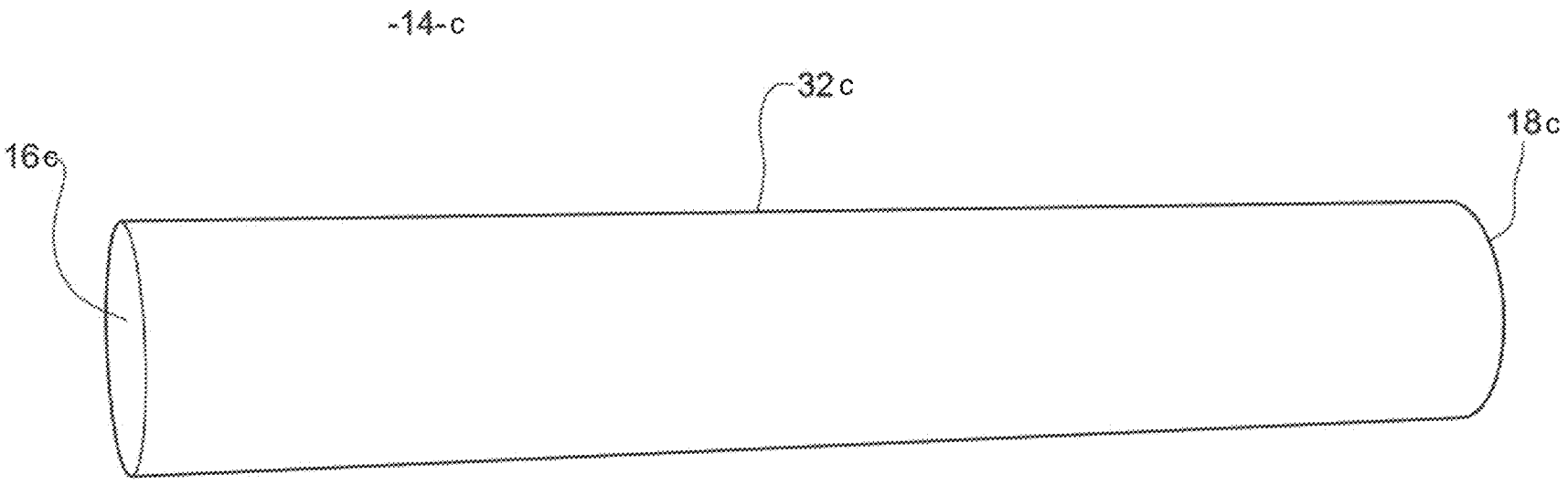
FIG. 43 is a perspective view illustration of an aerosol carrier for use in the system for aerosol delivery according to one or more embodiments of the fourth mode of the present disclosure.
Figure 44:
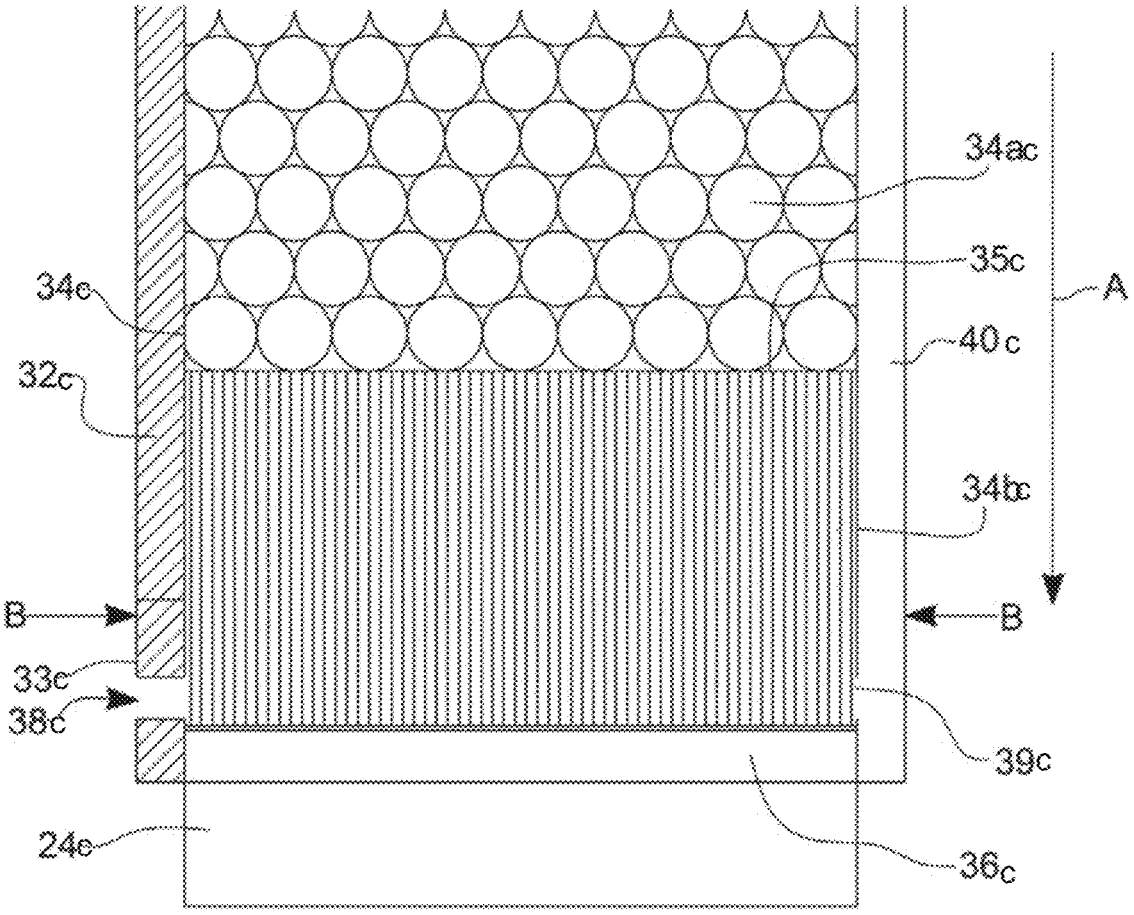
FIG. 44 is a cross-section side view of elements of an aerosol carrier and a part of an apparatus of the system for aerosol delivery according to one or more embodiments of the fourth mode of the present disclosure.
Figure 45:
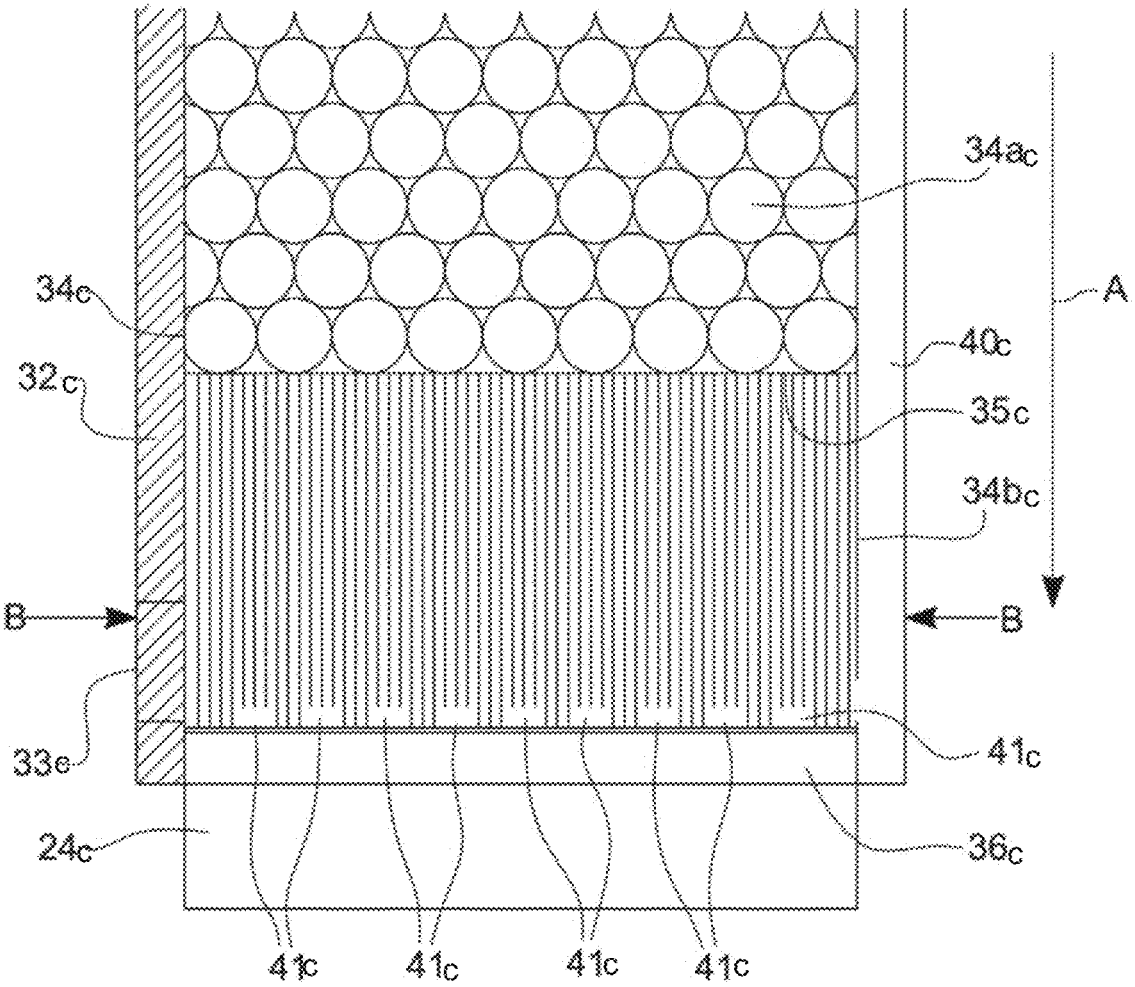
FIG. 45 is a cross-section side view corresponding to FIG. 44, but perpendicular thereto.

FIGS. 43 to 45 schematically illustrate the aerosol carrier 14*c* in more detail (and, in FIGS. 44 and 45, features within the receptacle in more detail). FIG. 43 illustrates an exterior of the aerosol carrier 14*c*, FIG. 44 illustrates internal components of the aerosol carrier 14*c* in one optional configuration, and FIG. 45 illustrates internal components of the aerosol carrier 14*c* in another optional configuration.

FIG. 43 illustrates the exterior of the aerosol carrier 14*c*, which comprises a housing 32*c* for housing said fluid-transfer article (not shown). The particular housing 32*c* illustrated in FIG. 43 comprises a tubular member, which may be generally cylindrical in form, and which is configured to be received within the receptacle of the apparatus. First end 16*c* of the aerosol carrier 14*c* is for location to oppose the heater of the apparatus, and second end 18*c* (and the region adjacent the second end 18*c*) is configured for insertion into a user's mouth.

FIGS. 44 and 45 illustrate some internal components of the aerosol carrier 14*c* and of the heater 24*c* of apparatus 12*c*, in in one embodiment of the disclosure.

As described above, the aerosol carrier 14*c* comprises a fluid-transfer article 34*c*. Optionally, there may be a conduction element 36*c* (as shown in FIGS. 5 and 6), being part of the heater 24*c*. In one or more arrangements, the aerosol carrier 14*c* is located within the receptacle of the apparatus such that an end of the fluid-transfer article opposes and is adjacent the heater 24*c* of the apparatus and receives heat directly from the heater 24*c* of the apparatus. When aerosol carrier 14*c* is located within the receptacle of the apparatus such that the adjacent end of the fluid-transfer article is located to oppose the heater of the apparatus, the conduction element 36*c* is disposed between the rest of the heater 24*c* and the end of the fluid-transfer article. Heat may be transferred to the end of the fluid-transfer article via conduction through conduction element 36*c* (i.e. application of heat to the activation surface is indirect).

Further components not shown in FIG. 44 comprise: an inlet conduit, via which air can be drawn into the aerosol carrier 14*c*; an outlet conduit, via which an air stream entrained with aerosol can be drawn from the aerosol carrier 14*c*; a filter element; and a reservoir for storing aerosol precursor material and for providing the aerosol precursor material to the fluid-transfer article 34*c*.

In FIGS. 44 and 45, the aerosol carrier is shown as comprising the fluid-transfer article 34*c* located within housing 32*c*. The fluid transfer article 34*c* comprises a first region 34*ac* holding an aerosol precursor. In one or more arrangements, the first region of 34*ac* of the fluid transfer article 34*c* comprises a reservoir for holding the aerosol precursor. The first region 34*ac* can be the sole reservoir of the aerosol carrier 14*c*, or it can be arranged in fluid communication with a separate reservoir, where aerosol precursor is stored for supply to the first region 34*ac*. In the particular arrangement illustrated, the material forming the first region of 34*ac* comprises a porous structure, whose pore diameter size may vary between one end of the first region 34*ac* and another end of the first region 34*ac*. For example, the pore diameter size may decrease from a first end remote from heater 24*c* (the upper end is as shown in the figure) to a second end. This configuration of pores having a decreasing diameter size can provide a wicking effect, which can serve to draw fluid through the first region 34*ac*, towards heater 24*c*. As mentioned above, the porous polymer material may be a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET).

Alternatively, the first region 34*ac* may be a simple liquid reservoir in the form of an empty tank for the receipt and storage of liquid aerosol precursor, rather than porous material for holding the aerosol precursor.

The fluid transfer article 34*c* also comprises a second region 34*bc*. In arrangements in which the first region 34*ac* is formed from material having a porous structure, aerosol precursor is drawn from the first region of 34*ac* to the second region 34*bc* by the wicking effect of the material forming the first region of 34*ac*. Thus, the first region 34*ac* is configured to transfer the aerosol precursor to the second region 34*bc* of the article 34*c*.

The second region 34*bc* is formed of a multiplicity of fibres. The fibres may be arranged in a generally parallel manner, with small spaces therebetween. The fibres extend from an end of the first region 34*ac*, which end will be referred to as a transfer surface, towards the heater 24*c*. The fibres forming the second region 34*bc* may be glass fibres, Kevlar fibres etc.

Some of the fibres extend to the heating surface formed by conduction element 36*c*. Others terminate short of the conduction element so that there are gaps between their ends and the conduction surface 36*c*. The effect of this, as illustrated in FIG. 45, is that the gaps form channels 41*c* among the fibres, which channels 41*c* extend along the conduction element 36*c*. The channels 41*c* allow air to pass among the fibres, and thus form an air-flow pathway. This arrangement permits direct transfer of heat from the conduction element 36*c* to some of the fibres (those which extend to the conduction element 36*c*) and yet allow satisfactory air flow along the air-flow pathway. As can be seen from FIG. 45, the sides of the channels 41*c* are bounded by the fibres which extend to the conduction element 36*c*, and the tops of the channels 41*c* are bounded by the fibres which terminate short of the conduction element 36*c*. Whilst the channels 41*c* do not have solid side and top walls, because the sides and top are bounded by fibres, the fibres are sufficiently close together that any air flow will be almost entirely within the channels, rather than among the individual fibres. This enables the air flow to be controlled, by choice of the relative numbers of the fibres which reach the conduction element and those which do not.

Aerosol precursor at the transfer surface 35*c* will pass into the spaces between the fibres of the second region 34*bc*, and be drawn along the fibres by capillary action. Aerosol precursor will thus pass to end of the second region 34*bc* proximate to the conduction element 36*c*, which end acts as an activation region for the aerosol precursor. When the heater 24*c* is active, heat will be transferred via that conduction element 36*c* to the aerosol precursor at the activation region at the adjacent end of the second region 34*bc* (i.e. at the ends of the fibres furthest from the transfer surface 35*c*) and the heat will cause that aerosol precursor to vaporise. The vaporised precursor can then pass into the channels 41*c*.

FIG. 44 also illustrates an opening 38*c* in a further housing 33*c*, which opening 38*c* is in communication with the air-intake apertures 20*c*. A further opening 39*c* communicates with a duct 40*c* within the housing 32*c*, which duct 40*c* communicates with the second end 18*c*.

The further housing 33*c* supports the heater 24*c* (and optional conduction element 36*c* if present). The housing 32*c* and the further housing 33*c* are separable, e.g. along the line B-B in FIG. 44, to allow the housing 32*c*, and hence the fluid-transfer article 34*c*, to be removed from the rest of the apparatus. Since the aerosol precursor in the fluid-transfer article will be consumed as the user uses the apparatus, it will be necessary periodically to replace it. This can be done by removing the housing 32*c* from the rest of the apparatus, and refilling the aerosol precursor, or replacing the housing 32*c* with another in which the fluid-transfer article is full of aerosol precursor. The further housing 33*c* may be integral with the housing 26*c* containing the electrical energy supply 28*c*.

In FIG. 44, all the fibres visible extend to the conduction element 36*c*. In FIG. 45, which is perpendicular to FIG. 44, it can be seen that some of the fibres stop short of the conduction element 36*c*. Those fibres that stop short are arranged in rows along the conduction element 36*c* so that the gaps between the ends of those fibres and the conduction surface are aligned, so that the channels 41*c* in FIG. 45 extend from one side of the conduction element 36*c* to the other. The channels 41*c* then link the openings 38*c*, 39*c*.

There is thus a fluid-flow path for air (hereinafter referred to as an air-flow pathway) between openings 38*c* and 39*c*, along the channels 41*c* thereby linking the apertures 20*c* and the second end 18*c* of the aerosol carrier. When the user sucks or inhales, air is drawn along the air-flow pathway, along the surface of the conduction element 36*c*, and through the channels 41*c* at the ends of the fibres, forming the second region 34*bc*. Note that the openings 38*c* and 39*c* are not visible in FIG. 45 as the cross-section of FIG. 45 is perpendicular to that of FIG. 44.

Aerosol precursor which has reached the ends of the fibres of the second region 34*bc* and has been heated and transferred by the conduction element 36*c* will pass into the air flowing in the channels 41*c* forming an air-flow pathway between the openings 38*c* and 39*c*. The vapour or mixture passes, as the user sucks and inhales, to the second end 18*c*. This has the effect of removing aerosol precursor from the ends of the fibres proximate the conduction element 36*c*. This will have the effect of drawing further aerosol precursor down the fibres from the transfer surface 35*c*. There may also be a low-pressure effect due to the movement of the air along the air-flow pathway, which draws fluid along the fibres to the conduction element 36*c*.

As noted above, the conduction element 36*c* may be absent in some arrangements.

The conduction element 36*c*, if present, may comprise a thin film of thermally conductive material, such as, for example, a metal foil (for example, aluminium, brass, copper, gold, steel, silver, or an alloy comprising anyone of the foregoing together with thermally conductive plastics and/or ceramics).

In the illustrative examples of FIGS. 44 and 45, the first region 34*ac* of the fluid-transfer article 34*c* is located at an "upstream" end of the fluid-transfer article 34*c* and the second region 34*b* is located at a downstream" end of the fluid-transfer article 34*c*. That is, aerosol precursor is wicked, or is drawn, from the "upstream" end of the fluid-transfer article 34*c* to the "downstream" end of the fluid-transfer article 34*c* (as denoted by arrow A in FIG. 44).

As mentioned above, the conduction element 36*c* need not be present.

Figure 46:
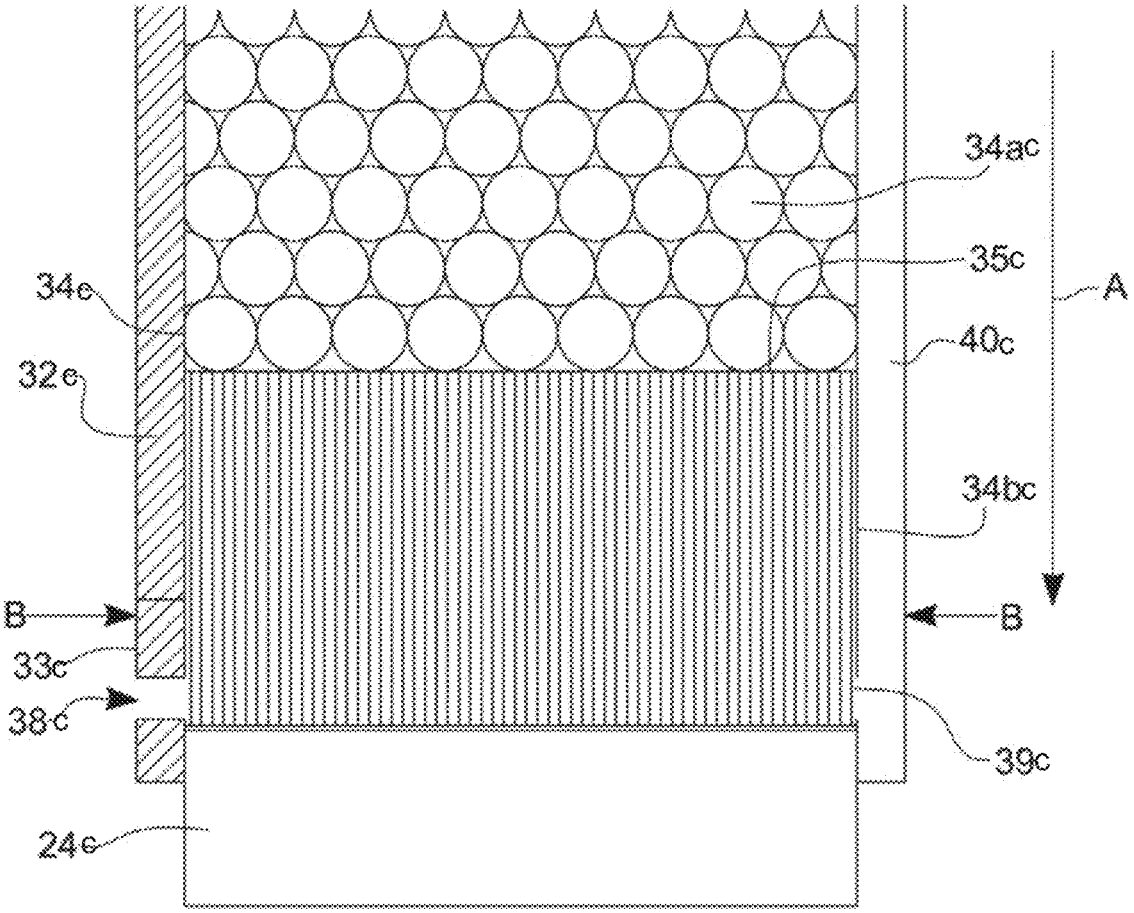
FIG. 46 is a cross-section side view of elements of an aerosol carrier and a part of an apparatus of the system for aerosol delivery according to one or more embodiments of the present disclosure, in an alternative configuration from that of FIG. 44.

FIG. 46 illustrates an embodiment corresponding to that of FIG. 44, but without such a conduction element 36*c*. The arrangement of FIG. 46 is otherwise similar to that of FIG. 44, and corresponding parts are indicated by the same reference numerals. In particular, there will be channels 41*c* formed by some of the fibres of the second region 34*bc*, as in FIG. 45, although those channels 41*c* are not visible in FIG. 46.

In FIG. 45 the channels 41*c* have a generally square or rectangular cross-section, because the fibres of the second region 36*bc* are of two different lengths. Other arrangements are possible by varying the lengths of the fibres, to form e.g. channels with a curved or stepped cross-section.

Figure 47:
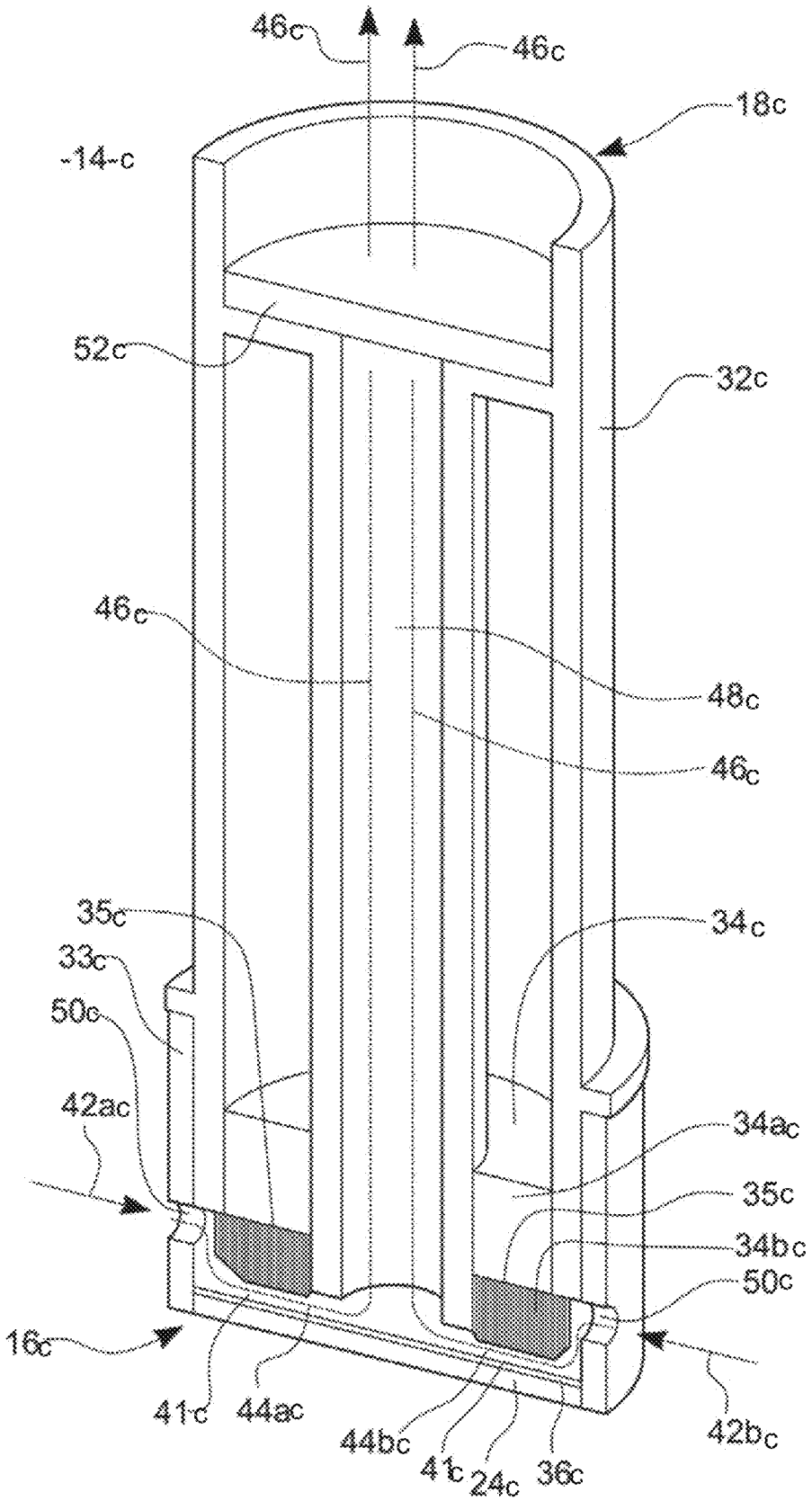
FIG. 47 is a cross-section side view of aerosol carrier according to one or more embodiments of the fourth mode of the present disclosure.
Figure 48:
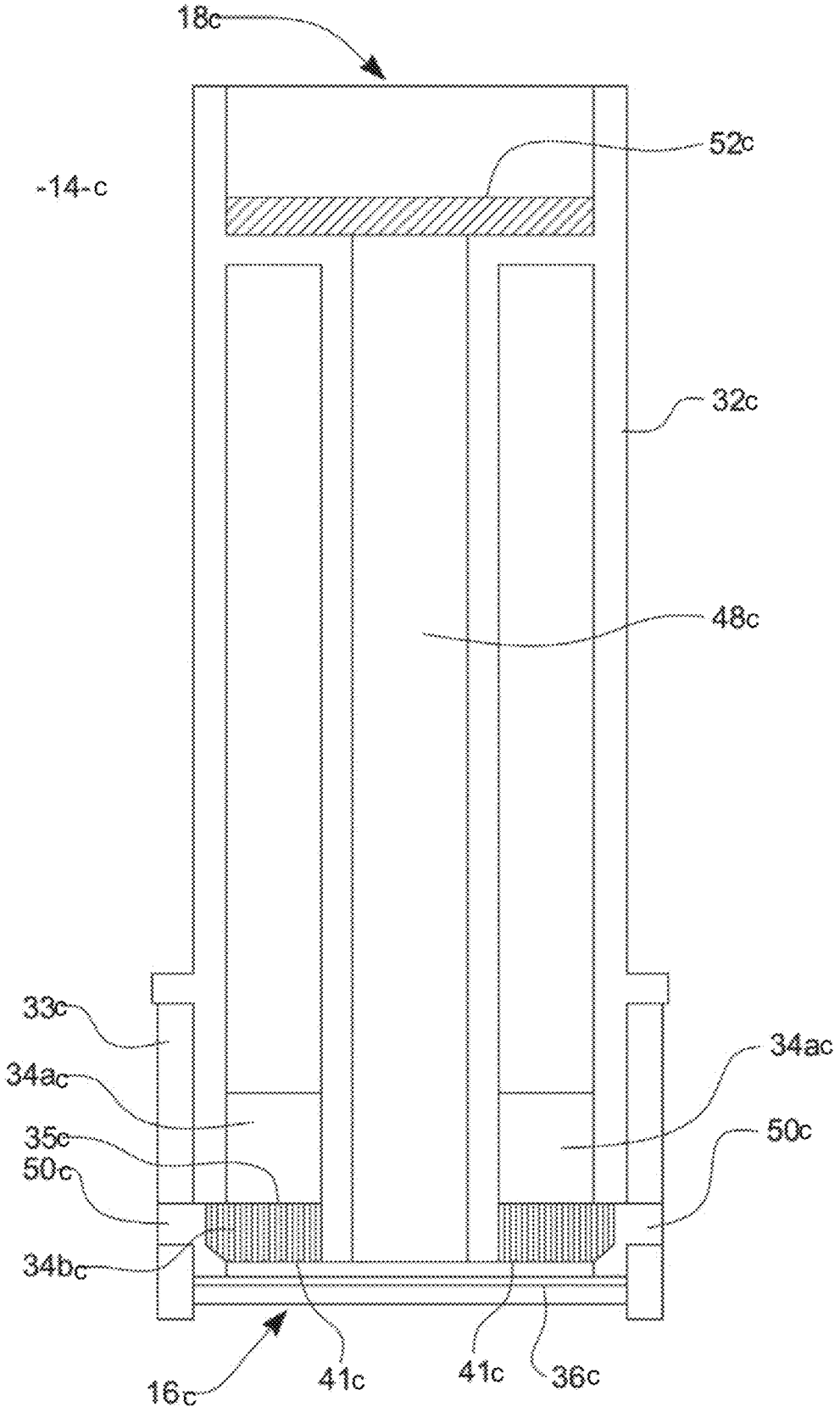
FIG. 48 is a perspective cross-section side view of the aerosol carrier of FIG. 7.

In the arrangements shown in FIGS. 44 to 46, the apertures 38*c*, 39*c* are on opposite sides of the housing 32. FIGS. 47 and 48 show an alternative configuration, in which the fluid-transfer article is annular, and the second part 34*bc* is then in the form of annular diaphragm. Note that, in FIGS. 47 and 48, sectional views are taken along the channels 41*c*, so all the fibres illustrated terminate short of the conduction element 36*c*. However, as in the arrangements of FIGS. 44 to 46, some of the fibres will extend to the conduction element 36*c*, to form the side walls of the channels 41*c*. Thus, FIGS. 47 and 48 illustrate an aerosol carrier 14*c* according to one or more possible arrangements in more detail. FIG. 47 is a cross-section side view illustration of the aerosol carrier 14*c* and FIG. 48 is a perspective cross-section side view illustration of the aerosol carrier 14*c*.

As can be seen from FIGS. 47 and 48, the aerosol carrier 14*c* is generally tubular in form. The aerosol carrier 14*c* comprises housing 32*c*, which defines the external walls of the aerosol carrier 14*c* and which defines therein a chamber in which are disposed the fluid-transfer article 34*c* (adjacent the first end 16*c* of the aerosol carrier 14*c*) and internal walls defining the fluid communication pathway 48*c*. Fluid communication pathway 48*c* defines a fluid pathway for an outgoing air stream from the channels 40*c* to the second end 18*c* of the aerosol carrier 14*c*. In the examples illustrated in FIGS. 47 and 48, the fluid-transfer article 34*c* is an annular shaped element located around the fluid communication pathway 48*c*. As in the arrangements of FIGS. 44 to 46, the heater 24*c* (and optional conduction element 36*c* if present) are mounted in a further housing 33*c*, which further housing 33*c* is separable from the housing 32*c* containing the fluid-transfer article.

In walls of the further housing 33*c*, there are provided inlet apertures 50*c* to provide a fluid communication pathway for an incoming air stream to reach the fluid-transfer article 34*c*, and particularly the air-flow pathway defined across the surface of the conduction element 36*c* (or across the surface of the heater 24*c*), and passing through the channels 41*c* formed by the ends of the fibres forming the second region 34*bc* of the aerosol-transfer article 34*c*.

In the illustrated example of FIGS. 47 and 48, the aerosol carrier 14*c* further comprises a filter element 52*c*. The filter element 52*c* is located across the fluid communication pathway 48*c* such that an outgoing air stream passing through the fluid communication pathway 48*c* passes through the filter element 52*c*.

With reference to FIG. 48, when a user sucks on a mouthpiece of the apparatus (or on the second end 18*c* of the aerosol carrier 14*c*, if configured as a mouthpiece), air is drawn into the carrier through inlet apertures 50*c* extending through walls in the housing 32*c* of the aerosol carrier 14*c*.

An incoming air stream 42*a* from a first side of the aerosol carrier 14*c* is directed to a first side of the second part 34*bc* of the fluid-transfer article 34*c* (e.g. via a gas communication pathway within the housing of the carrier). An incoming air stream 42*bc* from a second side of the aerosol carrier 14*c* is directed to a second side of the second part 34*bc* of the fluid-transfer article 34*c* (e.g. via a gas communication pathway within the housing of the carrier). When the incoming air stream 42*ac* from the first side of the aerosol carrier 14*c* reaches the first side of the second part 34*bc*, the incoming air stream 42*ac* from the first side of the aerosol carrier 14*c* flows through the channels 41*c* formed by the ends of the fibres of the second part 34*bc* across the conduction element 36*c* (or across the heater 24*c*). Likewise, when the incoming air stream 42*bc* from the second side of the aerosol carrier 14*c* reaches the second side of the second part 34*bc*, the incoming air stream 42*bc* from the second side of the aerosol carrier 14*c* flows through the channels 41*c* formed by the ends of the fibres of the second part 34*bc* across the conduction element 36*c* (or across heater 24*c*). The air streams from each side are denoted by dashed lines 44*ac* and 44*bc* in FIG. 47. As these air streams 44*ac* and 44*bc* flow, aerosol precursor at the ends of the fibres or on the conduction element 36*c* (or on the heater 24*c*) is entrained in air streams 44*ac* and 44*bc*.

In use, the heater 24*c* of the apparatus 12*c* to raise a temperature of the conduction element 36*c* to a sufficient temperature to release, or liberate, captive substances (i.e. the aerosol precursor) to form a vapour and/or aerosol, which is drawn downstream. As the air streams 44*ac* and 44*bc* continue their passages, more released aerosol precursor is entrained within the air streams 44*ac* and 44*bc*. When the air streams 44*ac* and 44*bc* entrained with aerosol precursor meet at a mouth of the outlet fluid communication pathway 48*c*, they enter the outlet fluid communication pathway 48*c* and continue until they pass through filter element 52*c* and exit outlet fluid communication pathway 48*c*, either as a single outgoing air stream, or as separate outgoing air streams 46*c* (as shown). The outgoing air streams 46*c* are directed to an outlet, from where it can be inhaled by the user directly (if the second end 18*c* of the aerosol capsule 14*c* is configured as a mouthpiece), or via a mouthpiece. The outgoing air streams 46*c* entrained with aerosol precursor are directed to the outlet (e.g. via a gas communication pathway within the housing of the carrier).

Figure 49:
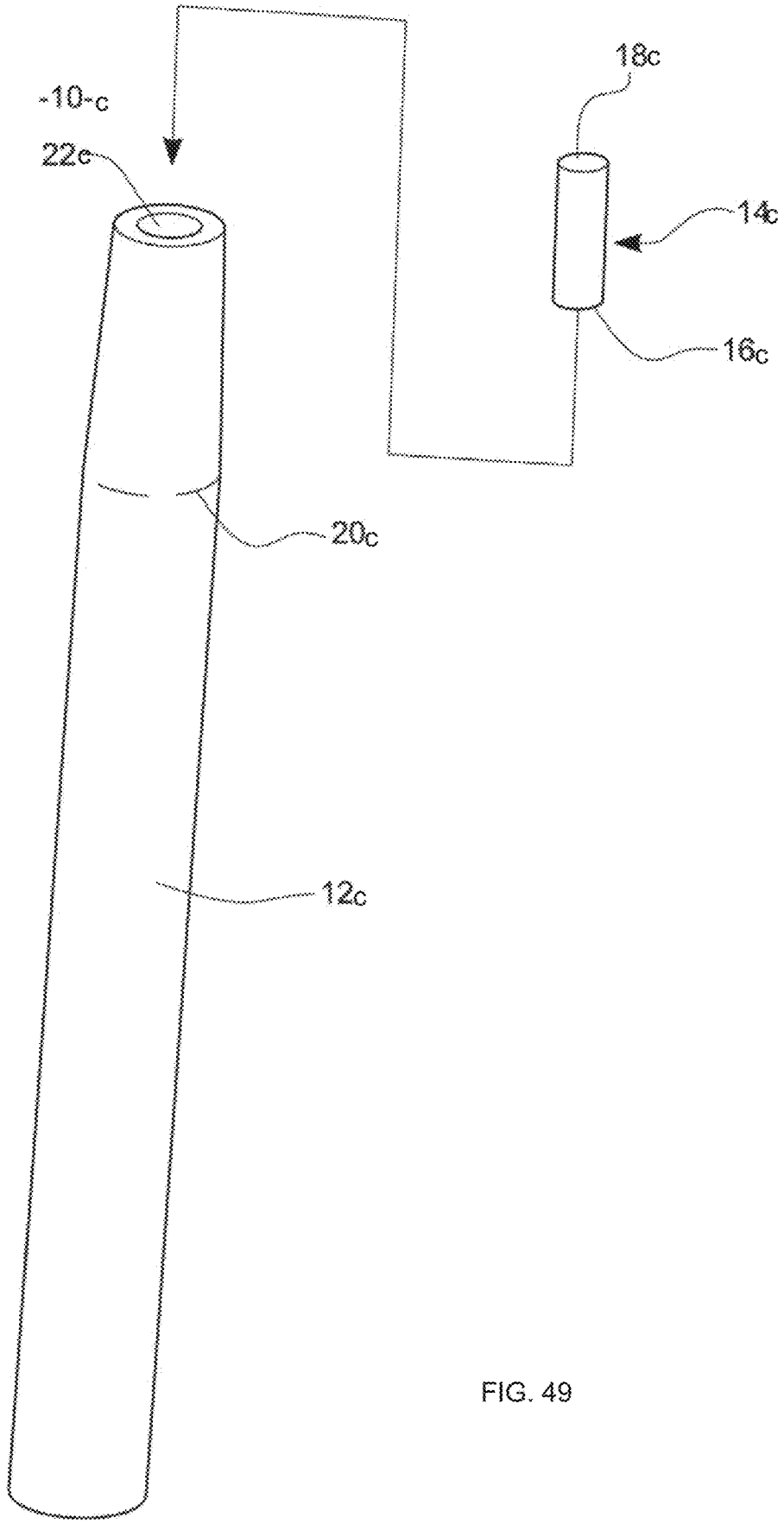
FIG. 49 is an exploded perspective view illustration of a kit-of-parts for assembling the system according to one or more embodiments of the fourth mode of the present disclosure.

FIG. 49 is an exploded perspective view illustration of a kit-of-parts for assembling an aerosol delivery system 10*c*.

As will be appreciated, in the arrangements described above, the fluid-transfer article 34*c* is provided within a housing 32*c* of the aerosol carrier 14*c*. In such arrangements, the housing of the carrier 14*c* serves to protect the aerosol precursor-containing fluid-transfer article 34*c*, whilst also allowing the carrier 14*c* to be handled by a user without his/her fingers coming into contact with the aerosol precursor liquid retained therein.

Fifth Mode of the Disclosure

In general outline, one or more embodiments in accordance with the fifth mode of the present disclosure may provide a system for aerosol delivery in which an aerosol carrier may be inserted into a receptacle (e.g. a "heating chamber") of an apparatus for initiating and maintaining release of an aerosol from the aerosol carrier. Another end, or another end portion, of the aerosol carrier may protrude from the apparatus and can be inserted into the mouth of a user for the inhalation of aerosol released from the aerosol carrier cartridge during operation of the apparatus.

Hereinafter, and for convenience only, "system for aerosol delivery" shall be referred to as "aerosol delivery system".

Figure 50:
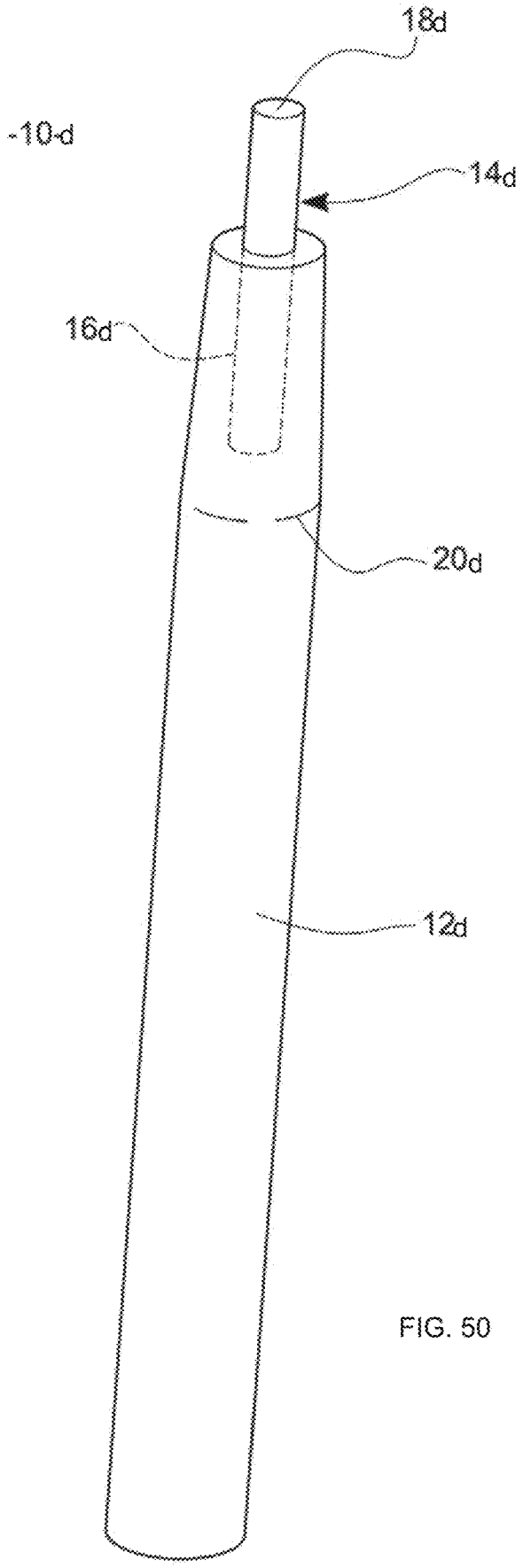
FIG. 50. is a perspective view illustration of a system for aerosol delivery according to one or more embodiments of the fifth mode of the present disclosure.

Referring now to FIG. 50, there is illustrated a perspective view of an aerosol delivery system 10*d* comprising an aerosol generation apparatus 12*d* operative to initiate and maintain release of aerosol from a fluid-transfer article in an aerosol carrier 14*d*. In the arrangement of FIG. 50, the aerosol carrier 14*d* is shown with a first end 16*d* thereof and a portion of the length of the aerosol carrier 14*d* located within a receptacle of the apparatus 12*d*. A remaining portion of the aerosol carrier 14*d* extends out of the receptacle. This remaining portion of the aerosol carrier 14*d*, terminating at a second end 18*d* of the aerosol carrier, is configured for insertion into a user's mouth. A vapour and/or aerosol is produced when a heater (not shown in FIG. 50) of the apparatus 12*d* heats a fluid-transfer article in the aerosol carrier 14*d* to release a vapour and/or an aerosol, and this can be delivered to the user, when the user sucks or inhales, via a fluid passage in communication with an outlet of the aerosol carrier 14*d* from the fluid-transfer article to the second end 18*d*.

The device 12*d* also comprises air-intake apertures 20*d* in the housing of the apparatus 12*d* to provide a passage for air to be drawn into the interior of the apparatus 12*d* (when the user sucks or inhales) for delivery to the first end 16*d* of the aerosol carrier 14*d*, so that the air can be drawn through an activation region of a fluid-transfer article located within a housing of the aerosol carrier cartridge 14*d* during use. Optionally, these apertures may be perforations in the housing of the apparatus 12*d*.

A fluid-transfer article (not shown in FIG. 50, but described hereinafter with reference to FIGS. 5 to 8 is located within a housing of the aerosol carrier 14*d*. The fluid-transfer article contains an aerosol precursor material, which may include at least one of: nicotine; a nicotine precursor material; a nicotine compound; and one or more flavourings. The fluid-transfer article is located within the housing of the aerosol carrier 14*d* to allow air drawn into the aerosol carrier 14*d* at, or proximal, the first end 16*d* to flow at an activation region of the fluid-transfer article. As air passes through the activation region of the fluid-transfer article, an aerosol may be entrained in the air stream from a substrate forming the fluid-transfer article, e.g. via diffusion from the substrate to the air stream and/or via vaporisation of the aerosol precursor material and release from the fluid-transfer article under heating.

The fluid-transfer article 34*d* may comprise a first region of a porous material where pores of the porous material hold, contain, carry, or bear the aerosol precursor material, and a second region formed of a multiplicity of fibres. In particular, the porous material of the fluid-transfer article is a porous polymer material such as, for example, a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET). All such materials may be described as heat resistant polymeric wicking material in the context of the present disclosure.

The aerosol carrier 14*d* is removable from the apparatus 12*d* so that it may be disposed of when expired. After removal of a used aerosol carrier 14*d*, a replacement aerosol carrier 14*d* can be inserted into the apparatus 12*d* to replace the used aerosol carrier 14*d*.

Figure 51:
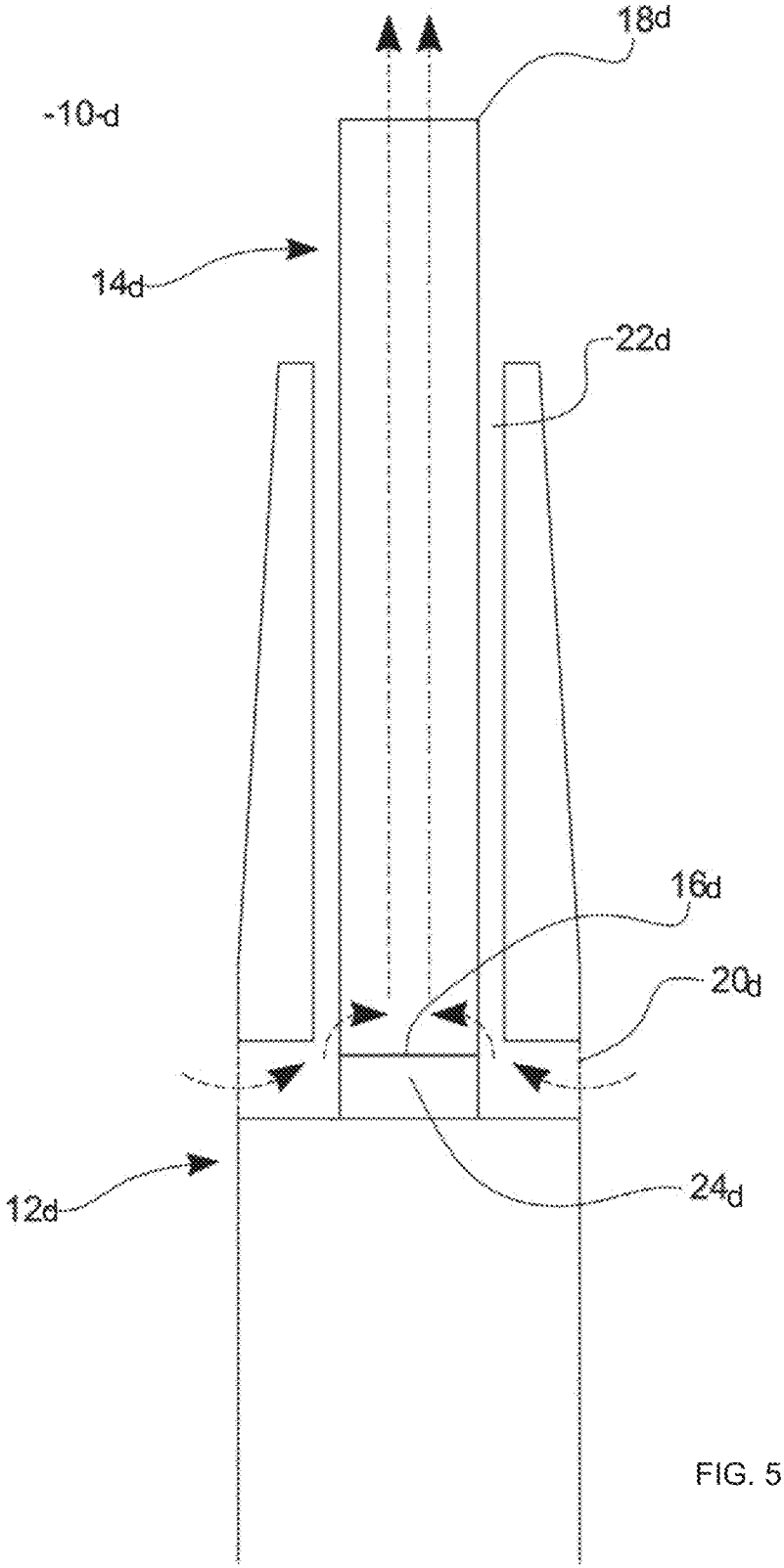
FIG. 51. is a cross-section side view illustration of part of an apparatus of the system for aerosol delivery of FIG. 50.

FIG. 51 is a cross-sectional side view illustration of a part of apparatus 12*d* of the aerosol delivery system

10. The apparatus 12*d* comprises a receptacle 22*d* in which is located a portion of the aerosol carrier 14*d*. In one or more optional arrangements, the receptacle 22*d* may enclose the aerosol carrier 14*d*. The apparatus 12*d* also comprise a heater 24*d*, which opposes an activation region of the fluid-transfer article (not shown in FIG. 51) of the aerosol carrier 14*d* when an aerosol carrier 14*d* is located within the receptacle 22*d*.

Air flows into the apparatus 12*d* (in particular, into a closed end of the receptacle 22*d*) via air-intake apertures 20*d*. From the closed end of the receptacle 22*d*, the air is drawn into the aerosol carrier 14*d* (under the action of the user inhaling or sucking on the second end 18*d*) and expelled at the second end 18*d*. As the air flows into the aerosol carrier 14*d*, it passes an end of the fluid-transfer article or across that end. Heat from the heater 24*d*, which opposes that end of the fluid-transfer article (the activation region), causes vaporisation of aerosol precursor material at the end of the fluid-transfer article and an aerosol is created in the air flow. Thus, through the application of heat in the region of the end of the fluid-transfer article, an aerosol is released, or liberated, from the fluid-transfer article, and is drawn from the material of the aerosol carrier unit by the air flow and is transported in the air flow to via outlet conduits (not shown in FIG. 51) in the housing of the aerosol carrier 14*d* to the second end 18*d*. The direction of air flow is illustrated by arrows in FIG. 51.

To achieve release of the captive aerosol from the fluid-transfer article, the fluid-transfer article of the aerosol carrier 14*d* is heated by the heater 24*d*. As a user sucks or inhales on second end 18*d* of the aerosol carrier 14*d*, the aerosol released from the fluid-transfer article and entrained in the air is drawn through the outlet conduits (not shown) in the housing of the aerosol carrier 14*d* towards the second end 18*d* and onwards into the user's mouth.

Figure 52:
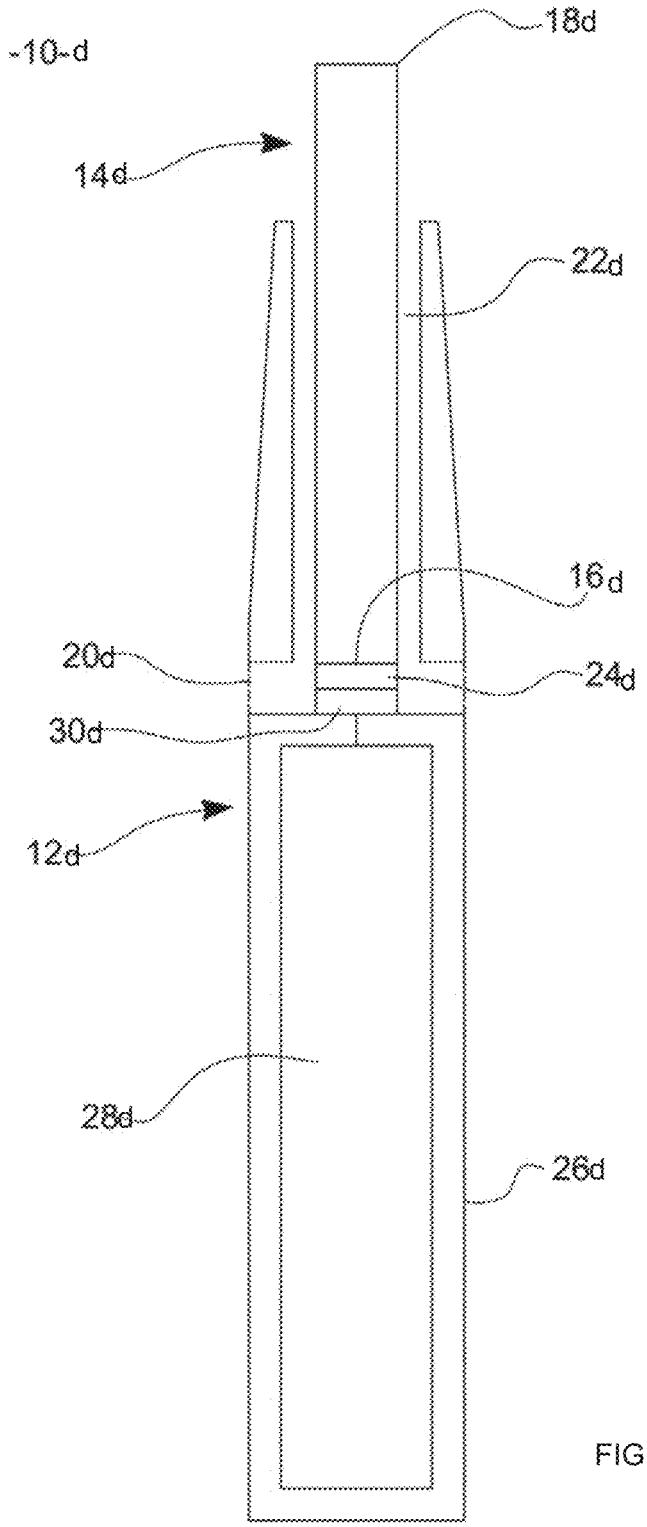
FIG. 52. is a cross-section side view illustration of the system and apparatus for aerosol delivery of FIG. 50.

Turning now to FIG. 52, a cross-sectional side view of the aerosol delivery system 10*d* is schematically illustrated showing the features described above in relation to FIGS. 50 and 51 in more detail. As can be seen, apparatus 12*d* comprises a housing 26*d*, in which are located the receptacle 22*d* and heater 24*d*. The housing 26*d* also contains control circuitry (not shown) operative by a user, or upon detection of air and/or vapour being drawn into the device 12*d* through air-intake apertures 20*d*, i.e. when the user sucks or inhales. Additionally, the housing 26*d* comprises an electrical energy supply 28*d*, for example a battery. Optionally, the battery comprises a rechargeable lithium ion battery. The housing 26*d* also comprises a coupling 30*d* for electrically (and optionally mechanically) coupling the electrical energy supply 28*d* to control circuitry (not shown) for powering and controlling operation of the heater 24*d*.

Responsive to activation of the control circuitry of apparatus 12*d*, the heater 24*d* heats the fluid-transfer article (not shown in FIG. 52) of aerosol carrier 14*d*. This heating process initiates (and, through continued operation, maintains) release of vapour and/or an aerosol from the end of the fluid-transfer article adjacent the heater. The vapour and/or aerosol formed as a result of the heating process is entrained into a stream of air being drawn across the heating surface of the heater (as the user sucks or inhales). The stream of air with the entrained vapour and/or aerosol passes through the aerosol carrier 14*d* via outlet conduits (not shown) and exits the aerosol carrier 14*d* at second end 18*d* for delivery to the user. This process is briefly described above in relation to FIG. 51, where arrows schematically denote the flow of the air stream into the device 12*d* and through the aerosol carrier 14*d*, and the flow of the air stream with the entrained vapour and/or aerosol through the aerosol carrier cartridge 14*d*.

Figure 53:
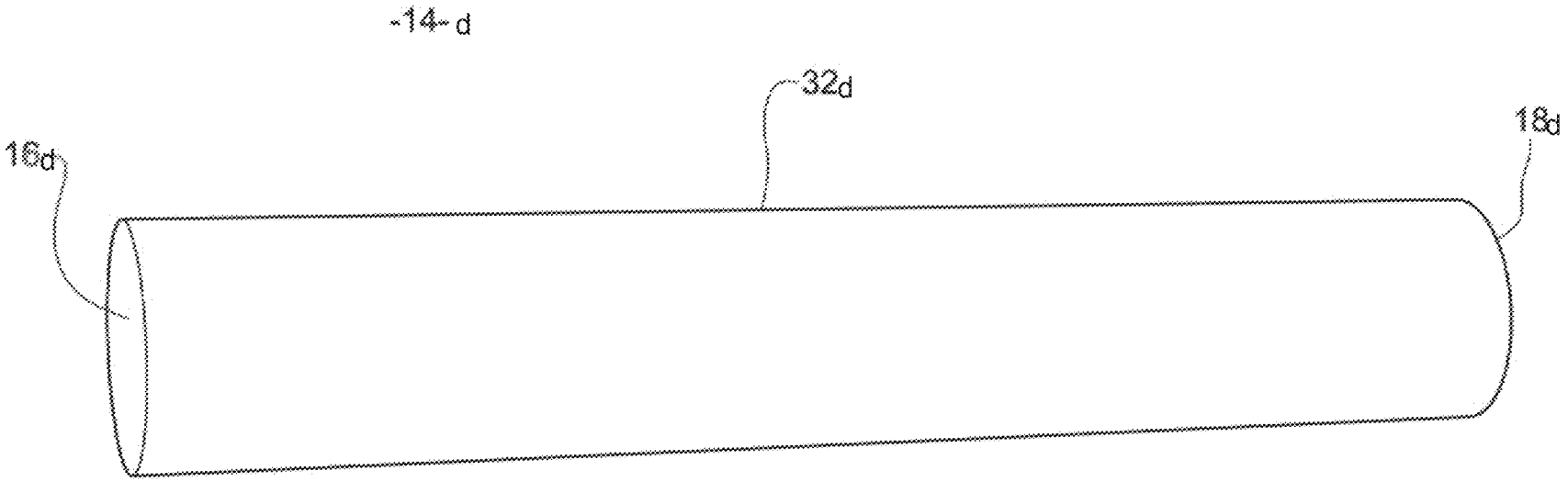
FIG. 53. is a perspective view illustration of an aerosol carrier for use in the system for aerosol delivery according to one or more embodiments of the present disclosure.
Figure 54:
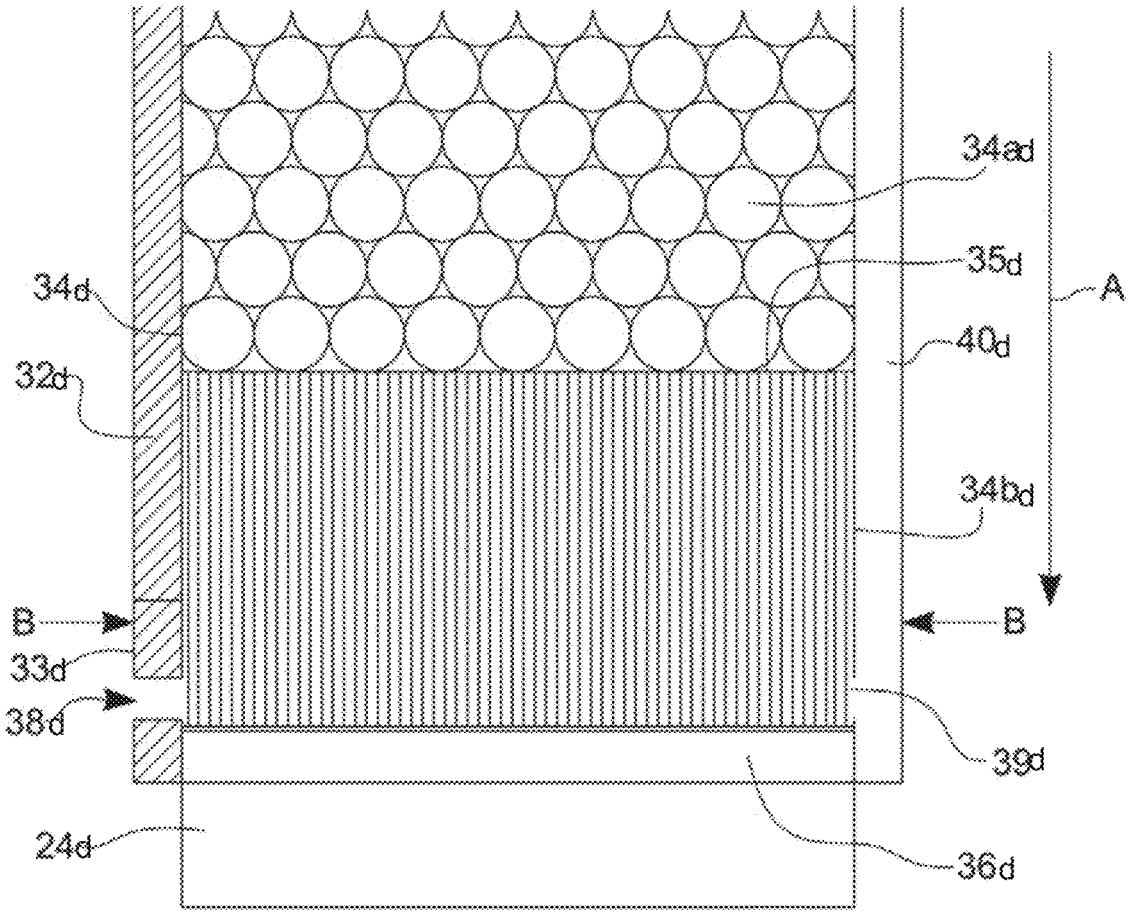
FIG. 54. is a cross-section side view of elements of an aerosol carrier and a part of an apparatus of the system for aerosol delivery according to one or more embodiments of the fifth mode of the present disclosure.
Figure 55:
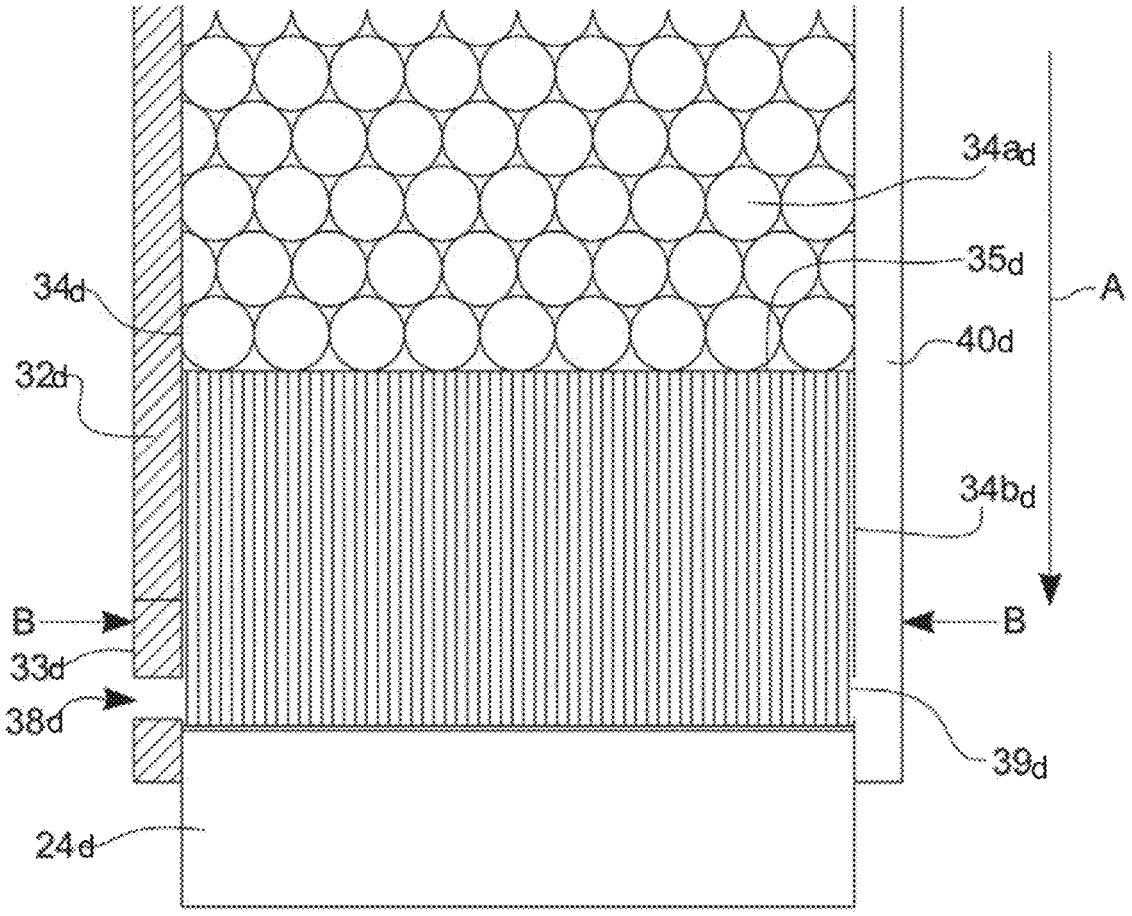
FIG. 55. is a cross-section side view of elements of an aerosol carrier and a part of an apparatus of the system for aerosol delivery according to one or more embodiments of the fifth mode of the present disclosure, in an alternative configuration from that of FIG. 54.

FIGS. 53 to 55 schematically illustrate the aerosol carrier 14*d* in more detail (and, in FIGS. 54 and 55, features within the receptacle in more detail). FIG. 4 illustrates an exterior of the aerosol carrier 14*d*, FIG. 54 illustrates internal components of the aerosol carrier 14*d* in one optional configuration, and FIG. 55 illustrates internal components of the aerosol carrier 14*d* in another optional configuration.

FIG. 53 illustrates the exterior of the aerosol carrier 14*d*, which comprises a housing 32*d* for housing said fluid-transfer article (not shown). The particular housing 32*d* illustrated in FIG. 53 comprises a tubular member, which may be generally cylindrical in form, and which is configured to be received within the receptacle of the apparatus. First end 16*d* of the aerosol carrier 14*d* is for location to oppose the heater of the apparatus, and second end 18*d* (and the region adjacent the second end 18*d*) is configured for insertion into a user's mouth.

FIG. 54 illustrates some internal components of the aerosol carrier 14*d* and of the heater 24*d* of apparatus 12*d*, in in one embodiment of the disclosure.

As described above, the aerosol carrier 14*d* comprises a fluid-transfer article 34*d*. Optionally, there may be a conduction element 36*d* (as shown in FIG. 54), being part of the heater 24*d*. In one or more arrangements, the aerosol carrier 14*d* is located within the receptacle of the apparatus such that an end of the fluid-transfer article opposes and is adjacent the heater 24*d* of the apparatus and receives heat directly from the heater 24*d* of the apparatus. When aerosol carrier 14*d* is located within the receptacle of the apparatus such that the adjacent end of the fluid-transfer article is located to oppose the heater of the apparatus, the conduction element 36*d* is disposed between the rest of the heater 24*d* and the end of the fluid-transfer article. Heat may be transferred to the end of the fluid-transfer article via conduction through conduction element 36*d* (i.e. application of heat to the activation surface is indirect).

Further components not shown in FIG. 54 comprise: an inlet conduit, via which air can be drawn into the aerosol carrier 14*d*; an outlet conduit, via which an air stream entrained with aerosol can be drawn from the aerosol carrier 14*d*; a filter element; and a reservoir for storing aerosol precursor material and for providing the aerosol precursor material to the fluid-transfer article 34*d*.

In FIG. 54, the aerosol carrier is shown as comprising the fluid-transfer article 34*d* located within housing

32. The fluid transfer article 34*d* comprises a first region 34*ad* holding an aerosol precursor. In one or more arrangements, the first region of 34*a* of the fluid transfer article 34*d* comprises a reservoir for holding the aerosol precursor. The first region 34*ad* can be the sole reservoir of the aerosol carrier 14*d*, or it can be arranged in fluid communication with a separate reservoir, where aerosol precursor is stored for supply to the first region 34*ad*. In the particular arrangement illustrated, the material forming the first region of 34*a* comprises a porous structure, whose pore diameter size may vary between one end of the first region 34*ad* and another end of the first region 34*ad*. For example, the pore diameter size may decrease from a first end remote from heater 24*d* (the upper end is as shown in the figure) to a second end. This configuration of pores having a decreasing diameter size can provide a wicking effect, which can serve to draw fluid through the first region 34*ad*, towards heater 24*d*. As mentioned above, the porous polymer material may be a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET).

Alternatively, the first region 34*ad* may be a simple liquid reservoir in the form of an empty tank for the receipt and storage of liquid aerosol precursor, rather than porous material for holding the aerosol precursor.

The fluid transfer article 34*d* also comprises a second region 34*bd*. In arrangements in which the first region 34*ad* is formed from material having a porous structure, aerosol precursor is drawn from the first region 34*ad* to the second region 34*bd* by the wicking effect of the material. Thus, the first region 34*ad* is configured to transfer the aerosol precursor to the second region 34*bd* of the article 34*d*.

The second region 34*bd* is formed of a multiplicity of fibres. The fibres may be arranged in a generally parallel manner, with small spaces therebetween. The fibres extend from an end of the first region 34*ad*, which end will be referred to as a transfer surface, towards the heater 24*d*. In FIG. 54, where the optional conduction element 36*d* is present, the fibres forming the second region 34*bd* extend to that conduction element 36*d*. However, it is possible that for them to terminate just short of the conduction element 36*d* if desired. The fibres forming the second region may be glass fibres, Kevlar fibres, etc.

Aerosol precursor within the first region 34*ad* will pass into the spaces between the fibres of the second region 34*bd*, and be drawn along the fibres by capillary action. Aerosol precursor will thus pass to end of the second region 34*bd* proximate to the conduction element 36*d*, which region of the fibres acts as an activation region for the aerosol precursor. When the heater 24*d* is active, heat will be transferred via that conduction element 36*d* to the aerosol precursor at the adjacent end of the second region 34*bd* which forms the activation region (i.e. at the ends of the fibres furthest from the transfer surface 35*d*) cause that aerosol precursor to vaporise.

FIG. 5 also illustrates an opening 38*d* in a further housing 33*d*, which opening 38*d* is in communication with the air-intake apertures 20*d*. A further opening 39*d* communicates with a duct 40*d* within the housing 32*d*, which duct 40*d* communicates with the second end 18*d*.

The further housing 33*d* supports the heater 24*d* (and optional conduction element 36*d* if present). The housing 32*d* and the further housing 33*d* are separable, e.g. along the line B-B in FIG. 54, to allow the housing 32*d*, and hence the fluid-transfer article 34*d*, to be removed from the rest of the apparatus. Since the aerosol precursor in the fluid-transfer article will be consumed as the user uses the apparatus, it will be necessary periodically to replace it. This can be done by removing the housing 32*d* from the rest of the apparatus, and refilling the aerosol precursor, or replacing the housing 32*d* with another in which the fluid-transfer article is full of aerosol precursor. The further housing 33*d* may be integral with the housing 26*d* containing the electrical energy supply 28*d*.

There is thus a fluid-flow path for air (hereinafter referred to as an air-flow pathway) between openings 38*d* and 39, linking the apertures 20*d* and the second end 18*d* of the aerosol carrier. When the user sucks or inhales, air is drawn along the air-flow pathway, along the surface of the conduction element 36*d*, and between the ends of the fibres forming in the second region 34*bd* (and between the ends of he fibres and the conduction element 36*d* if the fibres terminate just short of the conduction element 36*d*).

Aerosol precursor which has reached the ends of the fibres of the second region 34*bd* and has been heated and transferred by the conduction element 36*d* will pass into the air flowing in the air-flow pathway between the openings 38*d* and 39. The vapour or mixture passes, as the user sucks and inhales, to the second end 18*d*. This has the effect of removing aerosol precursor from the ends of the fibres proximate the conduction element 36*d*. This will have the effect of drawing further aerosol precursor down the fibres from the transfer surface 35*d*. There may also be a low-pressure effect due to the movement of the air along the air-flow pathway, which draws fluid along the fibres to the conduction element 36*d*. There may be a small gap between the ends of the fibres forming the second region of 34*b* and the conduction element 36*d*, with the air flow is through that space. However, it is preferable that the fibres of the second region 34*bd* extend to the conduction element 36*d*, to ensure maximum heat transfer to the aerosol precursor. In either case, the air-flow pathway will pass around the ends of the fibres, in the small spaces between the fibres, to enable vapour and/or aerosol and vapour mixture to enter the air flow. The spacing between each of the fibres is desirably chosen so as to facilitate that air flow, but also to create a capillary effect which will transfer aerosol precursor from the transfer surface 35*d*.

As noted above, the conduction element 36*d* may be absent in some arrangements.

The conduction element 36*d*, if present, may comprise a thin film of thermally conductive material, such as, for example, a metal foil (for example, aluminium, brass, copper, gold, steel, silver, or an alloy comprising anyone of the foregoing together with thermally conductive plastics and/or ceramics).

In the illustrative examples of FIG. 54, the first region 34*ad* of the fluid-transfer article 34*d* is located at an "upstream" end of the fluid-transfer article 34*d* and the second region 34*bd* is located at a downstream" end of the fluid-transfer article 34*d*. That is, aerosol precursor is wicked, or is drawn, from the "upstream" end of the fluid-transfer article 34*d* to the "downstream" end of the fluid-transfer article 34*d* (as denoted by arrow A in FIG. 54).

As mentioned above, the conduction element 36*d* need not be present. FIG. 55 illustrates an embodiment corresponding to that of FIG. 54, but without such a conduction element 36*d*. The arrangement of FIG. 55 is otherwise similar to that of FIG. 54, and corresponding parts are indicated by the same reference numerals.

Figure 56:
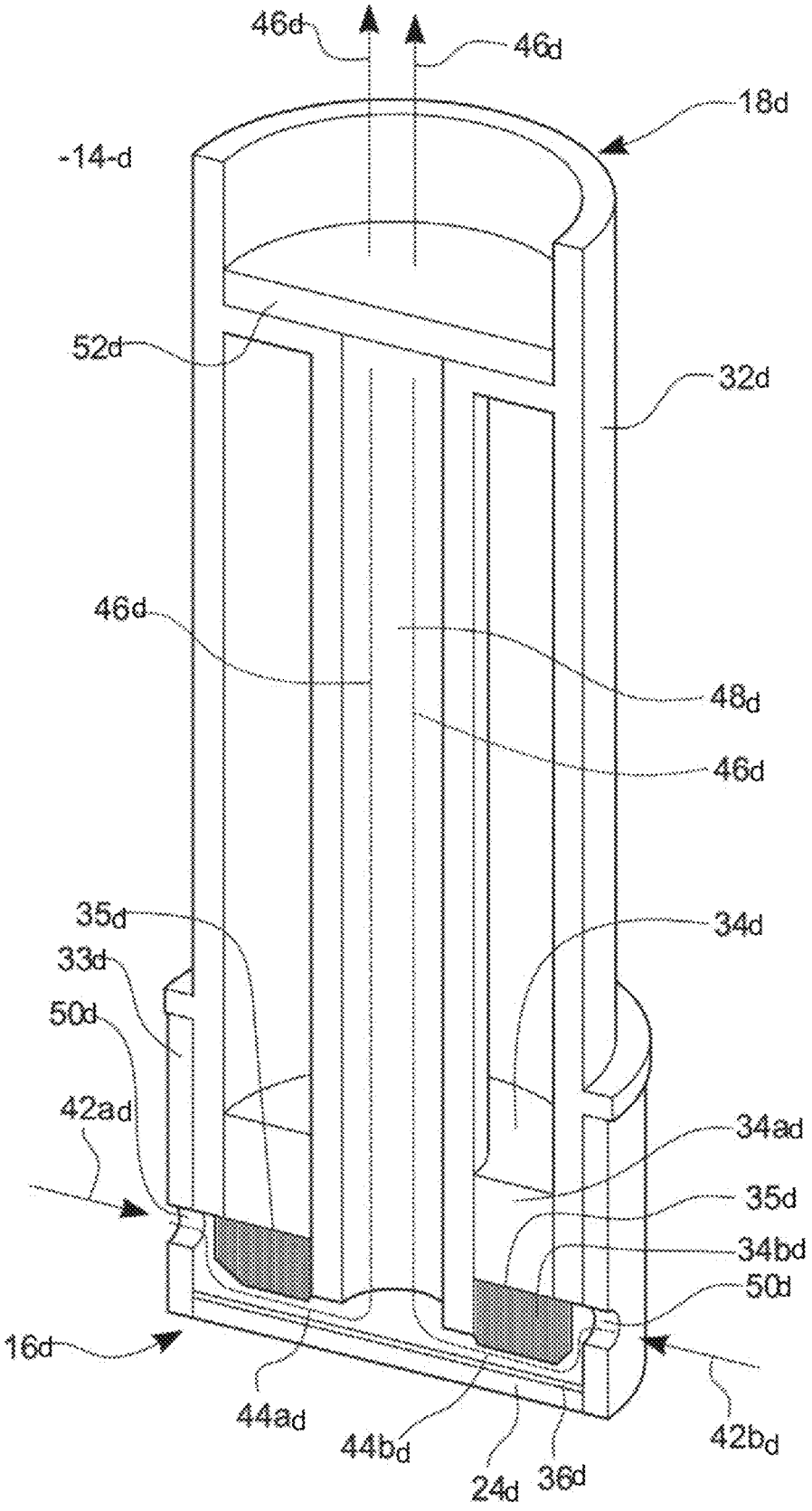
FIG. 56. is a cross-section side view of aerosol carrier according to one or more embodiments of the fifth mode of the present disclosure.
Figure 57:
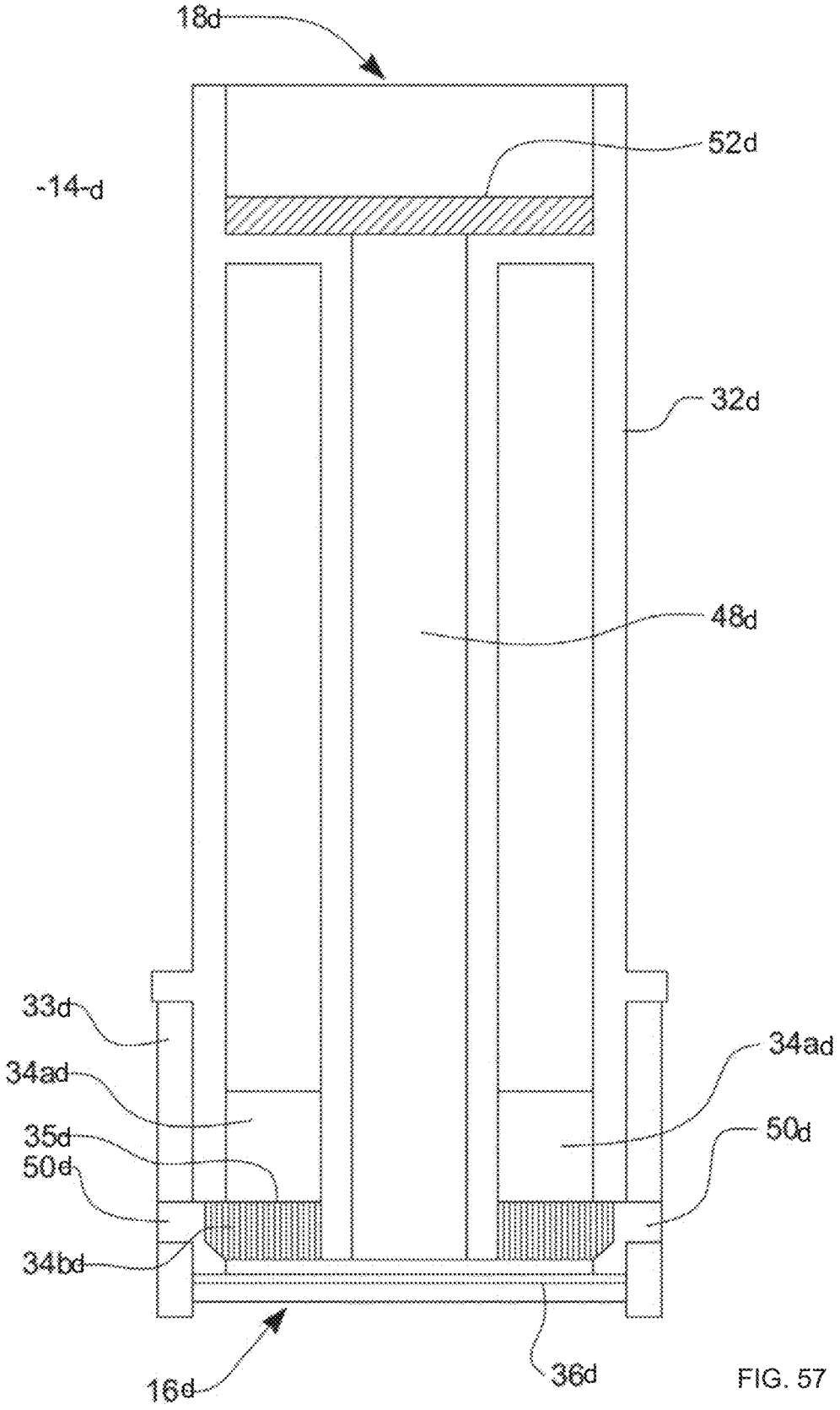
FIG. 57. is a perspective cross-section side view of the aerosol carrier of FIG. 56.

In the arrangements shown in FIGS. 54 and 55, the apertures 38*d*, 39*d* are on opposite sides of the housing FIGS. 56 and 57 shows an alternative configuration, in which the fluid-transfer article is annular, and the second part 34*bd* is then in the form of annular diaphragm. Note that, in FIGS. 56 and 57, the ends of the fibres forming the second part 34*bd* are illustrated terminating just short of the conduction element 36*d*. This is a possible arrangement, but it is also possible that the fibres extend to the conduction surface 36, as in the arrangements of FIGS. 54 and 55. The small space between the ends of the fibres and the conduction surface 36*d* in FIGS. 56 and 57 is shown to enable the air flow in the apparatus to be illustrated. Thus, FIGS. 56 and 57 illustrate an aerosol carrier 14*d* according to one or more possible arrangements in more detail. FIG. 56 is a cross-section side view illustration of the aerosol carrier 14*d* and FIG. 57 is a perspective cross-section side view illustration of the aerosol carrier 14*d*.

As can be seen from FIGS. 56 and 57, the aerosol carrier 14*d* is generally tubular in form. The aerosol carrier 14*d* comprises housing 32*d*, which defines the external walls of the aerosol carrier 14*d* and which defines therein a chamber in which are disposed the fluid-transfer article 34*d* (adjacent the first end 16*d* of the aerosol carrier 14*d*) and internal walls defining the fluid communication pathway 48*d*. Fluid communication pathway 48*d* defines a fluid pathway for an outgoing air stream from the channels 40*d* to the second end 18*d* of the aerosol carrier 14*d*. In the examples illustrated in FIGS. 56 and 57, the fluid-transfer article 34*d* is an annular shaped element located around the fluid communication pathway 48*d*. As in the arrangements of FIGS. 54 and 55, the heater 24*d* (and optional conduction element 36*d* if present) are mounted in a further housing 33*d*, which further housing 33*d* is separable from the housing 32*d* containing the fluid-transfer article.

In walls of the further housing 33*d*, there are provided inlet apertures 50*d* to provide a fluid communication pathway for an incoming air stream to reach the fluid-transfer article 34*d*, and particularly the air-flow pathway defined across the surface of the conduction element 36*d* (or across the surface of the heater 24*d*), and passing among the ends of the fibres forming the second region 34*bd* of the aerosol-transfer article 34*d*.

In the illustrated example of FIGS. 56 and 57, the aerosol carrier 14*d* further comprises a filter element 52*d*. The filter element 52*d* is located across the fluid communication pathway 48*d* such that an outgoing air stream passing through the fluid communication pathway 48*d* passes through the filter element 52*d*.

With reference to FIG. 57, when a user sucks on a mouthpiece of the apparatus (or on the second end 18*d* of the aerosol carrier 14*d*, if configured as a mouthpiece), air is drawn into the carrier through inlet apertures 50*d* extending through walls in the housing 32*d* of the aerosol carrier 14*d*.

An incoming air stream 42*ad* from a first side of the aerosol carrier 14*d* is directed to a first side of the second part 34*bd* of the fluid-transfer article 34*d* (e.g. via a gas communication pathway within the housing of the carrier). An incoming air stream 42*bd* from a second side of the aerosol carrier 14*d* is directed to a second side of the second part 34*bd* of the fluid-transfer article 34*d* (e.g. via a gas communication pathway within the housing of the carrier). When the incoming air stream 42*ad* from the first side of the aerosol carrier 14*d* reaches the first side of the second part 34*bd*, the incoming air stream 42*ad* from the first side of the aerosol carrier 14*d* flows around the ends of the fibres of the second part 34*bd* across the conduction element 36*d* (or across the heater 24*d*). Likewise, when the incoming air stream 42*bd* from the second side of the aerosol carrier 14*d* reaches the second side of the second part 34*bd*, the incoming air stream 42*bd* from the second side of the aerosol carrier 14*d* flows around the ends of the fibres of the second part 34*bd* across the conduction element 36*d* (or across heater 24*d*). The air streams from each side are denoted by dashed lines 44*ad* and 44*b* in FIG. 57. As these air streams 44*ad* and 44*b* flow, aerosol precursor at the ends of the fibres or on the conduction element 36*d* (or on the heater 24*d*) is entrained in air streams 44*ad* and 44*b*.

In use, the heater 24*d* of the apparatus 12*d* to raise a temperature of the conduction element 36*d* to a sufficient temperature to release, or liberate, captive substances (i.e. the aerosol precursor) to form a vapour and/or aerosol, which is drawn downstream. As the air streams 44*ad* and 44*b* continue their passages, more released aerosol precursor is entrained within the air streams 44*ad* and 44*b*. When the air streams 44*ad* and 44*b* entrained with aerosol precursor meet at a mouth of the outlet fluid communication pathway 48*d*, they enter the outlet fluid communication pathway 48*d* and continue until they pass through filter element 52*d* and exit outlet fluid communication pathway 48*d*, either as a single outgoing air stream, or as separate outgoing air streams 46*d* (as shown). The outgoing air streams 46*d* are directed to an outlet, from where it can be inhaled by the user directly (if the second end 18*d* of the aerosol capsule 14*d* is configured as a mouthpiece), or via a mouthpiece. The outgoing air streams 46*d* entrained with aerosol precursor are directed to the outlet (e.g. via a gas communication pathway within the housing of the carrier).

Figure 58:
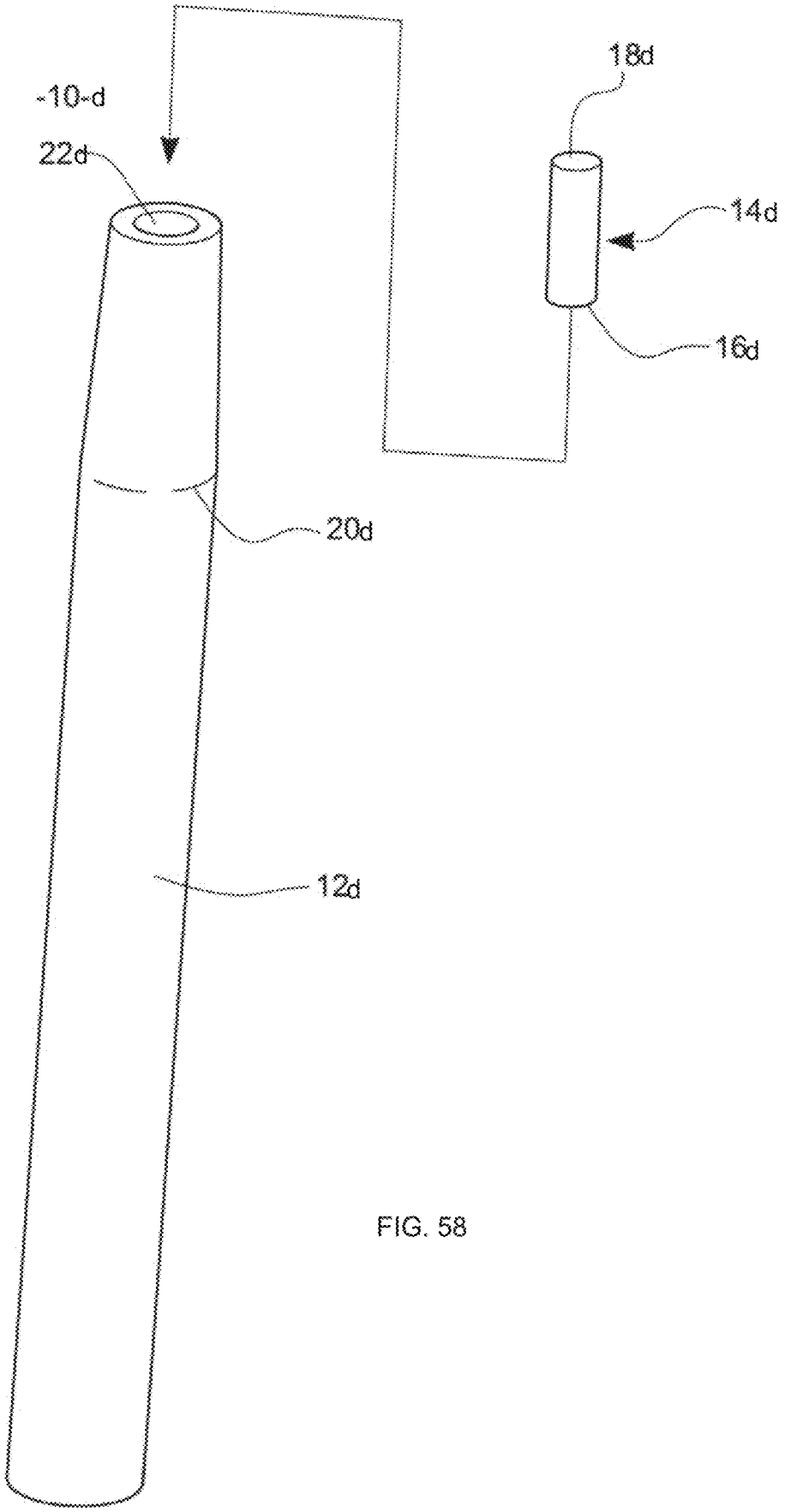
FIG. 58. is an exploded perspective view illustration of a kit-of-parts for assembling the system according to one or more embodiments of the fifth mode of the present disclosure.

FIG. 58 is an exploded perspective view illustration of a kit-of-parts for assembling an aerosol delivery system 10*d*.

Sixth Mode of the Disclosure

In general outline, one or more embodiments in accordance with the present disclosure may provide a system for aerosol delivery in which an aerosol carrier may be inserted into a receptacle (e.g. a "heating chamber") of an apparatus for initiating and maintaining release of an aerosol from the aerosol carrier. Another end, or another end portion, of the aerosol carrier may protrude from the apparatus and can be inserted into the mouth of a user for the inhalation of aerosol released from the aerosol carrier cartridge during operation of the apparatus.

Hereinafter, and for convenience only, "system for aerosol delivery" shall be referred to as "aerosol delivery system".

Figure 59:
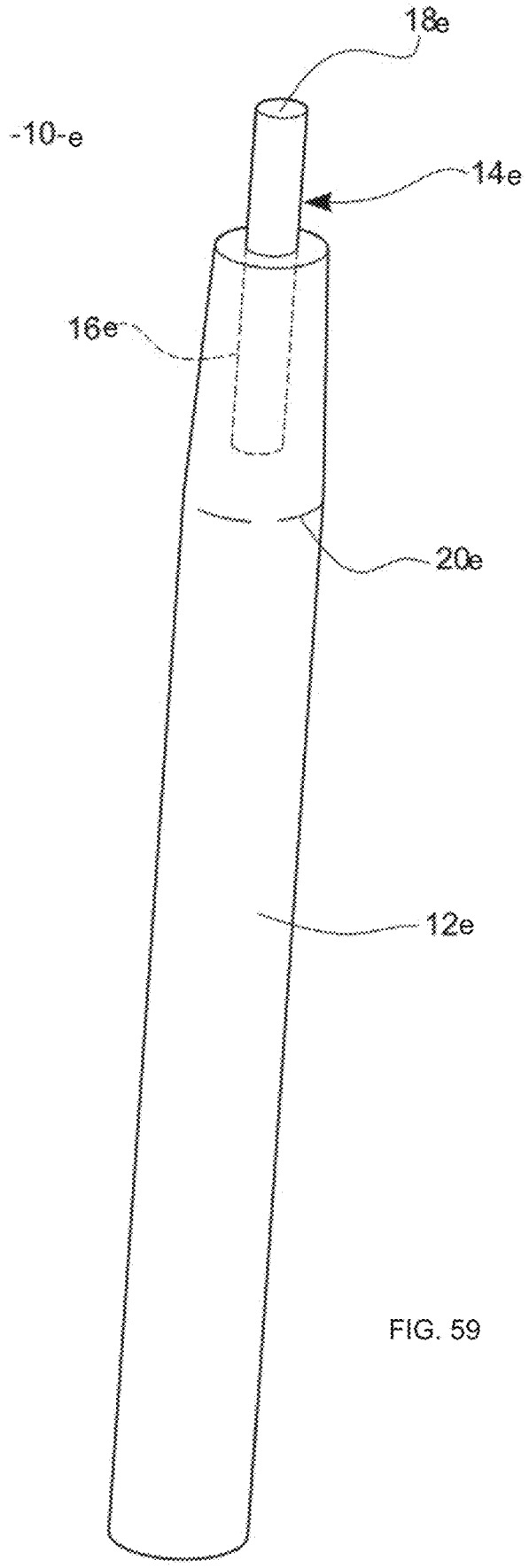
FIG. 59 is a perspective view illustration of a system for aerosol delivery according to one or more embodiments of the sixth mode of the present disclosure.

Referring now to FIG. 59, there is illustrated a perspective view of an aerosol delivery system 10*e* comprising an aerosol generation apparatus 12*e* operative to initiate and maintain release of aerosol from a fluid-transfer article in an aerosol carrier 14*e*. In the arrangement of FIG. 59, the aerosol carrier 14*e* is shown with a first end 16*e* thereof and a portion of the length of the aerosol carrier 14*e* located within a receptacle of the apparatus 12*e*. A remaining portion of the aerosol carrier 14*e* extends out of the receptacle. This remaining portion of the aerosol carrier 14*e*, terminating at a second end 18*e* of the aerosol carrier, is configured for insertion into a user's mouth. A vapour and/or aerosol is produced when a heater (not shown in FIG. 59) of the apparatus 12*e* heats a fluid-transfer article in the aerosol carrier 14*e* to release a vapour and/or an aerosol, and this can be delivered to the user, when the user sucks or inhales, via a fluid passage in communication with an outlet of the aerosol carrier 14*e* from the fluid-transfer article to the second end 18*e*.

The device 12*e* also comprises air-intake apertures 20*e* in the housing of the apparatus 12*e* to provide a passage for air to be drawn into the interior of the apparatus 12*e* (when the user sucks or inhales) for delivery to the first end 16*e* of the aerosol carrier 14*e*, so that the air can be drawn through an activation region of a fluid-transfer article located within a housing of the aerosol carrier cartridge 14*e* during use. Optionally, these apertures may be perforations in the housing of the apparatus 12*e*.

A fluid-transfer article (not shown in FIG. 59, but described hereinafter with reference to FIGS. 63 to 66 is located within a housing of the aerosol carrier 14*e*. The fluid-transfer article contains an aerosol precursor material, which may include at least one of: nicotine; a nicotine precursor material; a nicotine compound; and one or more flavourings. The fluid-transfer article is located within the housing of the aerosol carrier 14*e* to allow air drawn into the aerosol carrier 14*e* at, or proximal, the first end 16*e* to flow at an activation region of the fluid-transfer article. As air passes through the activation region of the fluid-transfer article, an aerosol may be entrained in the air stream from a substrate forming the fluid-transfer article, e.g. via diffusion from the substrate to the air stream and/or via vaporisation of the aerosol precursor material and release from the fluid-transfer article under heating.

The fluid-transfer article 34*e* comprises a first region which may be of a porous material where pores of the porous material hold, contain, carry, or bear the aerosol precursor material, and a second region formed of a multiplicity of fibres. In particular, the porous material of the fluid-transfer article may be a porous polymer material such as, for example, a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET). All such materials may be described as heat resistant polymeric wicking material in the context of the present disclosure.

The aerosol carrier 14*e* is removable from the apparatus 12*e* so that it may be disposed of when expired. After removal of a used aerosol carrier 14*e*, a replacement aerosol carrier 14*e* can be inserted into the apparatus 12*e* to replace the used aerosol carrier 14*e*.

Figure 60:
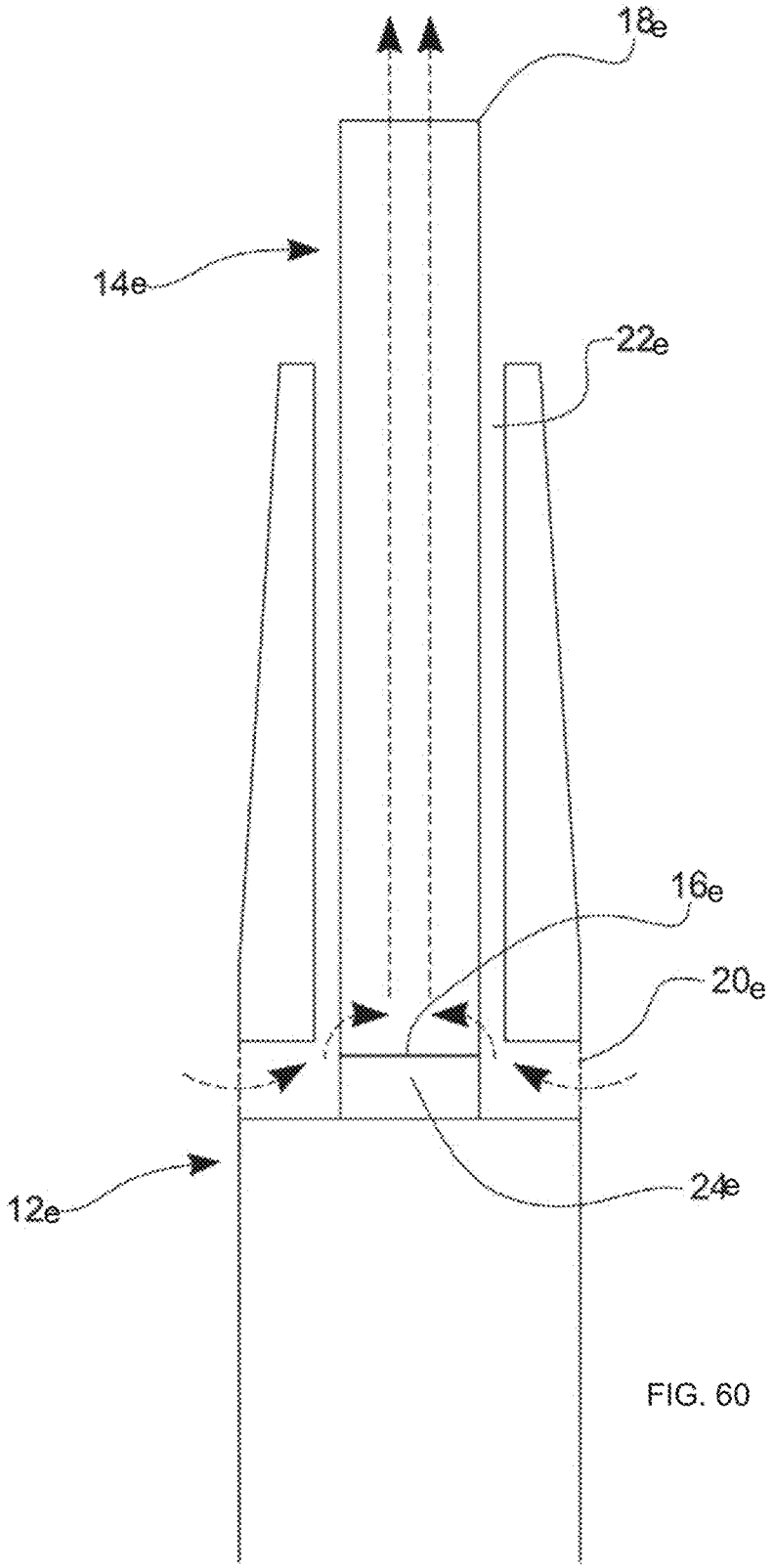
FIG. 60 is a cross-section side view illustration of part of an apparatus of the system for aerosol delivery of FIG. 59.

FIG. 60 is a cross-sectional side view illustration of a part of apparatus 12*e* of the aerosol delivery system

10. The apparatus 12*e* comprises a receptacle 22*e* in which is located a portion of the aerosol carrier 14*e*. In one or more optional arrangements, the receptacle 22*e* may enclose the aerosol carrier 14*e*. The apparatus 12*e* also comprise a heater 24*e*, which opposes an activation region of the fluid-transfer article (not shown in FIG. 60) of the aerosol carrier 14*e* when an aerosol carrier 14*e* is located within the receptacle 22*e*.

Air flows into the apparatus 12*e* (in particular, into a closed end of the receptacle 22*e*) via air-intake apertures 20*e*. From the closed end of the receptacle 22*e*, the air is drawn into the aerosol carrier 14*e* (under the action of the user inhaling or sucking on the second end 18*e*) and expelled at the second end 18*e*. As the air flows into the aerosol carrier 14*e*, it passes an end of the fluid-transfer article or across that end.

Heat from the heater 24*e*, which opposes that end of the fluid-transfer article (the activation region), causes vaporisation of aerosol precursor material at the end of the fluid-transfer article and an aerosol is created in the air flow. Thus, through the application of heat in the region of the end of the fluid-transfer article, an aerosol is released, or liberated, from the fluid-transfer article, and is drawn from the material of the aerosol carrier unit by the air flow and is transported in the air flow to via outlet conduits (not shown in FIG. 60) in the housing of the aerosol carrier 14*e* to the second end 18*e*. The direction of air flow is illustrated by arrows in FIG. 60.

To achieve release of the captive aerosol from the fluid-transfer article, the fluid-transfer article of the aerosol carrier 14*e* is heated by the heater 24*e*. As a user sucks or inhales on second end 18*e* of the aerosol carrier 14*e*, the aerosol released from the fluid-transfer article and entrained in the air is drawn through the outlet conduits (not shown) in the housing of the aerosol carrier 14*e* towards the second end 18*e* and onwards into the user's mouth.

Figure 61:
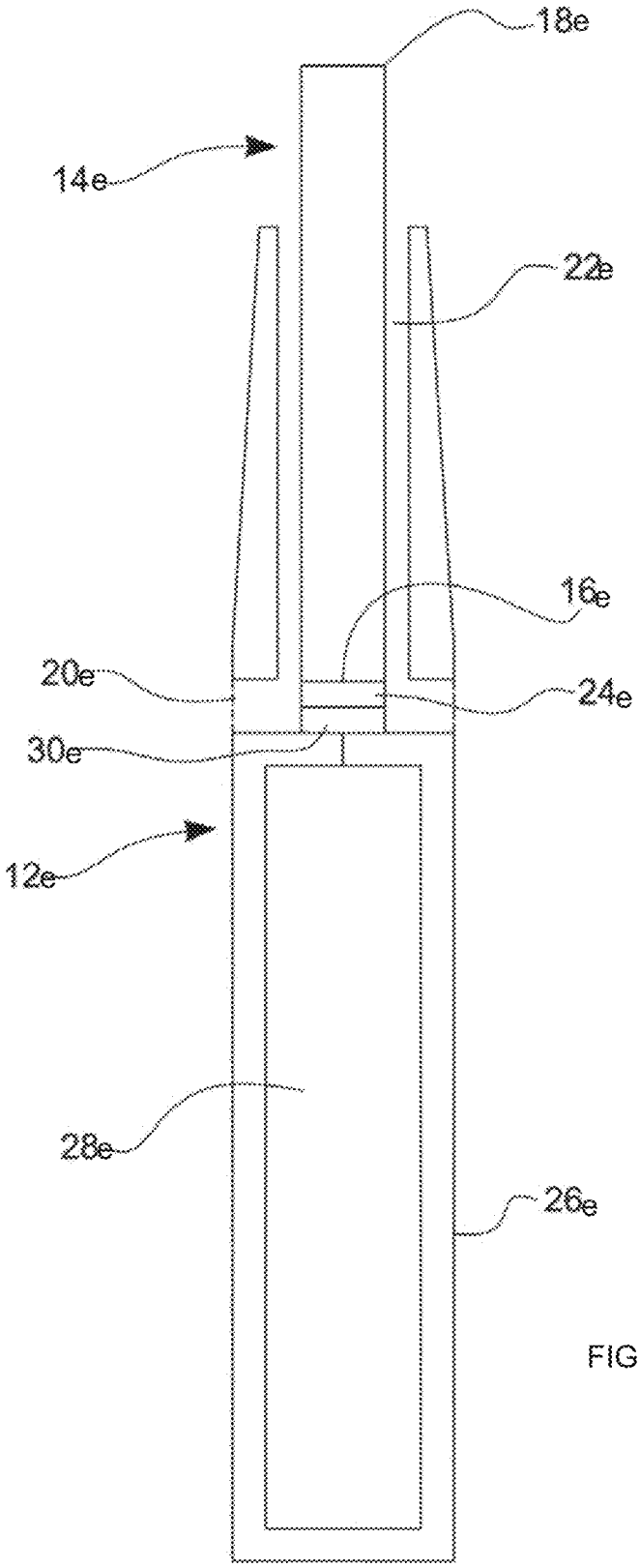
FIG. 61 is a cross-section side view illustration of the system and apparatus for aerosol delivery of FIG. 59.

Turning now to FIG. 61, a cross-sectional side view of the aerosol delivery system 10*e* is schematically illustrated showing the features described above in relation to FIGS. 59 and 60 in more detail. As can be seen, apparatus 12*e* comprises a housing 26*e*, in which are located the receptacle 22*e* and heater 24*e*. The housing 26*e* also contains control circuitry (not shown) operative by a user, or upon detection of air and/or vapour being drawn into the device 12*e* through air-intake apertures 20*e*, i.e. when the user sucks or inhales. Additionally, the housing 26*e* comprises an electrical energy supply 28*e*, for example a battery. Optionally, the battery comprises a rechargeable lithium ion battery. The housing 26*e* also comprises a coupling 30*e* for electrically (and optionally mechanically) coupling the electrical energy supply 28*e* to control circuitry (not shown) for powering and controlling operation of the heater 24*e*.

Responsive to activation of the control circuitry of apparatus 12*e*, the heater 24*e* heats the fluid-transfer article (not shown in FIG. 61) of aerosol carrier 14*e*. This heating process initiates (and, through continued operation, maintains) release of vapour and/or an aerosol from the end of the fluid-transfer article adjacent the heater. The vapour and/or aerosol formed as a result of the heating process is entrained into a stream of air being drawn across the heating surface of the heater (as the user sucks or inhales). The stream of air with the entrained vapour and/or aerosol passes through the aerosol carrier 14*e* via outlet conduits (not shown) and exits the aerosol carrier 14*e* at second end 18*e* for delivery to the user. This process is briefly described above in relation to FIG. 60, where arrows schematically denote the flow of the air stream into the device 12*e* and through the aerosol carrier 14*e*, and the flow of the air stream with the entrained vapour and/or aerosol through the aerosol carrier cartridge 14*e*.

Figure 62:
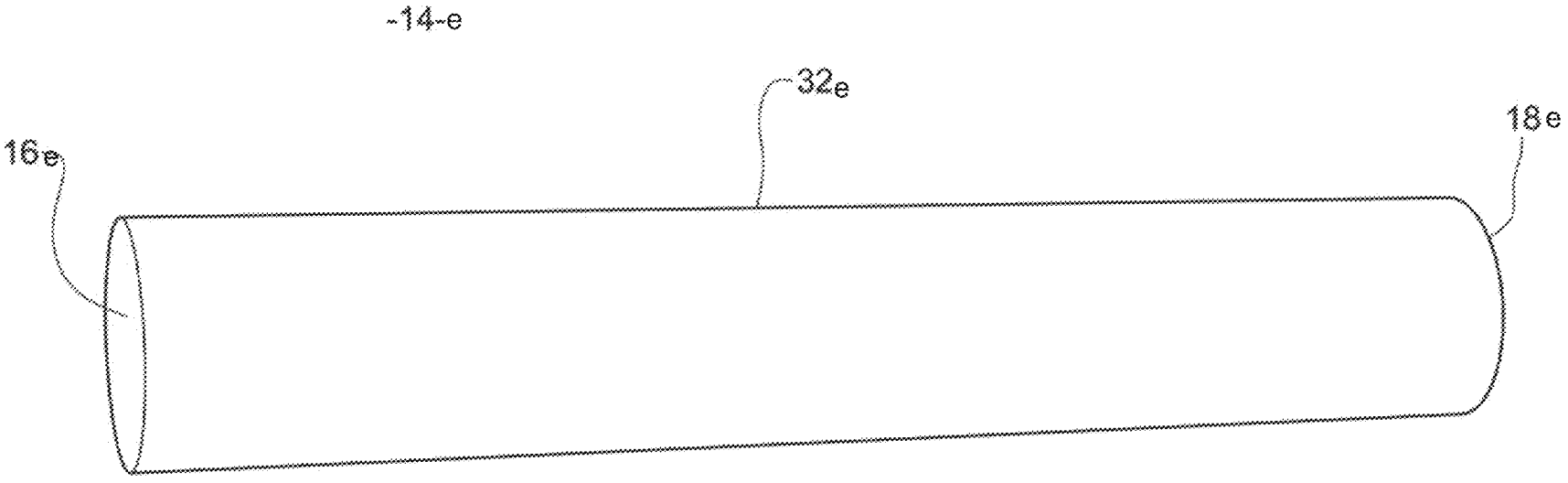
FIG. 62 is a perspective view illustration of an aerosol carrier for use in the system for aerosol delivery according to one or more embodiments of the sixth mode of the present disclosure.
Figure 63:
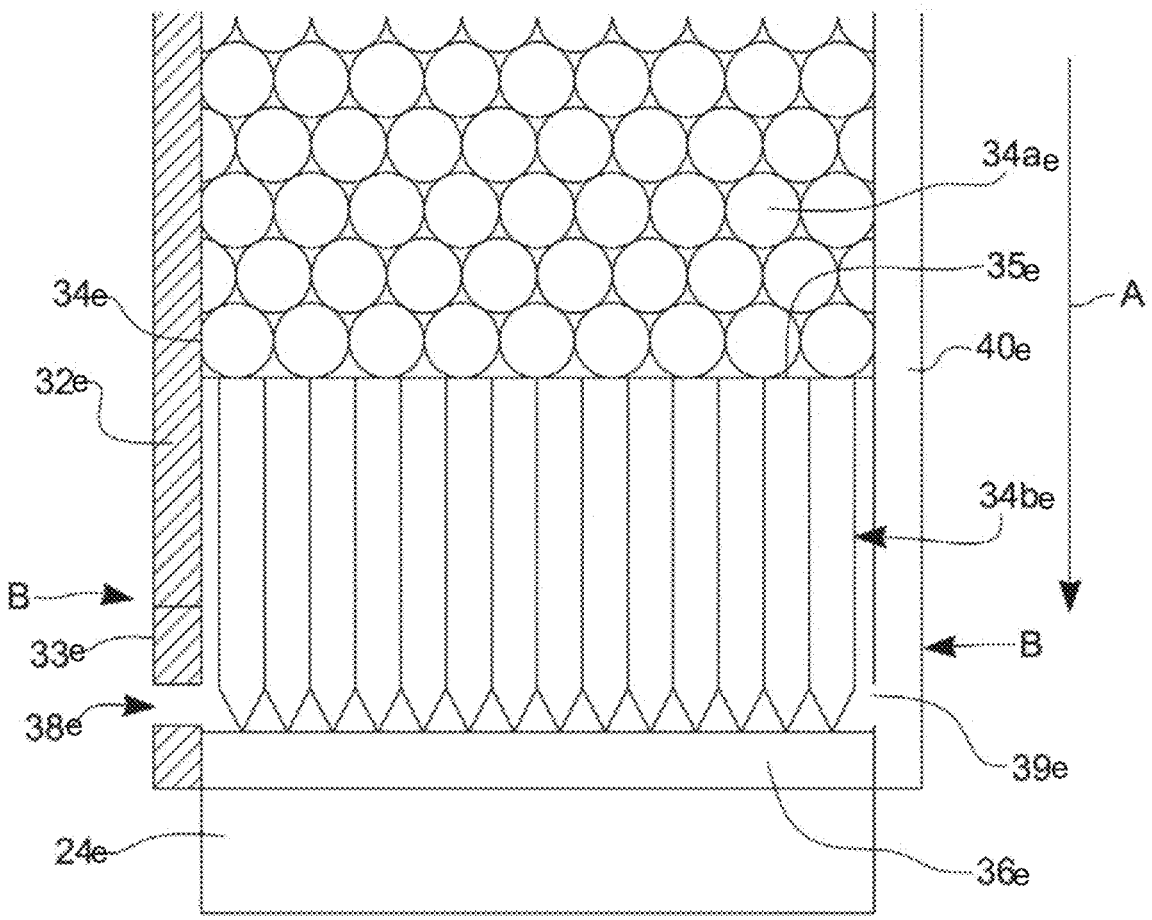
FIG. 63 is a cross-section side view of elements of an aerosol carrier and a part of an apparatus of the system for aerosol delivery according to one or more embodiments of the sixth mode of the present disclosure.
Figure 64:
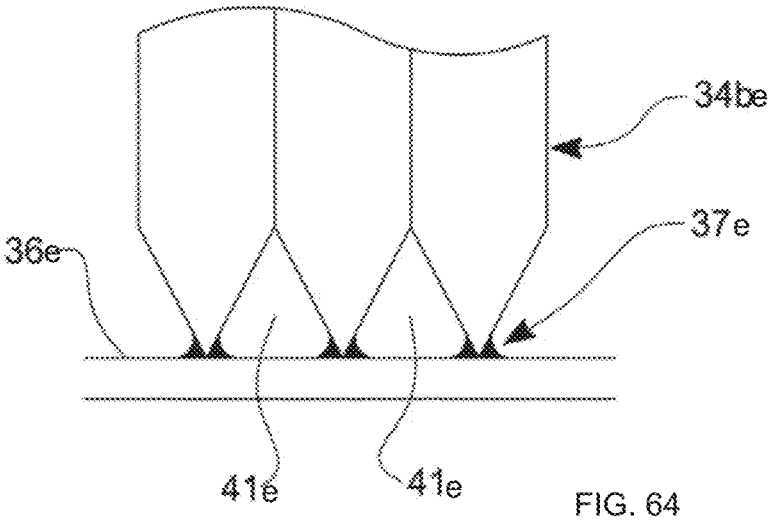
FIG. 64 is a detailed view of the ends of some of the capillary tubes, in FIG. 63.
Figure 65:
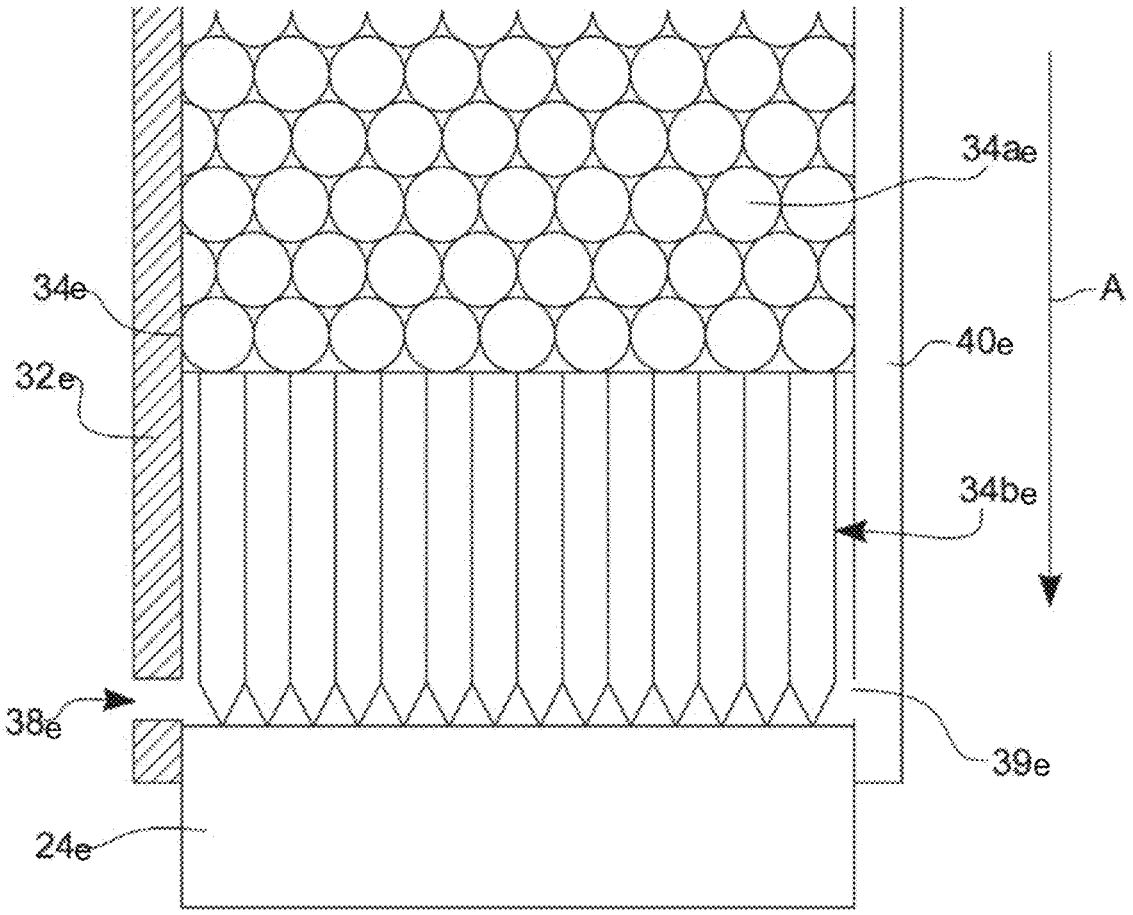
FIG. 65 is a cross-section side view of elements of an aerosol carrier and a part of an apparatus of the system for aerosol delivery according to one or more embodiments of the present disclosure, in an alternative configuration from that of FIG. 63.

FIGS. 62 to 65 schematically illustrate the aerosol carrier 14*e* in more detail (and, in FIGS. 63 to 65, features within the receptacle in more detail). FIG. 62 illustrates an exterior of the aerosol carrier 14*e*, FIG. 63 illustrates internal components of the aerosol carrier 14*e* in one optional configuration, FIG. 64 shows a detail of part of FIG. 63, and FIG. 65 illustrates internal components of the aerosol carrier 14*e* in another optional configuration.

FIG. 62 illustrates the exterior of the aerosol carrier 14*e*, which comprises a housing 32*e* for housing said fluid-transfer article (not shown). The particular housing 32*e* illustrated in FIG. 62 comprises a tubular member, which may be generally cylindrical in form, and which is configured to be received within the receptacle of the apparatus. First end 16*e* of the aerosol carrier 14*e* is for location to oppose the heater of the apparatus, and second end 18*e* (and the region adjacent the second end 18*e*) is configured for insertion into a user's mouth.

FIG. 63 illustrates some internal components of the aerosol carrier 14*e* and of the heater 24*e* of apparatus 12*e*, in in one embodiment of the disclosure.

As described above, the aerosol carrier 14*e* comprises a fluid-transfer article 34*e*. Optionally, there may be a conduction element 36*e* (as shown in FIG. 63), being part of the heater 24*e*. In one or more arrangements, the aerosol carrier 14*e* is located within the receptacle of the apparatus such that an end of the fluid-transfer article opposes and is adjacent the heater 24*e* of the apparatus and receives heat directly from the heater 24*e* of the apparatus. When aerosol carrier 14*e* is located within the receptacle of the apparatus such that the adjacent end of the fluid-transfer article is located to oppose the heater of the apparatus, the conduction element 36*e* is disposed between the rest of the heater 24*e* and the end of the fluid-transfer article. Heat may be transferred to the end of the fluid-transfer article via conduction through conduction element 36*e* (i.e. application of heat to the activation surface is indirect).

Further components not shown in FIG. 63 comprise: an inlet conduit, via which air can be drawn into the aerosol carrier 14*e*; an outlet conduit, via which an air stream entrained with aerosol can be drawn from the aerosol carrier 14*e*; a filter element; and a reservoir for storing aerosol precursor material and for providing the aerosol precursor material to the fluid-transfer article 34*e*.

In FIG. 63, the aerosol carrier is shown as comprising the fluid-transfer article 34*e* located within housing

32*e*. The fluid transfer article 34*e* comprises a air streams 44*ae* holding an aerosol precursor. In one or more arrangements, the first region of 34*a* of the fluid transfer article 34*e* comprises a reservoir for holding the aerosol precursor. The air streams 44*ae* can be the sole reservoir of the aerosol carrier 14*e*, or it can be arranged in fluid communication with a separate reservoir, where aerosol precursor is stored for supply to the air streams 44*ae*. In the particular arrangement illustrated, the material forming the first region of 34*a* comprises a porous structure, whose pore diameter size may vary between one end of the first region 34*ae* and another end of the air streams 44*ae*. For example, the pore diameter size may decrease from a first end remote from heater 24*e* (the upper end is as shown in the figure) to a second end. This configuration of pores having a decreasing diameter size can provide a wicking effect, which can serve to draw fluid through the air streams 44*ae*, towards heater 24*e*. As mentioned above, the porous polymer material may be a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET).

Alternatively, the air streams 44*ae* may be a simple liquid reservoir in the form of an empty tank for the receipt and storage of liquid aerosol precursor, rather than porous material for holding the aerosol precursor.

The fluid transfer article 34*e* also comprises air streams 44*ae*. In arrangements in which the air streams 44*ae* is formed from material having a porous structure, aerosol precursor is drawn from the first region of 34*a* to the air streams 44*ae* by the wicking effect of the material forming the first region of 34*a*. Thus, the air streams 44*ae* is configured to transfer the aerosol precursor to the air streams 44*ae* of the article 34*e*.

The air streams 44*ae* is formed of a multiplicity of capillary tubes. The capillary tubes may be arranged in a generally parallel manner. The capillary tubes extend from an end of the air streams 44*ae*, towards the heater 24*e*. In FIG. 5, where the air streams 44*ae* conduction element 36*e* is present, the capillary tubes forming the air streams 44*ae* extend to that conduction element 36*e*. However, it is possible that for them to terminate just short of the conduction element 36*e* if desired. The capillary tubes forming the second region may be glass, but are preferably of a high temperature polymer and with adjacent capillary tubes in contact with each other. The ends of capillary tubes thus form a two-dimensional array at the conduction element 36*e*.

Aerosol precursor within the air streams 44*ae* will pass into the capillary bores within the capillary tubes of the air streams 44*ae*, and be drawn along the capillary tubes by capillary action. Aerosol precursor will thus pass to end of the air streams 44*ae* proximate to the conduction element 36*e*, which region of the capillary tubes acts as an activation region for the aerosol precursor. When the heater 24*e* is active, heat will be transferred via that conduction element 36*e* to the aerosol precursor at the adjacent end of the air streams 44*ae* which forms the activation region (i.e. at the ends of the capillary tubes furthest from the transfer surface 35*e*) and cause that aerosol precursor to vaporise.

FIG. 64 then illustrates a close-up of the ends of some of the capillary tubes forming the air streams 44*ae*, adjacent the conduction element 36*e*. It can be seen that the ends of the capillary tubes are tapered so that their ends form a cone or frusto-cone. Aerosol precursor passes down the bores of the capillary tubes to the ends that are adjacent the heating surface, and air streams 44*ae* on the conduction element 36*e* around the ends of the capillary tubes. To enable this to happen, there may be a very small gap between the ends of the capillary tubes and the conduction element 36*e*, to allow liquid to pass to the conduction element 36*e* and to form the air streams 44*ae*.

FIG. 64 also shows that the tapering of the ends of the capillary tubes forming the air streams 44*ae* creates air streams 44*ae* between the ends of the capillary tubes through which air can flow. Air streams 44*ae* permit there to be an air-flow pathway along the conduction element 36*e*, even if the capillary tubes forming the air streams 44*ae* are in contact along the majority of their length. The region of the ends of the capillary tubes adjacent the conduction element 36*e*, with the air streams 44*ae*, form an activation region for the aerosol precursor, which the aerosol precursor will be heated when the heater 24*e* is active.

FIG. 63 also illustrates an air streams 44*ae* in a further housing 33*e*, which air streams 44*ae* is in communication with the air-intake apertures 20*e*. A further air streams 44*ae* communicates with air streams 44*ae* within the housing 32*e*, which air streams 44*ae* communicates with the second end 18*e*.

The further housing 33*e* supports the heater 24*e* (and air streams 44*ae* conduction element 36*e* if present). The housing 32*e* and the further housing 33*e* are separable, e.g. along the line B-B in FIG. 63, to allow the housing 32*e*, and hence the fluid-transfer article 34*e*, to be removed from the rest of the apparatus. Since the aerosol precursor in the fluid-transfer article will be consumed as the user uses the apparatus, it will be necessary periodically to replace it. This can be done by removing the housing 32*e* from the rest of the apparatus, and refilling the aerosol precursor, or replacing the housing 32*e* with another in which the fluid-transfer article is full of aerosol precursor. The further housing 33*e* may be integral with the housing 26*e* containing the electrical energy supply 28*e*.

There is thus a fluid-flow path for air (hereinafter referred to as an air-flow pathway) between air streams 44*ae* and 39*e*, linking the apertures 20*e* and the second end 18*e* of the aerosol carrier. When the user sucks or inhales, air is drawn along the air-flow pathway, along the surface of the conduction element 36*e*, and between the ends of the capillary tubes forming in the air streams 44*ae* (and between the ends of the capillary tubes and the conduction element 36*e* if the capillary tubes terminate just short of the conduction element 36*e*).

Aerosol precursor which has reached the ends of the capillary tubes of the air streams 44*ae*, such as at the air streams 44*ae* in FIG. 64, and has been heated by the conduction element 36*e* will pass into the air flowing in the air-flow pathway between the air streams 44*ae* and 39*e* as a vapour or mixture of vapour and aerosol. The vapour or mixture passes, as the user sucks and inhales, to the second end 18*e*. This has the effect of removing aerosol precursor from the ends of the capillary tubes and the air streams 44*ae* proximate the conduction element 36*e*. This will have the effect of drawing further aerosol precursor down the capillary tubes from the transfer surface 35*e*. There may also be a low-pressure effect due to the movement of the air along the air-flow pathway, which draws fluid along the fibres to the conduction element 36*e*. As mentioned above there may be a small gap between the ends of the capillary tubes forming the second region of 34*b* and the conduction element 36*e*, with the air flow through the space thus formed, and in the air streams 44*ae* formed by the tapering of the ends of the capillary tubes. The air-flow pathway will pass around the ends of the capillary tubes, in the air streams 44*ae* between the ends of the capillary tubes, to enable vapour and/or aerosol and vapour mixture to enter the air flow.

As noted above, the conduction element 36*e* may be absent in some arrangements.

The conduction element 36*e*, if present, may comprise a thin film of thermally conductive material, such as, for example, a metal foil (for example, aluminum, brass, copper, gold, steel, silver, or an alloy comprising anyone of the foregoing together with thermally conductive plastics and/or ceramics).

In the illustrative examples of FIG. 63, the air streams 44*ae* of the fluid-transfer article 34*e* is located at an "upstream" end of the fluid-transfer article 34*e* and the air streams 44*ae* is located at a downstream" end of the fluid-transfer article 34*e*. That is, aerosol precursor is wicked, or is drawn, from the "upstream" end of the fluid-transfer article 34*e* to the "downstream" end of the fluid-transfer article 34*e* (as denoted by arrow A in FIG. 63).

As mentioned above, the conduction element 36*e* need not be present. FIG. 65 illustrates an embodiment corresponding to that of FIG. 63, but without such a conduction element 36*e*. The arrangement of FIG. 64 is otherwise similar to that of FIG. 63, and corresponding parts are indicated by the same reference numerals.

Figure 66:
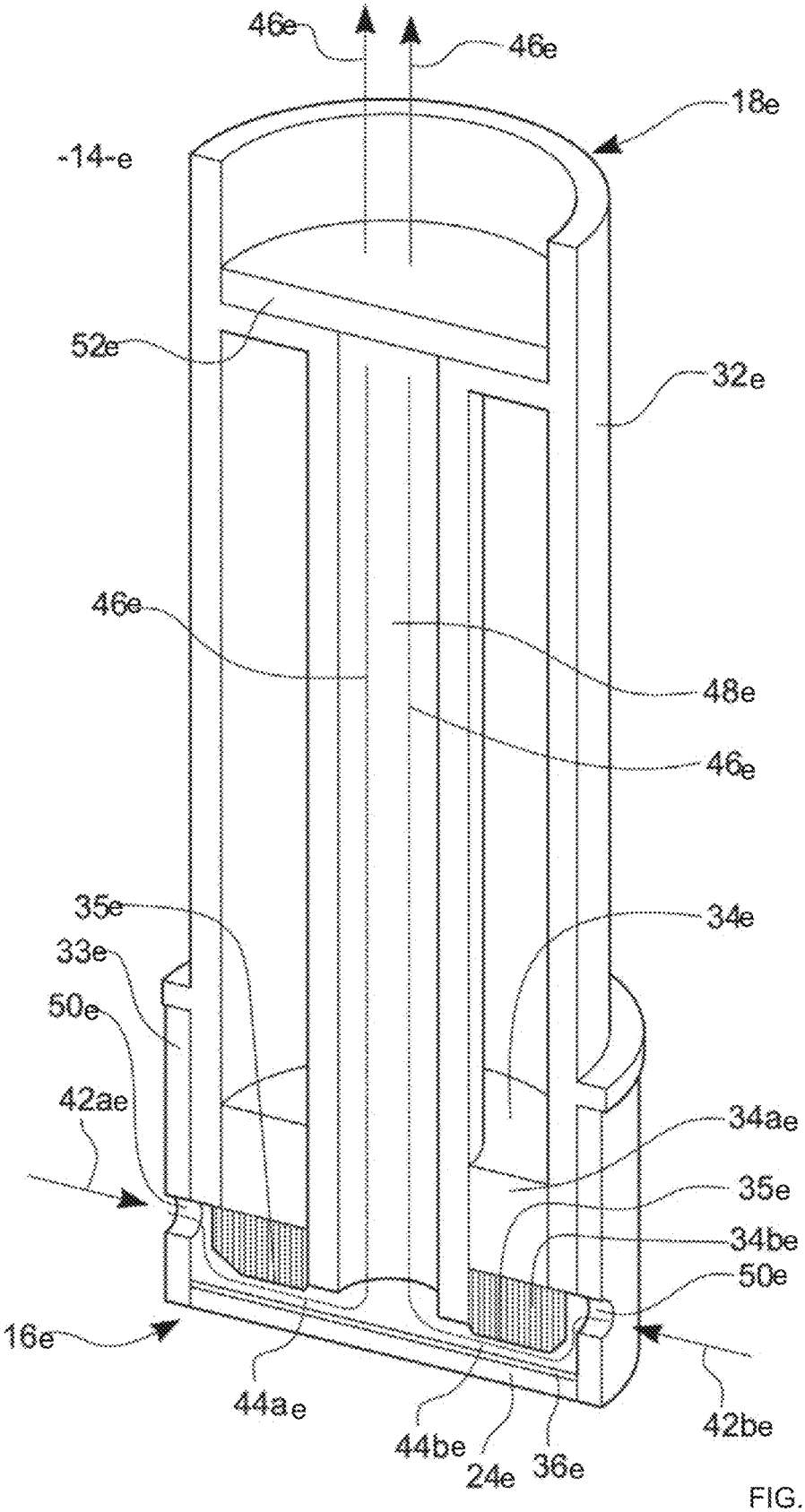
FIG. 66 is a cross-section side view of aerosol carrier according to one or more embodiments of the sixth mode of the present disclosure.
Figure 67:
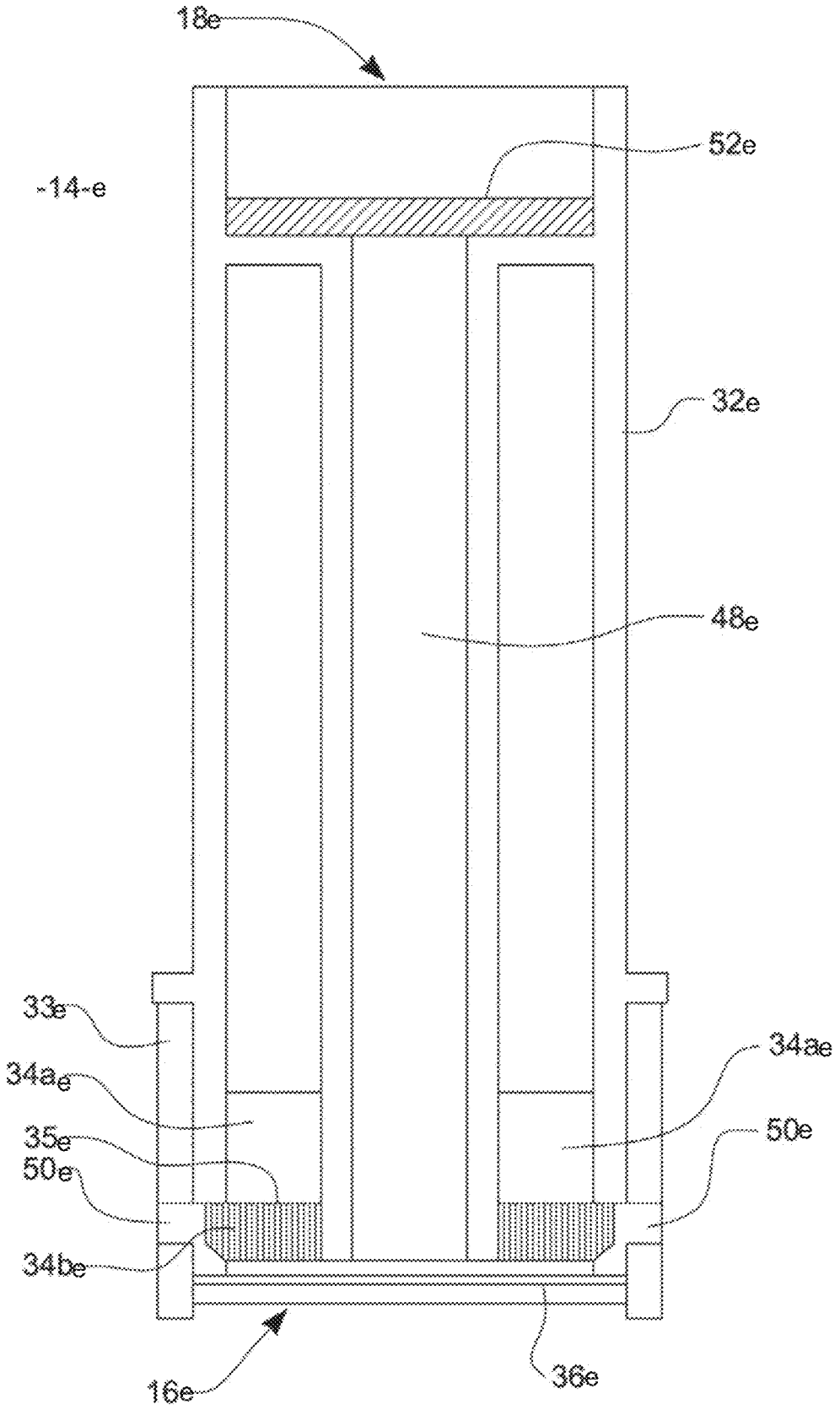
FIG. 67 is a perspective cross-section side view of the aerosol carrier of FIG. 66.

In the arrangements shown in FIGS. 63 to 65, the air streams 44*ae*, 39 are on opposite sides of the housing FIGS. 66 and 67 shows an alternative configuration, in which the fluid-transfer article is annular, and the air streams 44*ae* is then in the form of annular diaphragm. Note that, in FIGS. 66 and 67, the ends of the capillary tubes forming the air streams 44*ae* are illustrated terminating just short of the conduction element 36*e*. This is a possible arrangement, but it is also possible that the capillary tubes extend to the air streams 44*ae*. The small space between the ends of the capillary tubes and the air streams 44*ae* in FIGS. 66 and 67 is shown to enable the air flow in the apparatus to be illustrated. Thus, FIGS. 66 and 67 illustrate an aerosol carrier 14*e* according to one or more possible arrangements in more detail.

FIG. 66 is a cross-section side view illustration of the aerosol carrier 14*e* and FIG. 67 is a perspective cross-section side view illustration of the aerosol carrier 14*e*.

As can be seen from FIGS. 66 and 67, the aerosol carrier 14*e* is generally tubular in form. The aerosol carrier 14*e* comprises housing 32*e*, which defines the external walls of the aerosol carrier 14*e* and which defines therein a chamber in which are disposed the fluid-transfer article 34*e* (adjacent the first end 16*e* of the aerosol carrier 14*e*) and internal walls defining the air streams 44*ae*. Air streams 44*ae* defines a fluid pathway for an outgoing air stream from the air streams 44*ae* to the second end 18*e* of the aerosol carrier 14*e*. In the examples illustrated in FIGS. 65 and 66, the fluid-transfer article 34*e* is an annular shaped element located around the air streams 44*ae*. As in the arrangements of FIGS. 63 to 65, the heater 24*e* (and air streams 44*ae* conduction element 36*e* if present) are mounted in a further housing 33*e*, which further housing 33*e* is separable from the housing 32*e* containing the fluid-transfer article.

In walls of the further housing 33*e*, there are provided air streams 44*ae* to provide a fluid communication pathway for an incoming air stream to reach the fluid-transfer article 34*e*, and particularly the air-flow pathway defined across the surface of the conduction element 36*e* (or across the surface of the heater 24*e*), and passing among the ends of the capillary tubes forming the air streams 44*ae* of the aerosol-transfer article 34*e*.

In the illustrated example of FIGS. 66 and 67, the aerosol carrier 14*e* further comprises air streams 44*ae*. The air streams 44*ae* is located across the air streams 44*ae* such that an outgoing air stream passing through the air streams 44*ae* passes through the air streams 44*ae*.

With reference to FIG. 66, when a user sucks on a mouthpiece of the apparatus (or on the second end 18*e* of the aerosol carrier 14*e*, if configured as a mouthpiece), air is drawn into the carrier through air streams 44*ae* extending through walls in the housing 32*e* of the aerosol carrier 14*e*.

An air streams 44*ae* from a first side of the aerosol carrier 14*e* is directed to a first side of the air streams 44*ae* of the fluid-transfer article 34*e* (e.g. via a gas communication pathway within the housing of the carrier). An air streams 44*ae* from a second side of the aerosol carrier 14*e* is directed to a second side of the air streams 44*ae* of the fluid-transfer article 34*e* (e.g. via a gas communication pathway within the housing of the carrier). When the air streams 44*ae* from the first side of the aerosol carrier 14*e* reaches the first side of the air streams 44*ae*, the air streams 44*ae* from the first side of the aerosol carrier 14*e* flows around the ends of the capillary tubes of the air streams 44*ae* across the conduction element 36*e* (or across the heater 24*e*). Likewise, when the air streams 44*ae* from the second side of the aerosol carrier 14*e* reaches the second side of the air streams 44*ae*, the air streams 44*ae* from the second side of the aerosol carrier 14*e* flows around the ends of the capillary tubes of the air streams 44*ae* across the conduction element 36*e* (or across heater 24*e*). The air streams from each side are denoted by dashed air streams 44*ae* and 44*b* in FIG. 8. As these air streams 44*a* and 44*b* flow, aerosol precursor at the ends of the capillary tubes or on the conduction element 36*e* (or on the heater 24*e*) air streams 44*ae* is entrained in air streams 44*ae* and 44*be*.

In use, the heater 24*e* of the apparatus 12*e* to raise a temperature of the conduction element 36*e* to a sufficient temperature to release, or liberate, captive substances (i.e. the aerosol precursor) to form a vapour and/or aerosol, which is drawn downstream. As the air streams 44*ae* and 44*be* continue their passages, more released aerosol precursor is entrained within the air streams 44*ae* and 44*be*. When the air streams 44*ae* and 44*be* entrained with aerosol precursor meet at a mouth of the air streams 44*ae*, they enter the air streams 44*ae* and continue until they pass through air streams 44*ae* and air streams 44*ae*, either as a single outgoing air stream, or as air streams 44*ae* (as shown). The air streams 44*ae* are directed to an outlet, from where it can be inhaled by the user directly (if the second end 18*e* of the aerosol capsule 14*e* is configured as a mouthpiece), or via a mouthpiece. The air streams 44*ae* entrained with aerosol precursor are directed to the outlet (e.g. via a gas communication pathway within the housing of the carrier).

Figure 68:
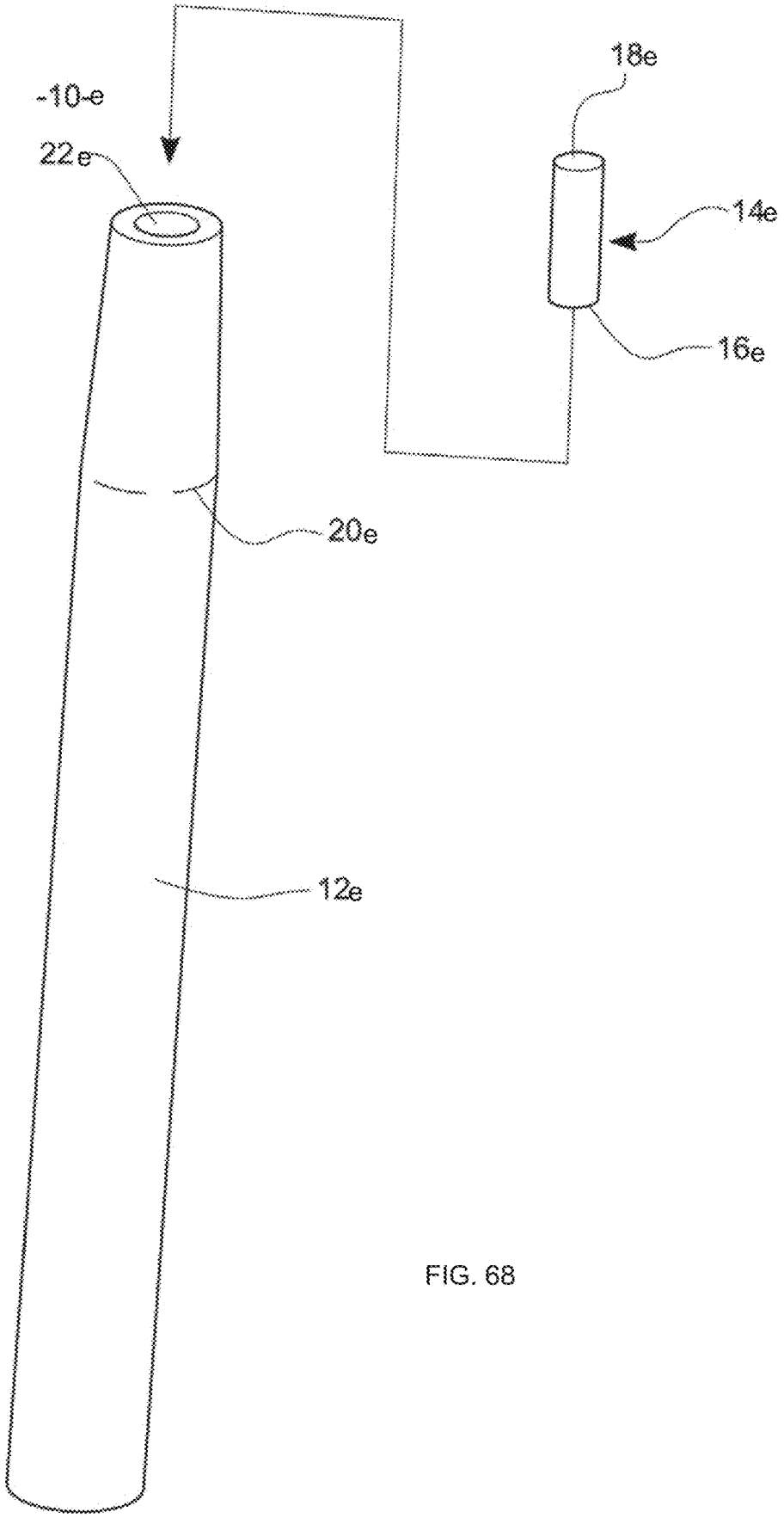
FIG. 68 is an exploded perspective view illustration of a kit-of-parts for assembling the system according to one or more embodiments of the sixth mode of the present disclosure.

FIG. 68 is an exploded perspective view illustration of a kit-of-parts for assembling an aerosol delivery system 10*e*.

As will be appreciated, in the arrangements described above, the fluid-transfer article 34*e* is provided within a housing 32*e* of the aerosol carrier 14*e*. In such arrangements, the housing of the carrier 14*e* serves to protect the aerosol precursor-containing fluid-transfer article 34*e*, whilst also allowing the carrier 14*e* to be handled by a user without his/her fingers coming into contact with the aerosol precursor liquid retained therein.

As will be appreciated, in the arrangements described above, the fluid-transfer article 34*d* is provided within a housing 32*d* of the aerosol carrier 14*d*. In such arrangements, the housing of the carrier 14*d* serves to protect the aerosol precursor-containing fluid-transfer article 34*d*, whilst also allowing the carrier 14*d* to be handled by a user without his/her fingers coming into contact with the aerosol precursor liquid retained therein.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps. It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

The invention claimed is:

1. An aerosol-generation apparatus comprising;

a reservoir for holding an aerosol precursor;

an air duct passing from an air inlet of said apparatus to a mouthpiece of said apparatus, thereby to allow a user to draw air through said air duct from said inlet to said mouthpiece;

a mesh through which said air duct passes, said mesh being arranged to receive said aerosol precursor from said reservoir, and atomise said aerosol precursor on said mesh due to passage of air through said mesh, thereby to form a spray of atomised aerosol precursor from said mesh;

a heater arranged to receive said spray of atomized aerosol precursor from said mesh and to heat and thereby vaporise said atomized aerosol precursor to form a mixture of vapour and air in said air duct at said heater;

wherein said mouthpiece is arranged to receive said mixture from said heater via said air duct.

2. An aerosol-generation apparatus according to claim 1, further including a wick between said reservoir and said mesh, said wick being arranged to receive aerosol precursor from said reservoir and to transfer said aerosol precursor to said mesh.

3. An aerosol-generation apparatus according to claim 2, wherein said wick is of fibrous material.

4. An aerosol-generation apparatus according to claim 2, wherein said wick is of porous polymeric material.

5. An aerosol-generation apparatus according to claim 2, wherein said wick is of porous ceramic material.

6. An aerosol-generation apparatus of claim 1, wherein at least a part of the reservoir is of porous polymer material.

7. An aerosol delivery system comprising:

an aerosol-generation apparatus comprising;

a reservoir for holding an aerosol precursor;

an air duct passing from an air inlet of the aerosol-generation apparatus to a mouthpiece of the aerosol-generation apparatus, thereby to allow a user to draw air through said air duct from said inlet to said mouthpiece;

a mesh through which said air duct passes, said mesh being arranged to receive said aerosol precursor from said reservoir, and atomise said aerosol precursor on said mesh due to passage of air through said mesh, thereby to form a spray of atomised aerosol precursor from said mesh;

a heater arranged to receive said spray of atomized aerosol precursor from said mesh and to heat and thereby vaporise said atomized aerosol precursor to form a mixture of vapour and air in said air duct at said heater;

wherein said mouthpiece is arranged to receive said mixture from said heater via said air duct;

a first housing having therein said reservoir, said mouthpiece, said mesh and parts of said air duct; and a second housing having therein said heater, and other parts of said air duct;

wherein said first and second housings are separable.

8. An aerosol delivery system according to claim 7, further including a wick between said reservoir and said mesh, said wick being arranged to receive aerosol precursor from said reservoir and to transfer said aerosol precursor to said mesh wherein said first housing also has said wick therein.

9. An aerosol delivery system according to claim 7, wherein said air inlet is in said second housing.

* * * * *